US008967724B2

(12) United States Patent
Battey et al.

(10) Patent No.: US 8,967,724 B2
(45) Date of Patent: Mar. 3, 2015

(54) CHAIR ARM ASSEMBLY

(71) Applicant: Steelcase Inc., Grand Rapids, MI (US)

(72) Inventors: Robert J. Battey, Middleville, MI (US); Richard N. Roslund, Jr., Jenison, MI (US); Nathan McCaughan, Grand Haven, MI (US); Pradeep Mydur, Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 14/029,194

(22) Filed: Sep. 17, 2013

(65) Prior Publication Data

US 2014/0077566 A1 Mar. 20, 2014

Related U.S. Application Data

(63) Continuation of application No. 29/432,765, filed on Sep. 20, 2012, now Pat. No. Des. 697,726, and a continuation of application No. 29/432,793, filed on Sep. 20, 2012, now Pat. No. Des. 699,061.

(Continued)

(51) Int. Cl.

| | |
|---|---|
| ***A47C 7/54*** | (2006.01) |
| ***A47C 7/24*** | (2006.01) |
| ***A47C 7/46*** | (2006.01) |

(Continued)

(52) U.S. Cl.

CPC ... *A47C 7/24* (2013.01); *A47C 7/46* (2013.01); *A47C 1/032* (2013.01); *A47C 1/03261* (2013.01); *A47C 1/03272* (2013.01); *A47C 1/024* (2013.01); *A47C 7/54* (2013.01); *A47C 31/023* (2013.01); *A47C 1/03* (2013.01); *A47C 1/03255* (2013.01); *A47C 1/03266* (2013.01); *A47C 3/30* (2013.01); *A47C 7/022* (2013.01);

(Continued)

(58) Field of Classification Search

USPC ..... 297/411.35, 411.36, 411.37, 411.38, 297/411.39

See application file for complete search history.

(56) References Cited

U.S. PATENT DOCUMENTS

| | | | |
|---|---|---|---|
| 1,706,634 | A | 3/1929 | Seils |
| 1,776,418 | A | 9/1930 | Dujardin |

(Continued)

FOREIGN PATENT DOCUMENTS

| | | |
|---|---|---|
| CN | 2838408 | 11/2006 |
| CN | 2907395 | 6/2007 |

(Continued)

*Primary Examiner* — Rodney B White

(74) *Attorney, Agent, or Firm* — Price Heneveld LLP

(57) ABSTRACT

A chair assembly includes a four-bar linkage assembly including a first linkage member and a second linkage member each having a U-shaped cross-sectional configuration that cooperate to form an interior space, a third linkage member and a fourth linkage member, wherein the linkage members are pivotably coupled to on another such that an upper end of the four-bar linkage is vertically adjustable between a raised and lowered positions, an arm rest assembly supported on the upper end of the four-bar linkage assembly, and a locking assembly including a first locking link having a first surface and a second locking link having plurality of teeth corresponding to a plurality of vertical positions of the four-bar link located between the raised and lowered positions, wherein the locking links are movable between locked and unlocked positions, and wherein the first and second locking links are located within the interior space.

26 Claims, 61 Drawing Sheets

Related U.S. Application Data

(60) Provisional application No. 60/703,677, filed on Sep. 20, 2012, provisional application No. 61/703,667, filed on Sep. 20, 2012, provisional application No. 61/703,666, filed on Sep. 20, 2012, provisional application No. 61/703,515, filed on Sep. 20, 2012, provisional application No. 61/703,663, filed on Sep. 20, 2012, provisional application No. 61/703,659, filed on Sep. 20, 2012, provisional application No. 61/703,661, filed on Sep. 20, 2012, provisional application No. 61/754,803, filed on Jan. 21, 2013.

(51) Int. Cl.

| | |
|---|---|
| ***A47C 1/032*** | (2006.01) |
| ***A47C 1/024*** | (2006.01) |
| ***A47C 31/02*** | (2006.01) |
| ***A47C 1/03*** | (2006.01) |
| ***A47C 3/30*** | (2006.01) |
| ***A47C 7/02*** | (2006.01) |
| ***A47C 7/14*** | (2006.01) |
| ***A47C 7/18*** | (2006.01) |
| ***A47C 7/40*** | (2006.01) |

(52) U.S. Cl.

CPC . *A47C 7/14* (2013.01); *A47C 7/185* (2013.01); *A47C 7/40* (2013.01); *A47C 7/462* (2013.01)

USPC ..... 297/411.35; 297/411.36; 297/411.37; 297/411.38

(56) References Cited

U.S. PATENT DOCUMENTS

| | | | | |
|---|---|---|---|---|
| 2,035,451 | A | 3/1936 | Bell | |
| 2,098,500 | A | 11/1937 | Koenigkramer et al. | |
| 2,204,893 | A | 6/1940 | Johnson | |
| 2,224,444 | A | 10/1940 | Murrin | |
| 2,784,770 | A | 3/1957 | Herr | |
| 2,844,193 | A | 7/1958 | Lauterbach | |
| 3,829,159 | A | 8/1974 | Leffler | |
| 4,141,586 | A | 2/1979 | Goldner et al. | |
| 4,165,901 | A | 8/1979 | Swenson et al. | |
| 4,244,623 | A | 1/1981 | Hall et al. | |
| 4,307,913 | A | 12/1981 | Spiegelhoff | |
| 4,311,338 | A | 1/1982 | Moorhouse | |
| 4,400,033 | A | 8/1983 | Pietsch | |
| 4,429,819 | A | 2/1984 | Palovaara | |
| 4,496,190 | A * | 1/1985 | Barley | 297/411.38 |
| 4,549,629 | A | 10/1985 | Komuro | |
| 4,634,182 | A | 1/1987 | Tanaka | |
| 4,655,501 | A | 4/1987 | Ishigami et al. | |
| 4,793,204 | A | 12/1988 | Kubasiak | |
| 4,807,935 | A | 2/1989 | King | |
| 4,828,323 | A | 5/1989 | Brodersen et al. | |
| 4,836,608 | A | 6/1989 | Sugiyama | |
| 4,872,727 | A | 10/1989 | Rye | |
| 4,887,866 | A | 12/1989 | Rusin | |
| 4,902,072 | A | 2/1990 | Chancellor, Jr. | |
| 4,917,438 | A | 4/1990 | Morgan | |
| 4,946,226 | A | 8/1990 | Hurn et al. | |
| 4,957,321 | A | 9/1990 | Martin et al. | |
| 4,978,171 | A | 12/1990 | Tateyama | |
| 5,106,160 | A | 4/1992 | Nomura et al. | |
| 5,135,190 | A | 8/1992 | Wilson | |
| 5,143,422 | A | 9/1992 | Althofer et al. | |
| 5,265,938 | A | 11/1993 | Melhuish et al. | |
| 5,320,415 | A | 6/1994 | Krebs | |
| 5,439,267 | A | 8/1995 | Peterson et al. | |
| 5,476,304 | A | 12/1995 | Gulliver et al. | |
| 5,489,143 | A | 2/1996 | Adachi et al. | |
| 5,586,811 | A | 12/1996 | Tornero | |
| 5,590,934 | A | 1/1997 | Gibbs | |
| 5,597,208 | A | 1/1997 | Bonutti | |
| 5,599,067 | A | 2/1997 | Schuelke et al. | |
| 5,651,586 | A | 7/1997 | Groth | |
| 5,676,483 | A | 10/1997 | Koubek | |
| 5,702,157 | A | 12/1997 | Hurite | |
| 5,746,480 | A | 5/1998 | Bonutti | |
| 5,752,683 | A | 5/1998 | Novis et al. | |
| 5,772,282 | A | 6/1998 | Stumpf et al. | |
| 5,845,965 | A | 12/1998 | Heath et al. | |
| 5,884,975 | A | 3/1999 | Su | |
| 5,975,640 | A | 11/1999 | Chen | |
| 5,984,416 | A | 11/1999 | Waldo et al. | |
| 6,017,091 | A | 1/2000 | Cao | |
| 6,053,578 | A | 4/2000 | van Hekken et al. | |
| 6,059,366 | A | 5/2000 | Hu | |
| 6,074,012 | A | 6/2000 | Wu | |
| 6,076,892 | A | 6/2000 | van Hekken et al. | |
| 6,086,156 | A | 7/2000 | Breen et al. | |
| 6,139,105 | A | 10/2000 | Morgos et al. | |
| 6,176,550 | B1 | 1/2001 | Lamart et al. | |
| 6,203,109 | B1 | 3/2001 | Bergsten et al. | |
| 6,302,486 | B1 | 10/2001 | Lamart et al. | |
| 6,460,932 | B1 | 10/2002 | Kopish et al. | |
| 6,467,847 | B2 | 10/2002 | Bidare | |
| 6,502,904 | B1 | 1/2003 | Hansen | |
| 6,619,746 | B2 | 9/2003 | Roslund, Jr. | |
| 6,659,558 | B2 | 12/2003 | Sugimoto | |
| 6,709,058 | B1 | 3/2004 | Diffrient | |
| 6,742,845 | B2 | 6/2004 | Nock | |
| 6,799,803 | B1 | 10/2004 | Lee et al. | |
| 6,908,158 | B2 | 6/2005 | Willette et al. | |
| 6,948,775 | B2 | 9/2005 | Tsai | |
| 7,066,546 | B2 | 6/2006 | Trego et al. | |
| 7,077,468 | B2 | 7/2006 | Maierholzner | |
| 7,100,242 | B2 | 9/2006 | Maierholzner | |
| 7,134,724 | B2 | 11/2006 | Chabanne et al. | |
| 7,159,947 | B1 | 1/2007 | Lee | |
| 7,201,449 | B2 | 4/2007 | Tsai | |
| 7,201,450 | B1 | 4/2007 | Chen | |
| 7,243,997 | B1 | 7/2007 | Tornero | |
| 7,360,839 | B1 | 4/2008 | Chen | |
| 7,364,237 | B2 | 4/2008 | Grable et al. | |
| 7,419,222 | B2 | 9/2008 | Schmitz et al. | |
| 7,475,946 | B2 * | 1/2009 | Diffrient | 297/411.38 X |
| 7,533,939 | B2 | 5/2009 | Fookes et al. | |
| 7,562,603 | B2 | 7/2009 | Momozu et al. | |
| 7,641,284 | B2 | 1/2010 | Jones et al. | |
| 7,815,259 | B2 | 10/2010 | Fookes et al. | |
| 7,828,389 | B2 | 11/2010 | Oda | |
| 7,837,269 | B2 | 11/2010 | Bock | |
| 7,857,393 | B2 | 12/2010 | Cebula et al. | |
| 8,016,360 | B2 | 9/2011 | Machael et al. | |
| 2002/0043863 | A1 | 4/2002 | Roslund et al. | |
| 2002/0074844 | A1 | 6/2002 | Klingstedt et al. | |
| 2002/0149247 | A1 | 10/2002 | Diffrient | |
| 2002/0170381 | A1 | 11/2002 | Hansel et al. | |
| 2002/0190561 | A1 | 12/2002 | Phillips et al. | |
| 2003/0030317 | A1 | 2/2003 | Chen | |
| 2003/0178882 | A1 * | 9/2003 | Schmitz et al. | 297/411.36 |
| 2004/0130200 | A1 | 7/2004 | Willette et al. | |
| 2004/0227388 | A1 | 11/2004 | Wang | |
| 2004/0245835 | A1 | 12/2004 | Diffrient | |
| 2006/0091714 | A1 * | 5/2006 | Schmitz et al. | 297/411.36 |
| 2007/0069565 | A1 | 3/2007 | Diffrient | |
| 2009/0091174 | A1 * | 4/2009 | Diffrient | 297/411.36 |
| 2010/0102170 | A1 | 4/2010 | Laconte | |
| 2010/0187889 | A1 * | 7/2010 | Bruns et al. | 297/411.35 |
| 2011/0140498 | A1 | 6/2011 | Tsai | |
| 2011/0248543 | A1 | 10/2011 | Hitchcock et al. | |
| 2013/0007609 | A1 | 1/2013 | Bak et al. | |

FOREIGN PATENT DOCUMENTS

| | | |
|---|---|---|
| CN | 201048728 | 4/2008 |
| CN | 201948443 | 8/2011 |
| CN | 202020064 | 11/2011 |
| DE | 20106718 | 8/2002 |
| DE | 20112915 | 9/2002 |
| DE | 10119017 | 1/2003 |
| DE | 20303566 | 5/2003 |

(56) References Cited

FOREIGN PATENT DOCUMENTS

| | | |
|---|---|---|
| DE | 20201 1001282 | 4/2012 |
| DE | 202012103626 | 11/2012 |
| EP | 0010867 | 5/1980 |
| EP | 0018662 | 11/1982 |
| EP | 0645976 | 4/1995 |
| EP | 0890473 | 1/1999 |
| EP | 0960614 | 12/1999 |
| EP | 1035790 | 9/2000 |
| EP | 1284115 | 2/2003 |
| EP | 1287765 | 3/2003 |
| EP | 1414670 | 5/2004 |
| EP | 1424029 | 6/2004 |
| EP | 1457140 | 9/2004 |
| EP | 1568297 | 8/2005 |
| EP | 1778051 | 5/2007 |
| EP | 1868466 | 12/2007 |
| EP | 1874165 | 1/2008 |
| EP | 2197319 | 6/2010 |
| EP | 2282656 | 2/2011 |
| EP | 2292512 | 3/2011 |
| EP | 2474249 | 7/2012 |
| EP | 2502521 | 9/2012 |
| EP | 2567636 | 3/2013 |
| GB | 20201000991 | 3/2010 |
| JP | 10313972 | 12/1998 |
| JP | 0129169 | 2/2001 |
| JP | 2004122994 | 4/2004 |
| WO | 0074531 | 12/2000 |
| WO | 2004073456 | 9/2004 |
| WO | 2006094260 | 3/2007 |
| WO | 2008134801 | 11/2008 |
| WO | 2009018402 | 2/2009 |
| WO | 2011130270 | 10/2011 |
| WO | 201282071 | 6/2012 |

* cited by examiner

CHAIR ARM ASSEMBLY

REFERENCE TO RELATED APPLICATIONS

This application claims the benefit of U.S. Provisional Patent Application 61/703,677 filed Sep. 20, 2012, entitled "CHAIR ASSEMBLY," 61/703,667 filed Sep. 20, 2012, entitled "CHAIR ARM ASSEMBLY," 61/703,666 filed Sep. 20, 2012, entitled "CHAIR ASSEMBLY WITH UPHOLSTERY COVERING," 61/703,663 filed Sep. 20, 2012, entitled "CHAIR BACK MECHANISM AND CONTROL ASSEMBLY," 61/703,659 filed Sep. 20, 2012, entitled "CONTROL ASSEMBLY FOR CHAIR," 61/703,661 filed Sep. 20, 2012, entitled "CHAIR ASSEMBLY," 61/754,803 filed Jan. 21, 2013, entitled "CHAIR ASSEMBLY WITH UPHOLSTERY COVERING," 61/703,515 filed Sep. 20, 2012, entitled "SPRING ASSEMBLY AND METHOD," U.S. Design Patent Application No. 29/432,765 filed Sep. 20, 2012, entitled "CHAIR," and U.S. Design Patent Application No. 29/432,793 filed Sep. 20, 2012, entitled "ARM ASSEMBLY," the entire disclosures of which are incorporated herein by reference.

BACKGROUND OF THE INVENTION

The present invention relates to a chair assembly, and in particular to an office chair arm assembly vertically and horizontally adjustable, and including an arm cap assembly that is pivotably and linearly adjustable.

BRIEF SUMMARY OF THE INVENTION

One aspect of the present invention is to provide a chair assembly that comprises a 4-bar linkage assembly comprising a first linkage member having a first end and a second end, a second linkage member having a first end and a second end, a third linkage member having a first end pivotably coupled to the first end of the first linkage member for rotation about a first pivot point, and a second end pivotably coupled to the first end of the second linkage member for rotation about a second pivot point, and a fourth linkage member having a first end pivotably coupled to the second end of the first linkage member for rotation about a third pivot point, and second end pivotably coupled to the second end of the second linkage member for rotation about a fourth pivot point, wherein the 4-bar linkage assembly includes a lower end and an upper end that is adjustable between a raised position, and a lowered position. The chair assembly further comprises an arm rest assembly adapted to support the arm of a seated user thereon and supported on an upper end of the 4-bar linkage assembly, wherein the lower end of the 4-bar linkage assembly is pivotably supported by an arm support structure for pivotable movement of about a fifth pivot point, such that the upper end of the 4-bar linkage assembly is movable between a first position and a second position located laterally outward from the first position.

Another aspect of the present invention is to provide a chair assembly comprising a 4-bar linkage assembly comprising a first linkage member having a first end, a second end, and a U-shaped cross-sectional configuration located along the length thereof, a second linkage member having a first end, a second end, and a U-shaped cross-sectional configuration located along the length thereof, and wherein the first linkage member and the second linkage member cooperate to form an interior space extending longitudinally along the lengths of the first and second linkage members, a third linkage member having a first end pivotably coupled to the first end of the first linkage member for rotation about the first pivot point, and a second end pivotably coupled to the first end of the second linkage member for rotation about a second pivot point, and a fourth linkage member having a first end pivotably coupled to the second end of the first linkage member for rotation about a third pivot point, and a second end pivotably coupled to the second end of the second linkage member for rotation about a fourth pivot point, wherein the 4-bar linkage assembly includes a lower end and an upper end that is vertically adjustable between a raised position, and a lowered position. The chair assembly further comprises an arm rest assembly adapted to support the arm of the seated user thereon and supported on an upper end of the 4-bar linkage assembly, and the locking assembly including a first locking link having a first surface and a second locking link having a plurality of teeth corresponding to a plurality of vertical positions of the 4-bar linkage located between the raised position and the lowered position, wherein the first and second locking links are movable with respect to one another between a locked position, wherein the first surface engages at least one of the plurality of teeth to prevent adjustment of the 4-bar linkage between the raised and lowered positions, and an unlocked position, wherein the first surface is spaced from the plurality of teeth, thereby allowing the 4-bar linkage to be adjusted between the raised and lowered positions, and wherein at least a substantial portion of both the first and second locking links are located within the interior space.

Yet another aspect of the present invention is to provide a chair assembly that comprises an arm support structure, an arm rest assembly adapted to comfortably support the arm of a seated user thereon, an arm support assembly having a lower end supported by the arm support structure, and an upper end supporting the arm rest assembly thereon, wherein the arm support assembly is adjustable between a vertically raised position and a vertically lowered position, and a locking assembly. The locking assembly comprises a first locking link having at least one of a first surface and a plurality of teeth, a second locking link having the other of the first surface and the plurality of teeth, movable between a locked position, wherein the first surface engages at least one of the plurality of teeth to prevent adjustment of the arm support assembly between the raised and lowered positions, and an unlocked position, wherein the first surface is spaced from the plurality of teeth, thereby allowing the arm support assembly to be adjusted between the raised and lowered positions, an actuator link operably coupled with the first locking link and adapted to move between a first position, wherein the first locking link is moved by the actuator link to the locked position, and a second position, wherein the first locking link is moved by the actuator link to the unlocked position, and an actuator member operably coupled with the actuator link, wherein at least a portion of the actuator member may be actuate by a seated user, thereby allowing the user to move the actuator link between the first and second positions.

Another aspect of the present invention is an arm rest assembly for an office chair. The arm rest assembly includes an outer member having a cushion mounted thereto, and an inner member configured to be secured to an office chair structure. The inner member has teeth disposed thereon. The arm rest assembly also includes upper and lower members extending between and pivotably interconnecting the inner and outer members to form a 4-bar linkage. The arm rest assembly also includes a vertical adjustment lock assembly to lock the height of the cushion relative to the inner member. The vertical adjustment lock assembly includes a movable release member, and an actuator member that shifts between locked and unlocked positions upon movement of the release member. The actuator member defines a base end. The vertical adjustment lock assembly further includes a moveable locking member with teeth that selectively engage the teeth on the inner member of the 4-bar linkage. A spring biases the actuator member towards the locked position, and also biases the teeth of the pivotable locking member out of engagement with the teeth on the inner member of the 4-bar linkage. The base end of the actuator member moves into a first recess of the locking member to permit movement of the locking member teeth out of engagement with the teeth of the inner member of the 4-bar linkage. The arm rest assembly further includes a second lock having a locking second recess in the locking member that receives the end of the actuator member and prevents movement of the locking member when a downward force is applied to the cushion.

Still yet another aspect of the present invention is to provide a chair assembly that comprises a seat support structure including a seat support surface configured to support a seated user thereon, an arm rest assembly including an arm support surface to support the arm of a seated user thereon, and an arm support assembly having an upper end supporting the arm support assembly in a greater vertical height than the seat support surface, and a lower end that includes a select one of a pivot boss and a pivot aperture. The chair assembly further comprises an arm support structure that includes the other of the pivot boss and the pivot aperture, wherein the pivot boss is received within the pivot aperture for pivotably supporting the arm support assembly for rotation about a pivot point between a first position and a second position, the pivot boss having a conical-shape, and wherein the aperture has a conical-shape closely corresponding to the shape of the pivot boss.

Another aspect of the present invention is to provide a chair assembly that comprises an arm support assembly having an upper end and a lower end, an arm rest assembly adapted to support the arm of a seated user thereon and supported on the upper end of the arm support assembly, and an arm support structure pivotably supporting the arm support assembly for pivoting movement about a substantially vertical axis, such that the upper end of the arm support assembly is pivotable about the substantially vertical axis between a first position and a second position located laterally outward from the first position. The chair further comprises a seat support structure including a seat support surface configured to support a seated user thereon, wherein the seat support surface includes a longitudinal axis, and wherein the upper end of the arm support assembly moves greater than or equal to about 22° outwardly from an axis parallel with the longitudinal axis of the seat support surface, and wherein the upper end of the arm support assembly moves greater than or equal to about 17° inwardly from the axis parallel with the longitudinal axis of the seat support surface.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

Figure 1:
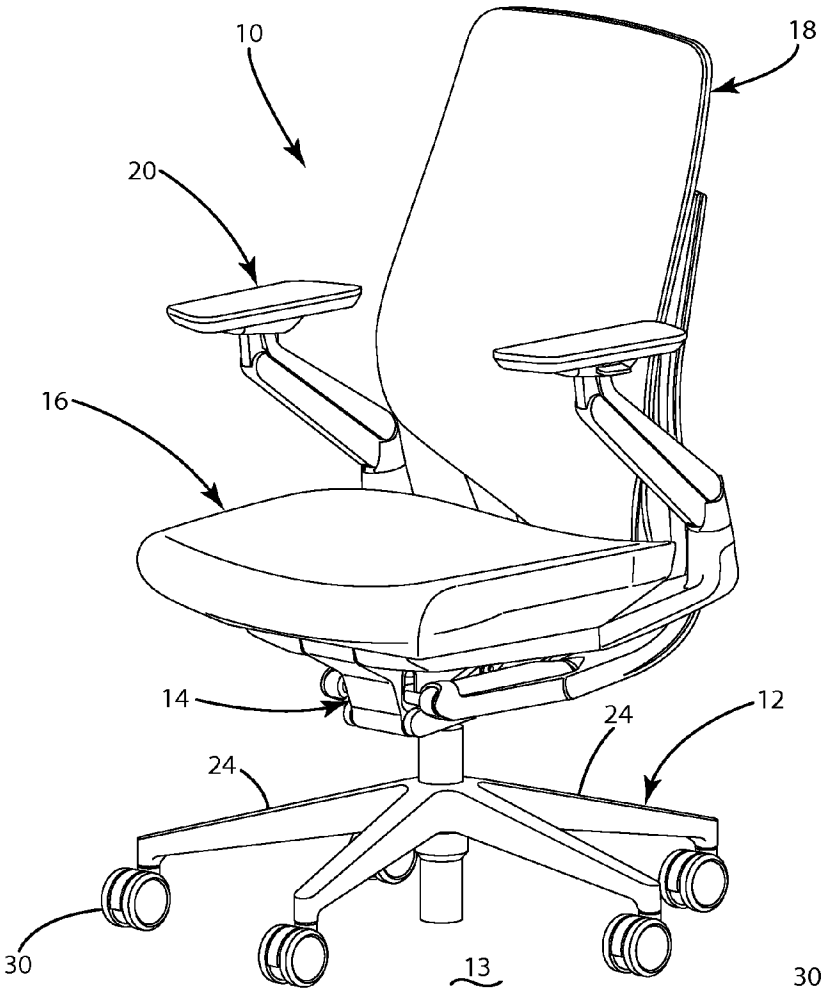
FIG. 1 is a front perspective view of a chair assembly embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise. Various elements of the embodiments disclosed herein may be described as being operably coupled to one another, which includes elements either directly or indirectly coupled with one another. Further, the term "chair" as utilized herein encompasses various seating arrangements, including office chairs, vehicle seating, home seating, stadium seating, theater seating, and the like.

Figure 2:
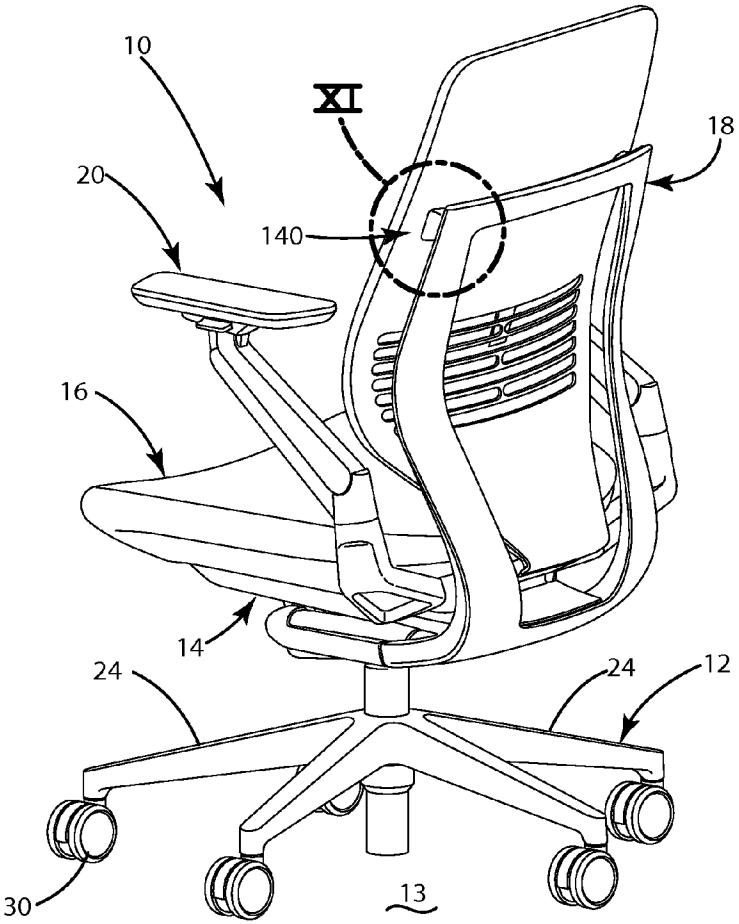
FIG. 2 is a rear perspective view of the chair assembly.
Figure 4:
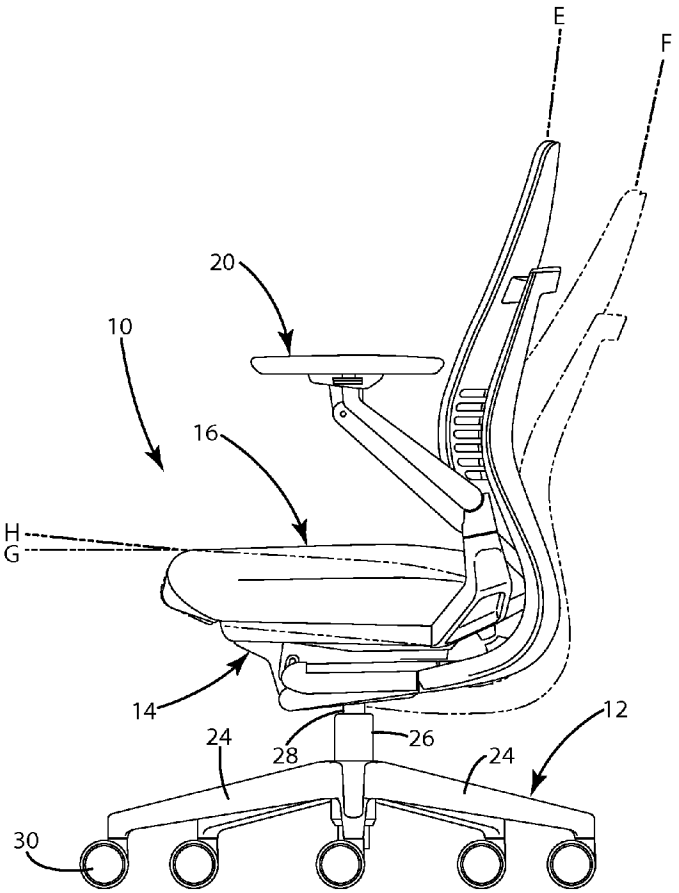
FIG. 4 is a side elevational view of the chair assembly showing the chair assembly in an upright position and in a reclined position in dashed line.

The reference numeral 10 (FIGS. 1 and 2) generally designates a chair assembly embodying the present invention. In the illustrated example, the chair assembly 10 includes a castered base assembly 12 abutting a supporting floor surface 13, a control or support assembly 14 supported by the castered base assembly 12, a seat assembly 16 and back assembly 18 each operably coupled with the control assembly 14, and a pair of arm assemblies 20. The control assembly 14 (FIG. 3) is operably coupled to the base assembly 12 such that the seat assembly 16, the back assembly 18 and the arm assemblies 20 may be vertically adjusted between a fully lowered position A and a fully raised position B, and pivoted about a vertical axis 21 in a direction 22. The seat assembly 16 is operably coupled to the control assembly 14 such that the seat assembly 16 is longitudinally adjustable with respect to the control assembly 14 between a fully retracted position C and a fully extended position D. The seat assembly 16 (FIG. 4) and the back assembly 18 are operably coupled with the control assembly 14 and with one another such that the back assembly 18 is movable between a fully upright position E and a fully reclined position F, and further such that the seat assembly 16 is movable between a fully upright position G and a fully reclined position H corresponding to the fully upright position E and the fully reclined position F of the back assembly 18, respectively.

The base assembly 12 includes a plurality of pedestal arms 24 radially extending and spaced about a hollow central column 26 that receives a pneumatic cylinder 28 therein. Each pedestal arm 24 is supported above the floor surface 13 by an associated caster assembly 30. Although the base assembly 12 is illustrated as including a multiple-arm pedestal assembly, it is noted that other suitable supporting structures maybe utilized, including but not limited to fixed columns, multiple leg arrangements, vehicle seat support assemblies, and the like.

Figure 5:
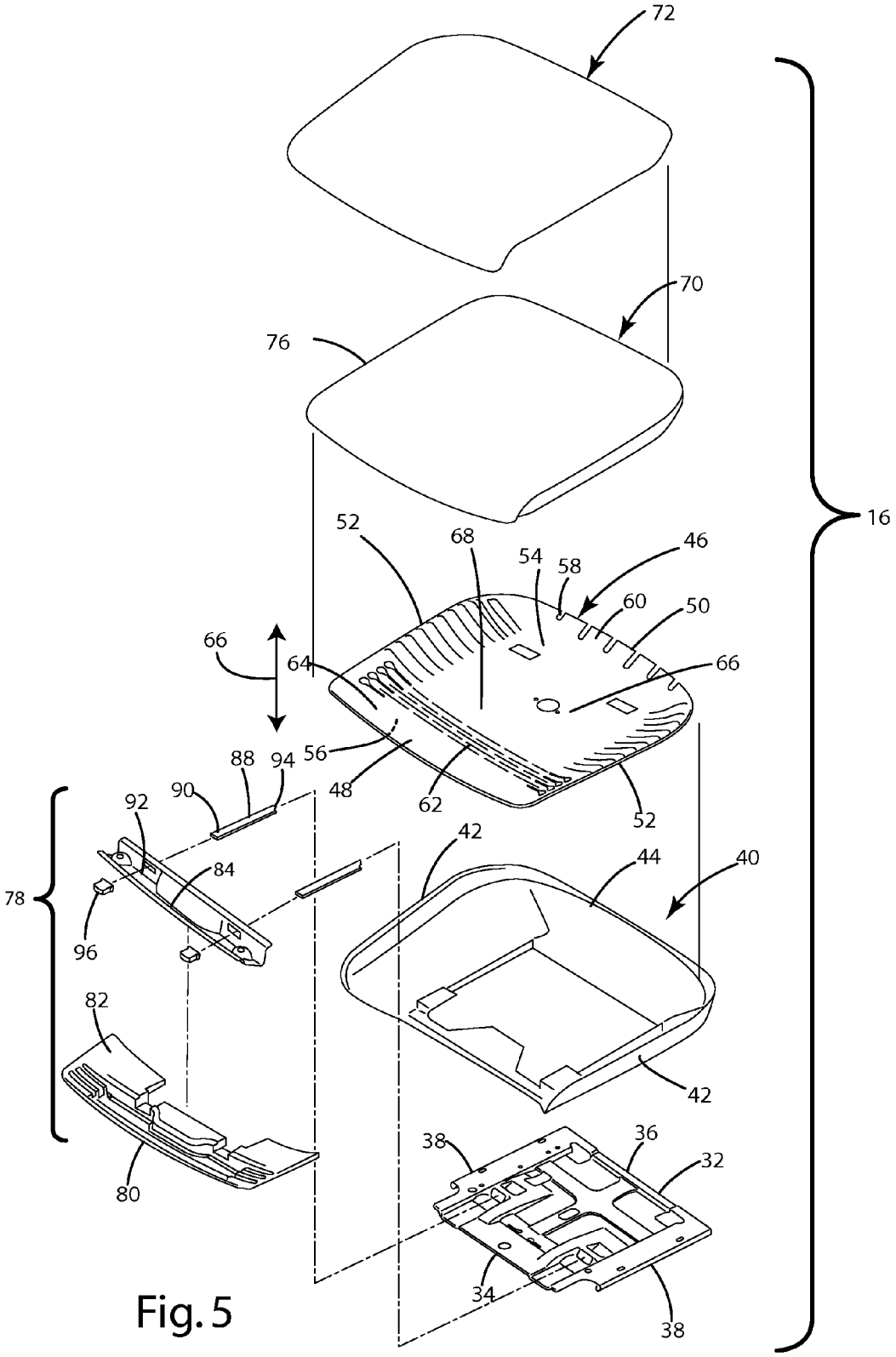
FIG. 5 is an exploded view of the seat assembly.
Figure 6:
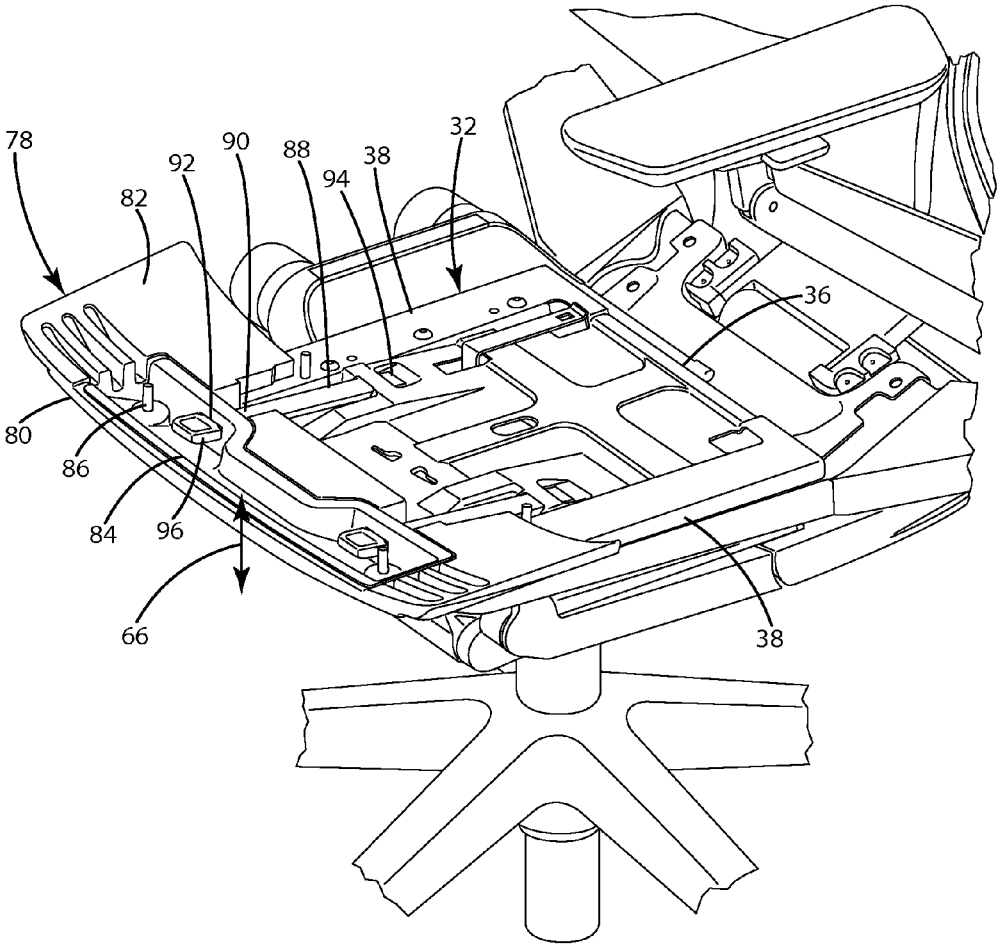
FIG. 6 is an enlarged perspective view of the chair assembly with a portion of the seat assembly removed to illustrate a spring support assembly.
Figure 8:
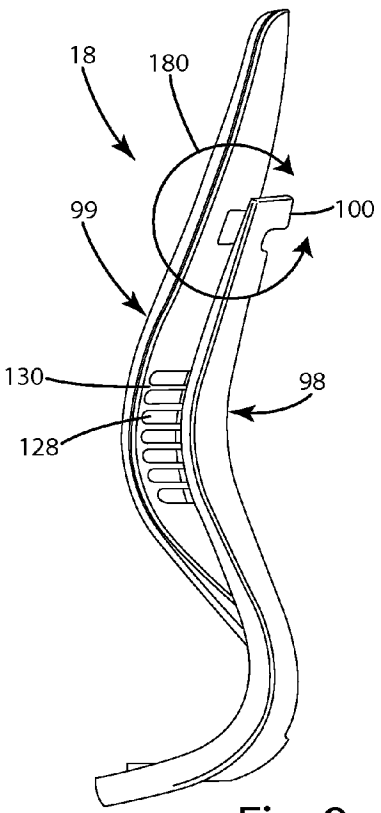
FIG. 8 is a side elevational view of the back assembly.

The seat assembly 16 (FIG. 5) includes a relatively rigid seat support plate 32 having a forward edge 34, a rearward edge 36, and a pair of C-shaped guide rails 38 defining the side edges of the seat support plate 32 and extending between the forward edge 34 and the rearward edge 36. The seat assembly 16 further includes a flexibly resilient outer seat shell 40 having a pair of upwardly turned side portions 42 and an upwardly turned rear portion 44 that cooperate to form an upwardly disposed generally concave shape. In the illustrated example, the seat shell 40 is comprised of a relatively flexible material such as a thermoplastic elastomer (TPE). In assembly, the outer seat shell 40 is secured and sandwiched between the seat support plate 32 and a plastic, flexibly resilient seat pan 46 which is secured to the seat support plate 32 by a plurality of mechanical fasteners. The seat pan 46 includes a forward edge 48, a rearward edge 50, side edges 52 extending between the forward edge 48 and the rearward edge 50, a top surface 54 and a bottom surface 56 that cooperate to form an upwardly disposed generally concave shape. In the illustrated example, the seat pan 46 includes a plurality of longitudinally extending slots 58 extending forwardly from the rearward edge 50. The slots 58 cooperate to define a plurality of fingers 60 therebetween, each finger 60 being individually flexibly resilient. The seat pan 46 further includes a plurality of laterally oriented, elongated apertures 62 located proximate the forward edge 48. The apertures 62 cooperate to increase the overall flexibility of the seat pan 46 in the area thereof, and specifically allow a forward portion 64 of the seat pan 46 to flex in a vertical direction 66 with respect to a rearward portion 68 of the seat pan 46, as discussed further below. The seat assembly 16 further includes a foam cushion member 70 that rests upon the top surface 54 of the seat pan 46 and is cradled within the outer seat shell 40, a fabric seat cover 72 (FIGS. 1 and 2), and an upper surface 76 of the cushion member 70. A spring support assembly 78 (FIGS. 5 and 6) is secured to the seat assembly 16 and is adapted to flexibly support the forward portion 64 of the seat pan 46 for flexure in the vertical direction 66. In the illustrated example, the spring support assembly 78 includes a support housing 80 comprising a foam and having side portions 82 defining an upwardly concave arcuate shape. The spring support assembly 78 further includes a relatively rigid attachment member 84 that extends laterally between the side portions 82 of the support housing 80 and is located between the support housing 80 and the forward portion 64 of the seat pan 46. A plurality of mechanical fasteners 86 secure the support housing 80 and the attachment member 84 to the forward portion 64 of the seat pan 46. The spring support assembly 78 further includes a pair of cantilever springs 88 each having a distal end 90 received through a corresponding aperture 92 of the attachment member 84, and a proximate end 94 secured to the seat support plate 32 such that the distal end 90 of each cantilever spring 88 may flex in the vertical direction 66. A pair of linear bearings 96 are fixedly attached to the attachment member 84 and aligned with the apertures 92 thereof, such that the linear bearing 96 slidably receives the distal ends 90 of a corresponding cantilever spring 88. In operation, the cantilever springs 88 cooperate to allow the forward portion 64 of the seat pan 46, and more generally the entire forward portion of seat assembly 16 to flex in the vertical direction 66 when a seated user rotates forward on the seat assembly 16 and exerts a downward force on the forward edge thereof.

The back assembly 18 (FIGS. 7-9B) includes a back frame assembly 98 and a back support assembly 99 supported thereby. The back frame assembly 98 is generally comprised of a substantially rigid material such as metal, and includes a laterally extending top frame portion 100, a laterally extending bottom frame portion 102, and a pair of curved side frame portion 104 extending between the top frame portion 100 and the bottom frame portion 102 and cooperating therewith to define an opening 106 having a relatively large upper dimension 108 and a relatively narrow lower dimension 110.

The back assembly 18 further includes a flexibly resilient, plastic back shell 112 having an upper portion 114, a lower portion 116, a pair of side edges 118 extending between the upper portion 114 and a lower portion 116, a forwardly facing surface 120 and a rearwardly facing surface 122, wherein the width of the upper portion 114 is generally greater than the width of the lower portion 116, and the lower portion 116 is downwardly tapered to generally follow the rear elevational configuration of the frame assembly 98. A lower reinforcement member 115 attaches to hooks 117 (FIG. 9A) of lower portion 116 of back shell 112. Reinforcement member 115 includes a plurality of protrusions 113 that engage reinforcement ribs 134 to prevent side-to-side movement of lower reinforcement member 115 relative to back shell 112. As discussed below, reinforcement member 115 pivotably interconnects back control link 342 (FIG. 26) to lower portion 116 of back shell 112 at pivot points or axis 346.

Figure 10:
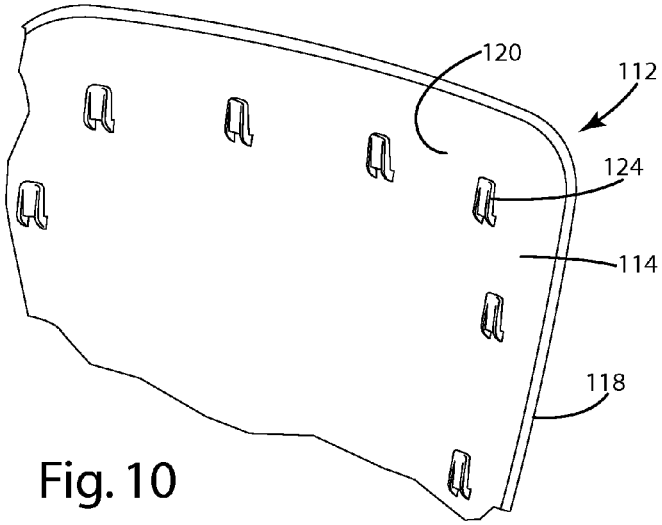
FIG. 10 is an enlarged perspective view of an area X, FIG. 9A.
Figure 11:
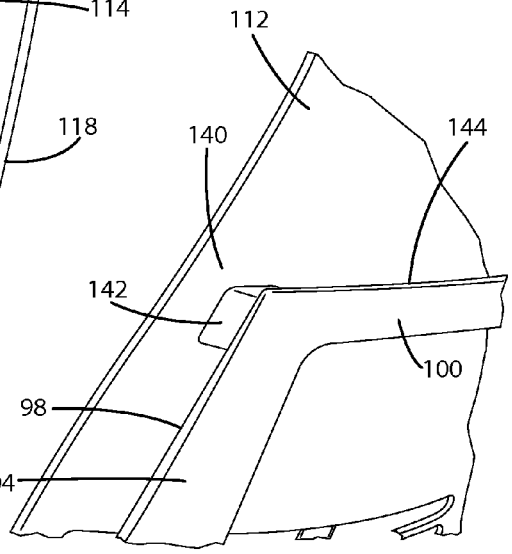
FIG. 11 is an enlarged perspective view of an area XI, FIG. 2.
Figure 12:
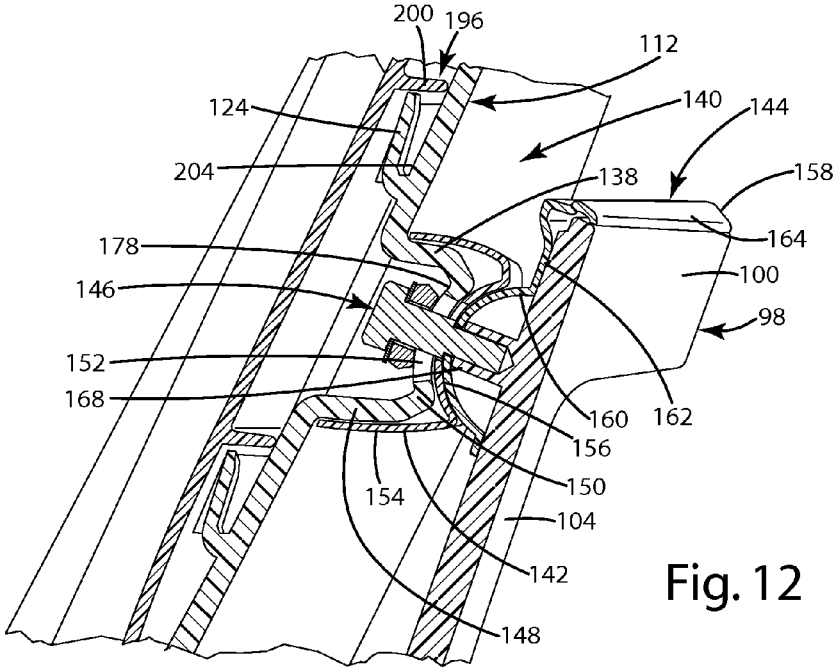
FIG. 12 is a cross-sectional view of an upper back pivot assembly taken along the line XII-XII, FIG. 7.
Figure 13A:
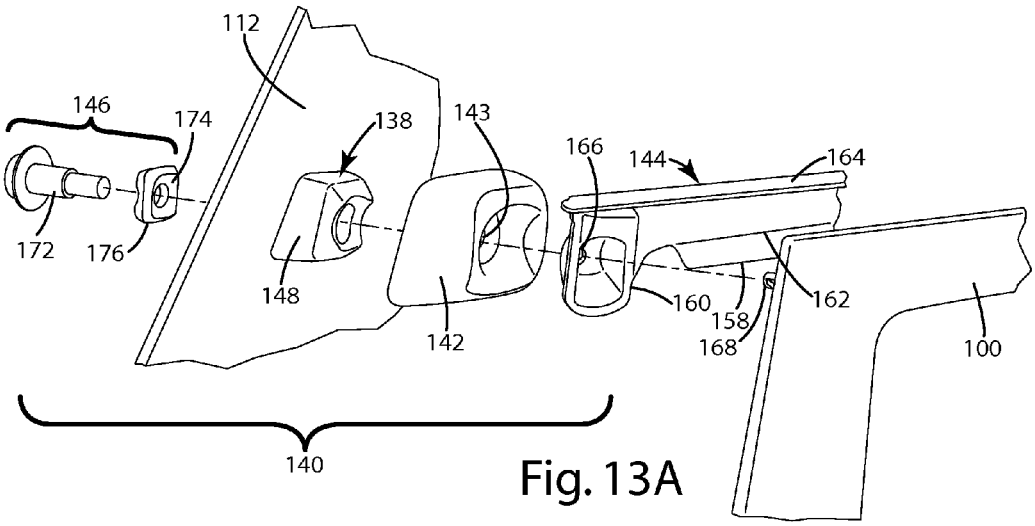
FIG. 13A is an exploded rear perspective view of the upper back pivot assembly.
Figure 13B:
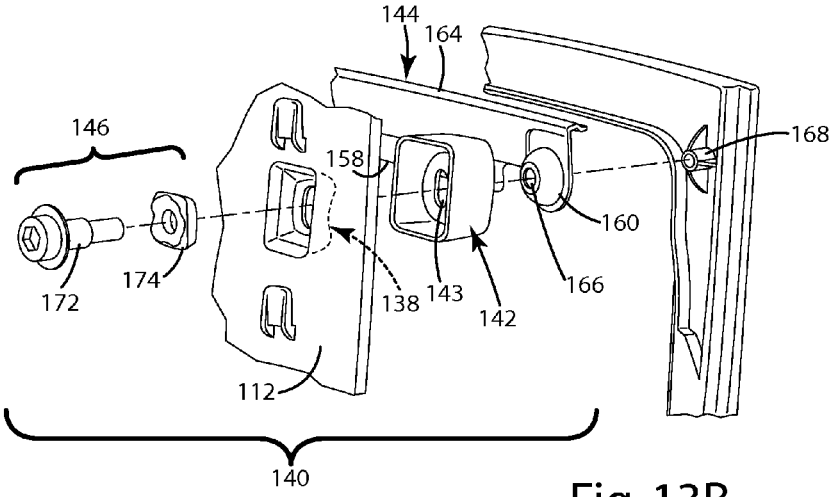
FIG. 13B is an exploded front perspective view of the upper back pivot assembly.

The back shell 112 also includes a plurality of integrally molded, forwardly and upwardly extending hooks 124 (FIG. 10) spaced about the periphery of the upper portion 114 thereof. An intermediate or lumbar portion 126 is located vertically between the upper portion 114 and the lower portion 116 of the back shell 112, and includes a plurality of laterally extending slots 128 that cooperate to form a plurality of laterally extending ribs 130 located therebetween. The slots 128 cooperate to provide additional flexure to the back shell 112 in the location thereof. Pairings of lateral ribs 130 are coupled by vertically extending ribs 132 integrally formed therewith and located at an approximate lateral midpoint thereof. The vertical ribs 132 function to tie the lateral ribs 130 together and reduce vertical spreading therebetween as the back shell 112 is flexed at the intermediate portion 126 thereof when the back assembly 18 is moved from the upright position E to the reclined position F, as described further below. The back shell 112 further includes a plurality of laterally-spaced reinforcement ribs 134 extending longitudinally along the vertical length of the back shell 112 between the lower portion 116 and the intermediate portion 126. It is noted that the depth of each of the ribs 134 increases the further along each of the ribs 134 from the intermediate portion 126, such that the overall rigidity of the back shell 112 increases along the length of the ribs from the intermediate portion 126 toward the lower portion 116.

The back shell 112 further includes a pair of rearwardly extending, integrally molded pivot bosses 138 forming part an upper back pivot assembly 140. The back pivot assembly 140 (FIGS. 11-13B) includes the pivot bosses 138 of the back shell 112, a pair of shroud members 142 that encompass respective pivot bosses 138, a race member 144, and a mechanical fastening assembly 146. Each pivot boss 138 includes a pair of side walls 148 and a rearwardly-facing concave seating surface 150 having a vertically elongated pivot slot 152 extending therethrough. Each shroud member 142 is shaped so as to closely house the corresponding pivot boss 138, and includes a plurality of side walls 154 corresponding to side walls 148, and a rearwardly-facing concave bearing surface 156 that includes a vertically elongated pivot slot 143 extending therethrough, and which is adapted to align with the slot 152 of a corresponding pivot boss 138. The race member 144 includes a center portion 158 extending laterally along and abutting the top frame portion 100 of the back frame assembly 98, and a pair of arcuately-shaped bearing surfaces 160 located at the ends thereof. Specifically, the center portion 158 includes a first portion 162, and a second portion 164, wherein the first portion 162 abuts a front surface of the top frame portion 100 and second portion 164 abuts a top surface of the top frame portion 100. Each bearing surface 160 includes an aperture 166 extending therethrough and which aligns with a corresponding boss member 168 integral with the back frame assembly 98.

Figure 7:
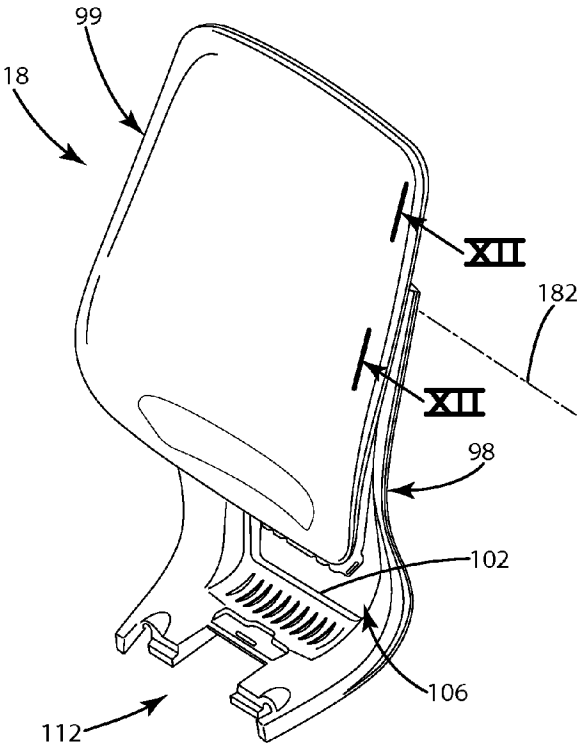
FIG. 7 is a front perspective view of a back assembly.

In assembly, the shroud members 142 are positioned about the corresponding pivot bosses 138 of the back shell 112 and operably positioned between the back shell 112 and race member 144 such that the bearing surface 156 is sandwiched between the seating surface 150 of a corresponding pivot boss 138 and a bearing surface 160. The mechanical fastening assemblies 146 each include a bolt 172 that secures a rounded abutment surface 174 of the bearing washer 176 in sliding engagement with an inner surface 178 of the corresponding pivot boss 138, and threadably engages the corresponding boss member 168 of the back shell 112. In operation, the upper back pivot assembly 140 allows the back support assembly 99 to pivot with respect to the back frame assembly in a direction 180 (FIG. 8) about a pivot axis 182 (FIG. 7).

Figure 9A:
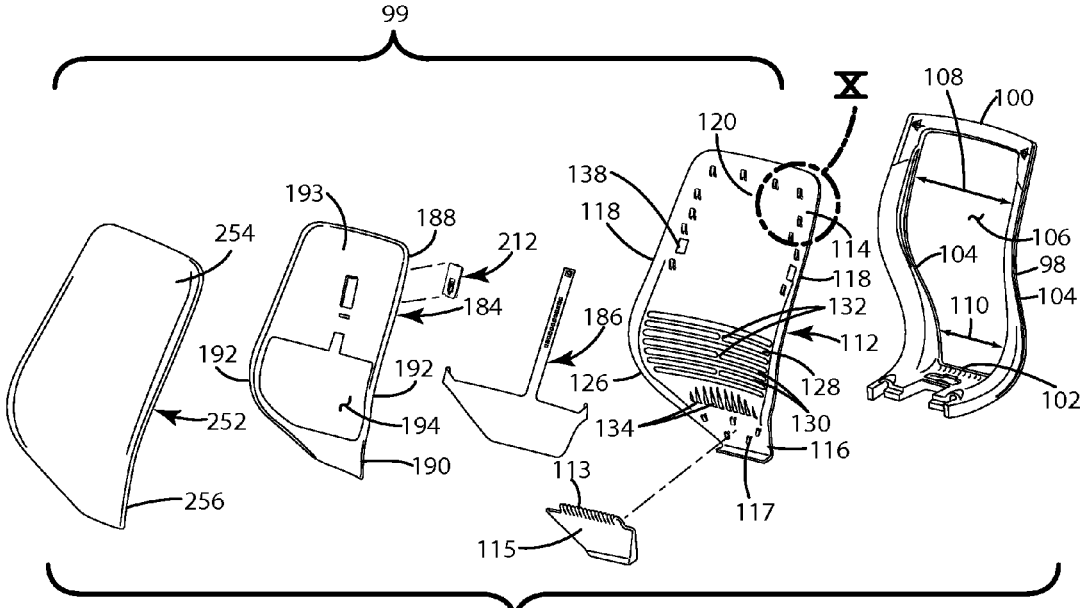
FIG. 9A is an exploded front perspective view of the back assembly.
Figure 9B:
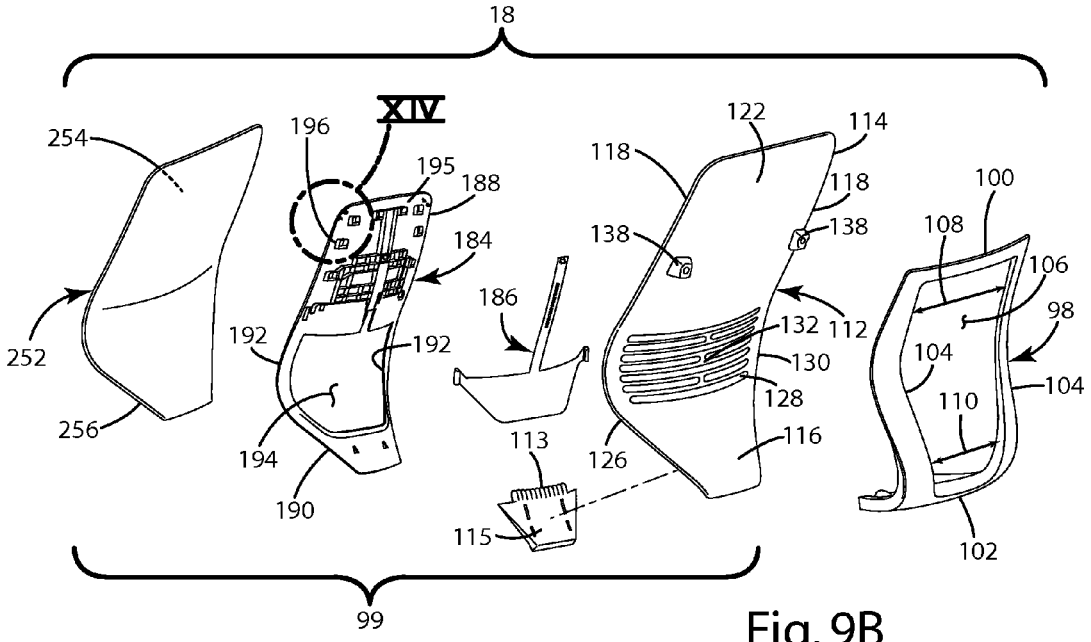
FIG. 9B is an exploded rear perspective view of the back assembly.
Figure 14:
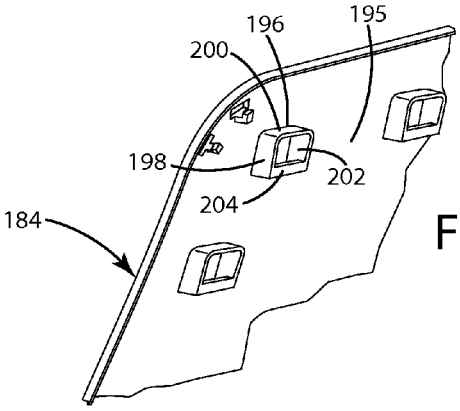
FIG. 14 is an enlarged perspective view of the area XIV, FIG. 9B.
Figure 15A:
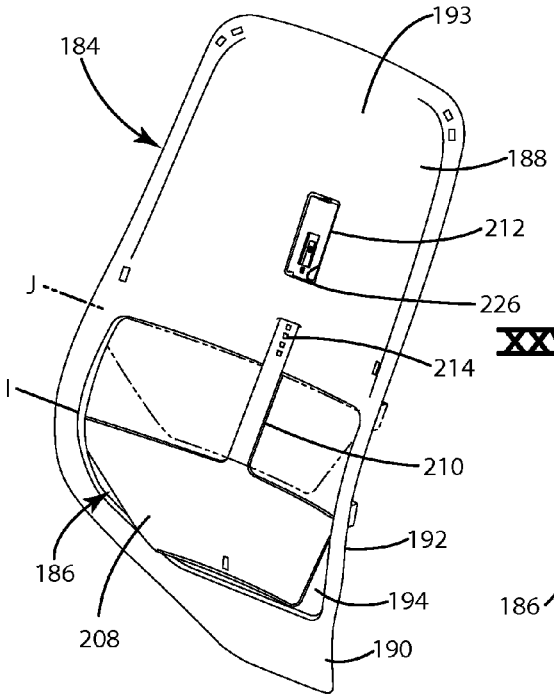
FIG. 15A is an enlarged perspective view of a comfort member and a lumbar assembly.
Figure 15B:
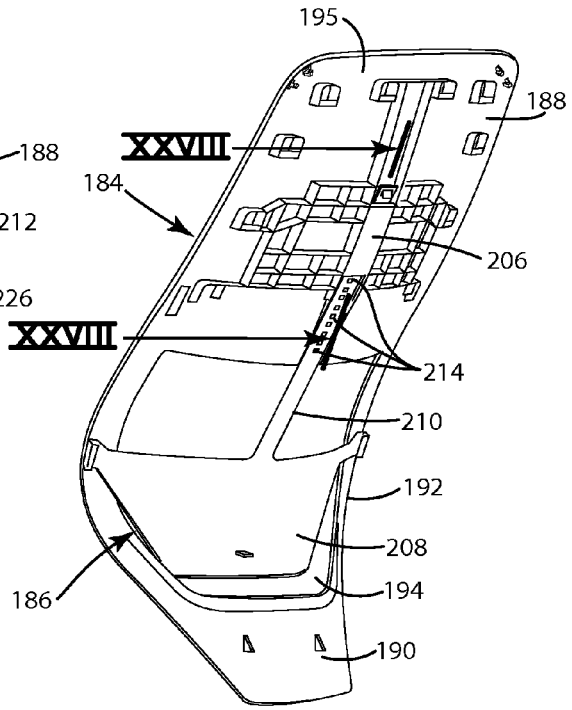
FIG. 15B is a rear perspective view of the comfort member and the lumbar assembly.

The back support assembly 99 (FIGS. 9A and 9B) further includes a flexibly resilient comfort member 184 (FIGS. 15A and 15B) attached to the back shell 112 and slidably supporting a lumbar assembly 186. The comfort member 184 includes an upper portion 188, a lower portion 190, a pair of side portions 192, a forward surface 193 and a rearward surface 195, wherein the upper portion 188, the lower portion 190 and the side portions 192 cooperate to form an aperture 194 that receives the lumbar assembly 186 therein. As best illustrated in FIGS. 9B and 14, the comfort member 184 includes a plurality of box-shaped couplers 196 spaced about the periphery of the upper portion 188 and extending rearwardly from the rearward surface 195. Each box-shaped coupler 196 includes a pair of side walls 198 and a top wall 200 that cooperate to form an interior space 202. A bar 204 extends between the side walls 198 and is spaced from the rearward surface 195. In assembly, the comfort member 184 (FIGS. 12-14) is secured to the back shell 112 by aligning and vertically inserting the hooks 124 of the back shell 112 into the interior space 202 of each of the box-shaped couplers 196 until the hooks 124 engage a corresponding bar 204. It is noted that the forward surface 120 of the back shell 112 and the rearward surface 195 of the comfort member 184 are free from holes or apertures proximate the hooks 124 and box-shaped couplers 196, thereby providing a smooth forward surface 193 and increasing the comfort to a seated user.

Figure 16A:
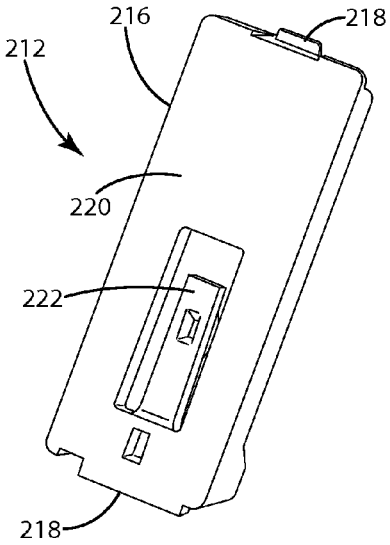
FIG. 16A is a front perspective view of a pawl member.
Figure 16B:
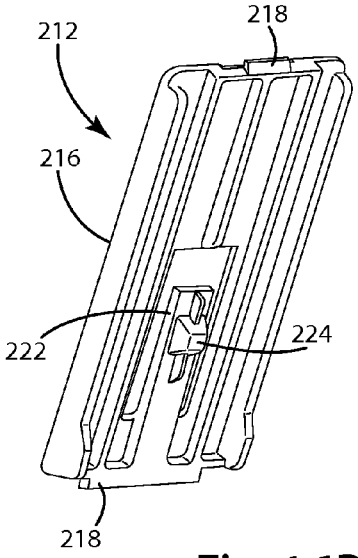
FIG. 16B is a rear perspective view of the pawl member.

The comfort member 184 (FIGS. 15A and 15B) includes an integrally molded, longitudinally extending sleeve 206 extending rearwardly from the rearward surface 195 and having a rectangularly-shaped cross-sectional configuration. The lumbar assembly 186 includes a forwardly laterally concave and forwardly vertically convex, flexibly resilient body portion 208, and an integral support portion 210 extending upwardly from the body portion 208. In the illustrated example, the body portion 208 is shaped such that the body portion vertically tapers along the height thereof so as to generally follow the contours and shape of the aperture 194 of the comfort member 184. The support portion 210 is slidably received within the sleeve 206 of the comfort member 184 such that the lumbar assembly 186 is vertically adjustable with respect to the remainder of the back support assembly 99 between a fully lowered position I and a fully raised position J. A pawl member 212 selectively engages a plurality of apertures 214 spaced along the length of support portion 210, thereby releasably securing the lumbar assembly 186 at selected vertical positions between the fully lowered position I and the fully raised position J. The pawl member 212 (FIGS. 16*a* and 16*b*) includes a housing portion 216 having engagement tabs 218 located at the ends thereof and rearwardly offset from an outer surface 220 of the housing portion 216. A flexibly resilient finger 222 is centrally disposed within the housing portion 216 and includes a rearwardly-extending pawl 224.

Figure 17:
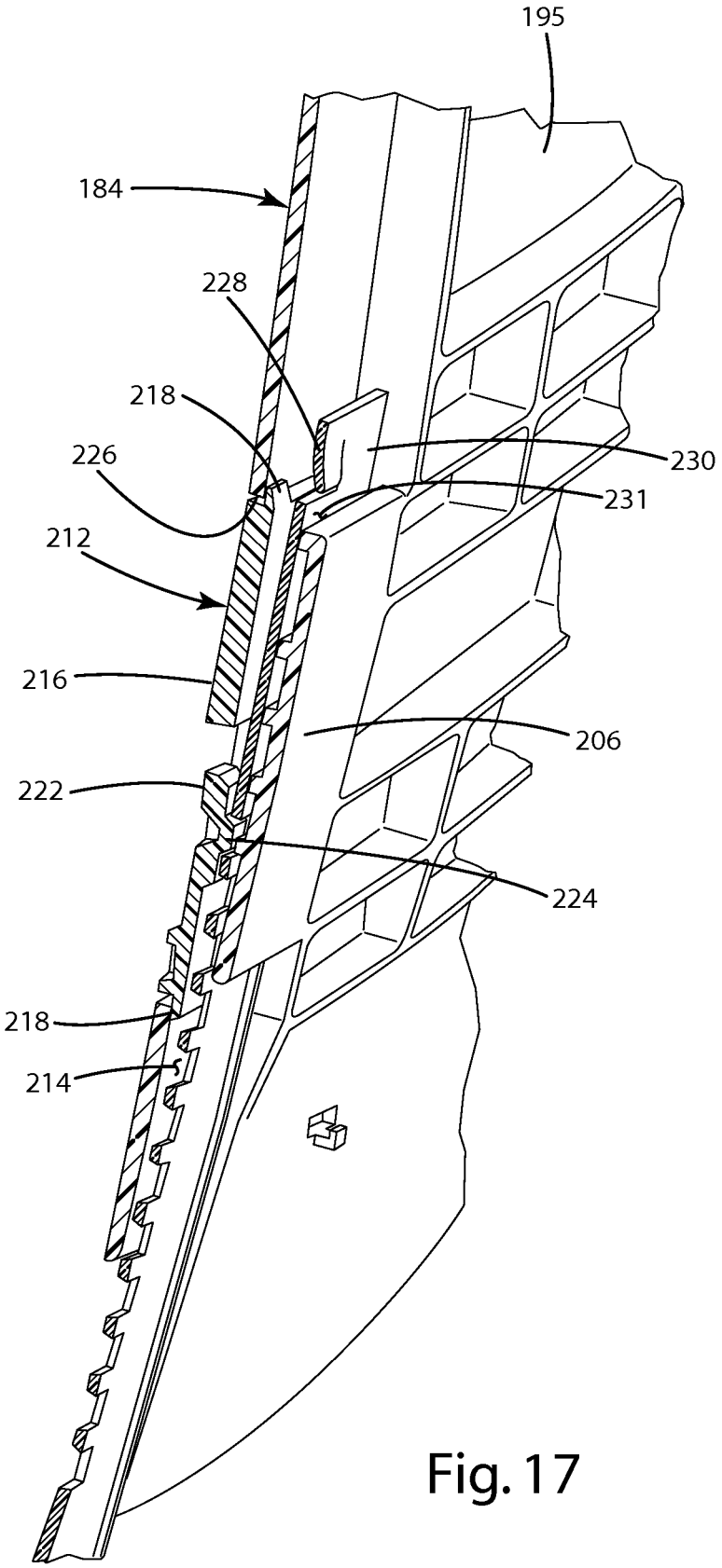
FIG. 17 is a partial cross-sectional perspective view along the line XVIII-XVIII, FIG. 15B.
Figure 18A:
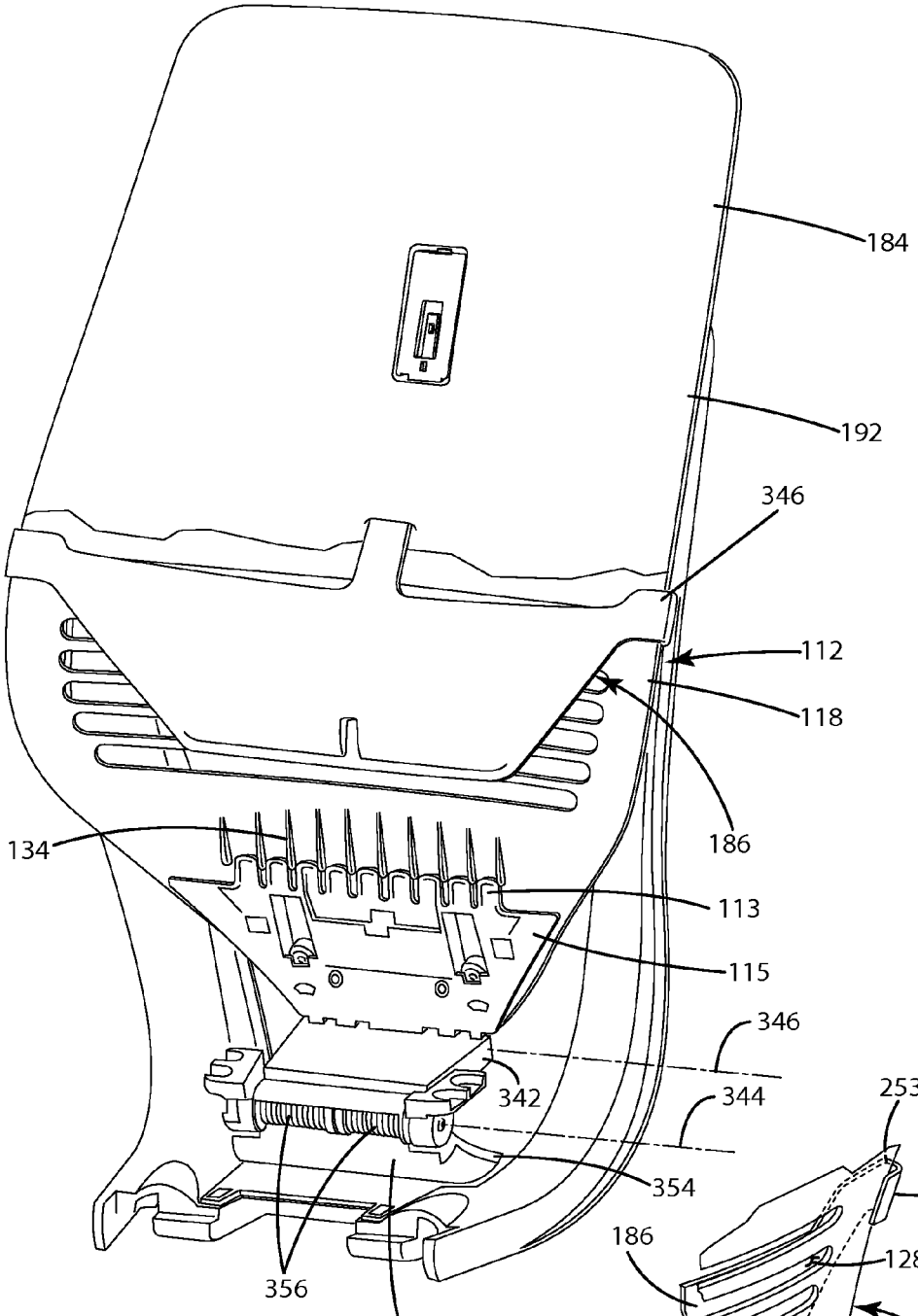
FIG. 18A is a perspective view of the back assembly, wherein a portion of the comfort member is cut away.
Figure 18B:
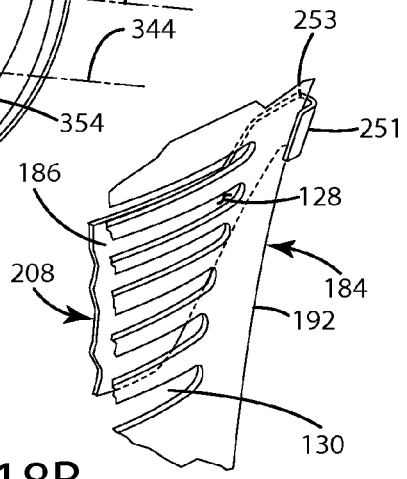
FIG. 18B is an exploded perspective view of a portion of the back assembly.

In assembly, the pawl member 212 (FIG. 17) is positioned within an aperture 226 located within the upper portion 188 of the comfort member 184 such that the outer surface 220 of the housing portion 216 of the pawl member 212 is coplanar with the forward surface 193 of the comfort member 184, and such that the engagement tabs 218 of the housing portion 216 abut the rearward surface 195 of the comfort member 184. The support portion 210 of the lumbar assembly 186 is then positioned within the sleeve 206 of the comfort member 184 such that the sleeve 206 is slidable therein and the pawl 224 is selectively engageable with the apertures 214, thereby allowing the user to optimize the position of the lumbar assembly 186 with respect to the overall back support assembly 99. Specifically, the body portion 208 of the lumbar assembly 186 includes a pair of outwardly extending integral handle portions 251 (FIGS. 18A and 18B) each having a C-shaped cross-sectional configuration defining a channel 253 therein that wraps about and guides along the respective side edge 192 of the comfort member 184 and the side edge 118 of the back shell 112.

In operation, a user adjusts the relative vertical position of the lumbar assembly 186 with respect to the back shell 112 by grasping one or both of the handle portions 251 and sliding the handle assembly 251 along the comfort member 184 and the back shell 112 in a vertical direction. A stop tab 228 is integrally formed within a distal end 230 and is offset therefrom so as to engage an end wall of the sleeve 206 of the comfort member 184, thereby limiting the vertical downward travel of the support portion 210 of the lumbar assembly 186 with respect to the sleeve 206 of the comfort member 184.

The back assembly 99 (FIGS. 9A and 9B) also includes a cushion member 252 having an upper portion 254 and a lower portion 256, wherein the lower portion 256 tapers along the vertical length thereof to correspond to the overall shape and taper of the back shell 112 and the comfort member 184.

Figure 20:
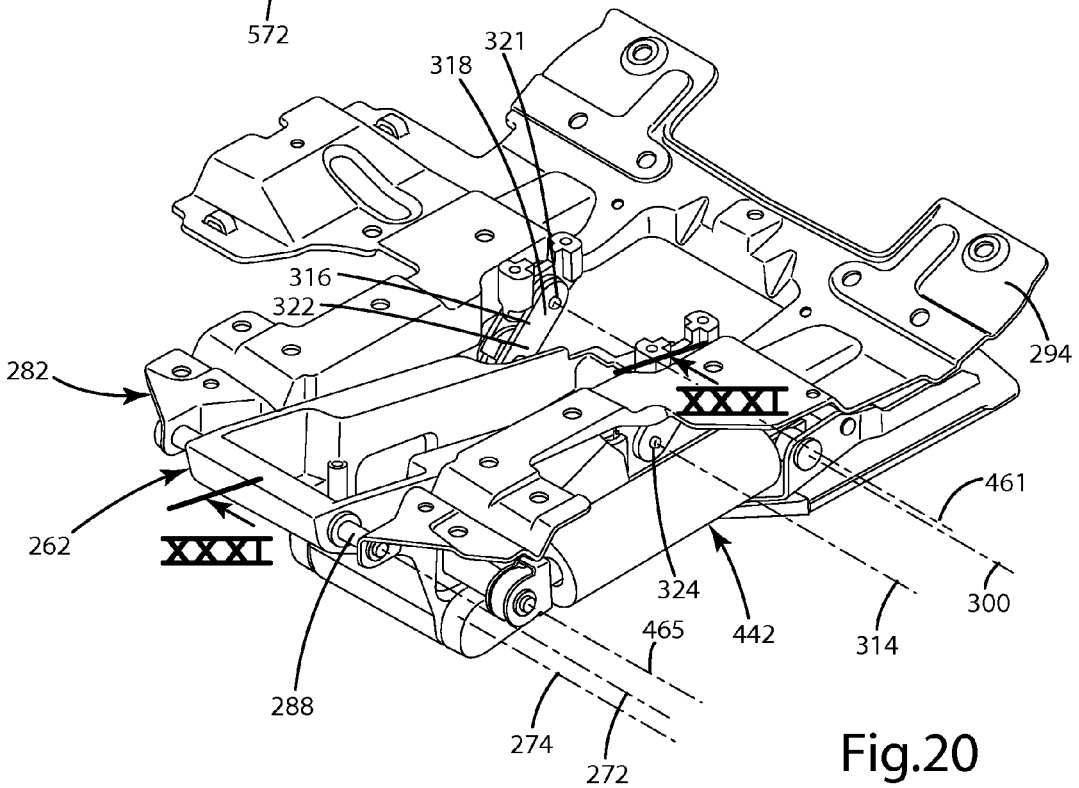
FIG. 20 is a perspective view of the control input assembly with certain elements removed to show the interior thereof.
Figure 21:
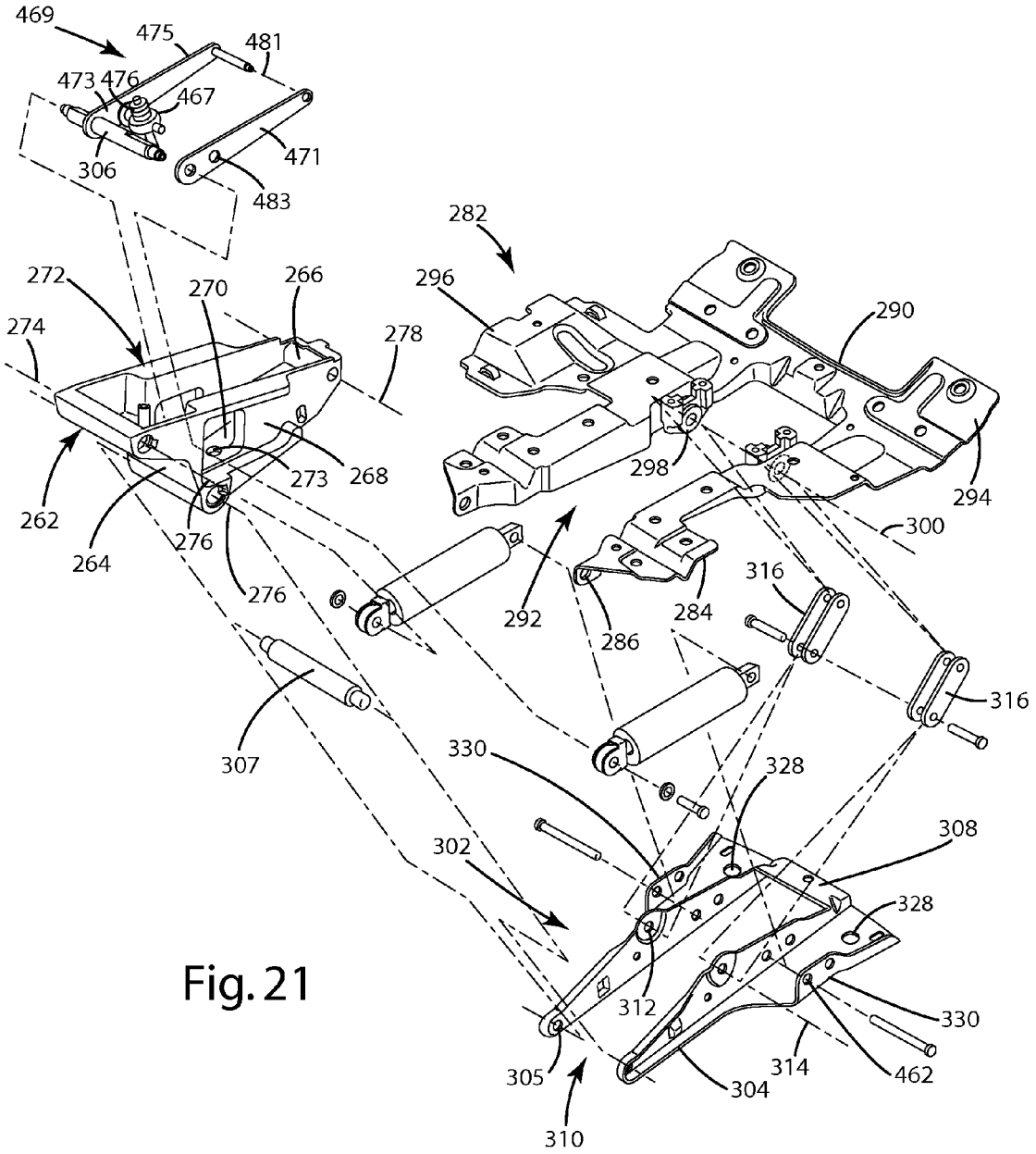
FIG. 21 is an exploded view of the control input assembly.

The seat assembly 16 and the back assembly 18 are operably coupled to and controlled by the control assembly 14 (FIG. 19) and a control input assembly 260. The control assembly 14 (FIGS. 20-22) includes a housing or base structure or ground structure 262 that includes a front wall 264, a rear wall 266, a pair of side walls 268 and a bottom wall 270 integrally formed with one another and that cooperate to form an upwardly opening interior space 272. The bottom wall 270 includes an aperture 273 centrally disposed therein for receiving the cylinder assembly 28 (FIG. 3) therethrough, as described below. The base structure 262 further defines an upper and forward pivot point 274, a lower and forward pivot point 276, and an upper and rearward pivot point 278, wherein the control assembly 14 further includes a seat support structure 282 that supports the seat assembly 16. In the illustrated example, the seat support structure 282 has a generally U-shaped plan form configuration that includes a pair of forwardly extending arm portions 284 each including a forwardly located pivot aperture 286 pivotably secured to the base structure 262 by a pivot shaft 288 for pivoting movement about the upper and forward pivot point 274. The seat support structure 282 further includes a rear portion 290 extending laterally between the arm portions 284 and cooperating therewith to form an interior space 292 within which the base structure 262 is received. The rear portion 290 includes a pair of rearwardly extending arm mounting portions 294 to which the arm assemblies 20 are attached as described below. The seat support structure 282 further includes a control input assembly mounting portion 296 to which the control input assembly 260 is mounted. The seat support structure 282 further includes a pair of bushing assemblies 298 that cooperate to define a pivot point 300.

The control assembly 14 further includes a back support structure 302 having a generally U-shaped plan view configuration and including a pair of forwardly extending arm portions 304 each including a pivot aperture 305 and pivotably coupled to the base structure 262 by a pivot shaft 307 such that the back support structure 302 pivots about the lower and forward pivot point 276. The back support structure 302 includes a rear portion 308 that cooperates with the arm portions 304 to define an interior space 310 which receives the base structure 262 therein. The back support structure 302 further includes a pair of pivot apertures 312 located along the length thereof and cooperating to define a pivot point 314. It is noted that in certain instances, at least a portion of the back frame assembly 98 may be included as part of the back support structure 302.

The control assembly 14 further includes a plurality of control links 316 each having a first end 318 pivotably coupled to the seat support structure 282 by a pair of pivot pins 321 for pivoting about the pivot point 300, and a second end 322 pivotably coupled to corresponding pivot apertures 312 of the back support structure 302 by a pair of pivot pins 324 for pivoting about the pivot point 314. In operation, the control links 316 control the motion, and specifically the recline rate of the seat support structure 282 with respect to the back support structure 302 as the chair assembly is moved to the recline position, as described below.

Figure 23A:
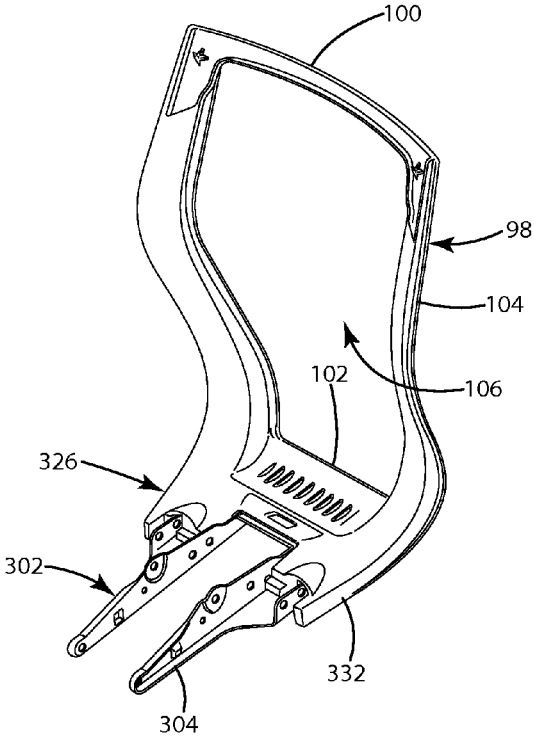
FIG. 23A is a front perspective view of a back support structure.
Figure 23B:
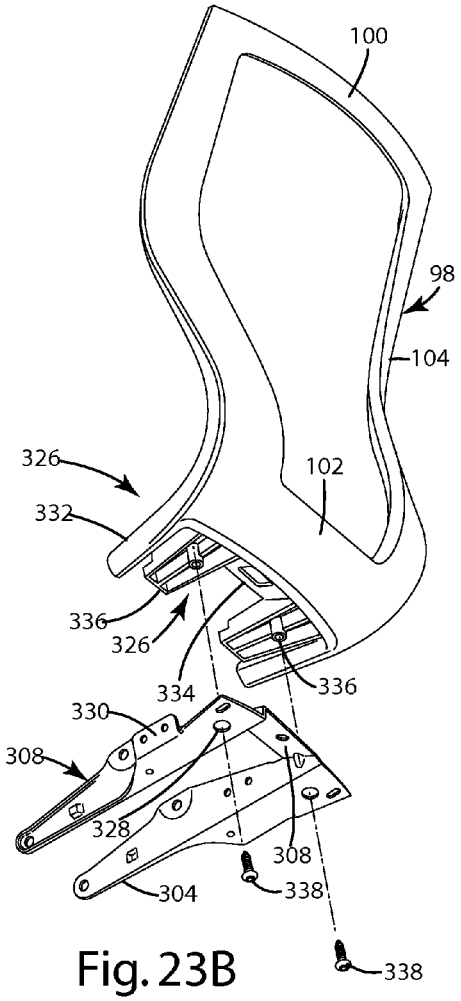
FIG. 23B is an exploded perspective view of the back support structure.

As best illustrated in FIGS. 23A and 23B, a bottom frame portion 102 of the back frame assembly 98 is configured to connect to the back support structure 302 via a quick connect arrangement 326. Each arm portion 304 of the back support structure 302 includes a mounting aperture 328 located at a proximate end 330 thereof. In the illustrated example, the quick connect arrangement 326 includes a configuration of the bottom frame portion 102 of the back frame assembly 98 to include a pair of forwardly-extending coupler portions 332 that cooperate to define a channel 334 therebetween that receives the rear portion 308 and the proximate ends 330 of the arm portions 304 therein. Each coupler portion 332 includes a downwardly extending boss 336 that aligns with and is received within a corresponding aperture 328. Mechanical fasteners, such as screws 338 are then threaded into the bosses 336, thereby allowing a quick connection of the back frame assembly 98 to the control assembly 14.

Figure 24:
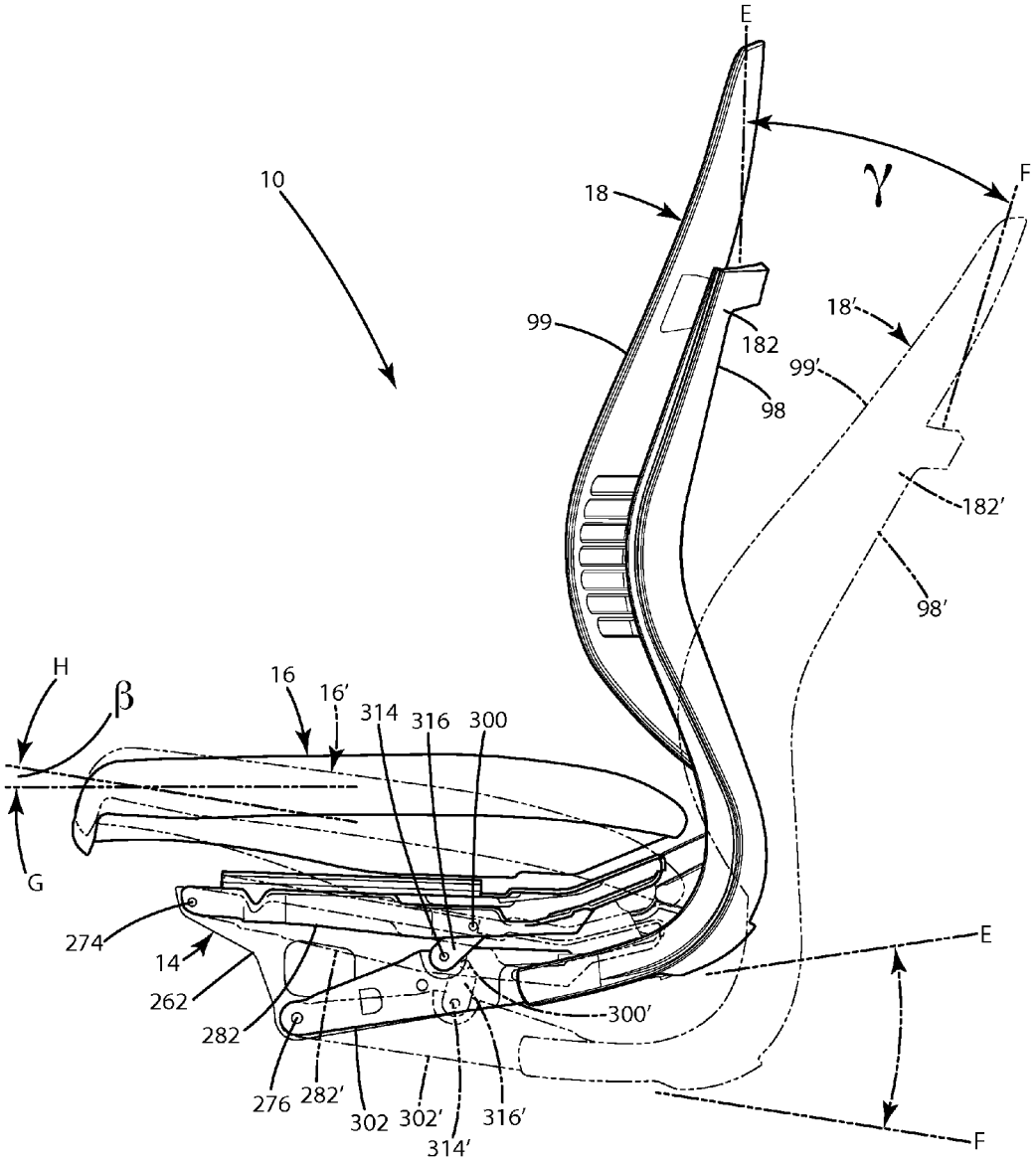
FIG. 24 is a side elevational view of the chair assembly illustrating multiple pivot points thereof.

As best illustrated in FIG. 24, the base structure 262, the seat support structure 282, the back support structure 302 and the control links 316 cooperate to form a 4-bar linkage assembly that supports the seat assembly 16, the back assembly 18, and the arm assemblies 20. For ease of reference, the associated pivot assemblies associated with the 4-bar linkage assembly of the control assembly 14 are referred to as follows: the upper and forward pivot point 274 between the base structure 262 and the base support structure 282 as the first pivot point 274; the lower and forward pivot point 276 between the base structure 262 and the back support structure 302 as the second pivot point 276; the pivot point 300 between the first end 318 of the control link 316 and the seat support structure 282 as the third pivot point 300; and, the pivot point 314 between the second end 322 of the control link 316 and the back support structure 302 as the fourth pivot point 314. Further, FIG. 24 illustrates the component of the chair assembly 10 shown in a reclined position in dashed lines, wherein the reference numerals of the chair in the reclined position are designated with a "'".

In operation, the 4-bar linkage assembly of the control assembly 14 cooperates to recline the seat assembly 16 from the upright position G to the reclined position H as the back assembly 184 is moved from the upright position E to the reclined position F, wherein the upper and lower representations of the positions E and F in FIG. 24 illustrate that the upper and lower portions of the back assembly 18 recline as a single piece. Specifically, the control link 316 is configured and coupled to the seat support structure 282 and the back support structure 302 to cause the seat support structure 282 to rotate about the first pivot point 274 as the back support structure 302 is pivoted about the second pivot point 276. Preferably, the seat support structure 302 is rotated about the first pivot point 274 at between about ⅓ and about ⅔ the rate of rotation of the back support structure 302 about the second pivot point 276, more preferably the seat support structure rotates about the first pivot point 274 at about half the rate of rotation of the back support structure 302 about the second pivot point 276, and most preferably the seat assembly 16 reclines to an angle $\beta$ of about 9° from the fully upright position G to the fully reclined position H, while the back assembly 18 reclines to an angle $\lambda$ of about 18° from the fully upright position E to the fully reclined position F.

Figure 25:
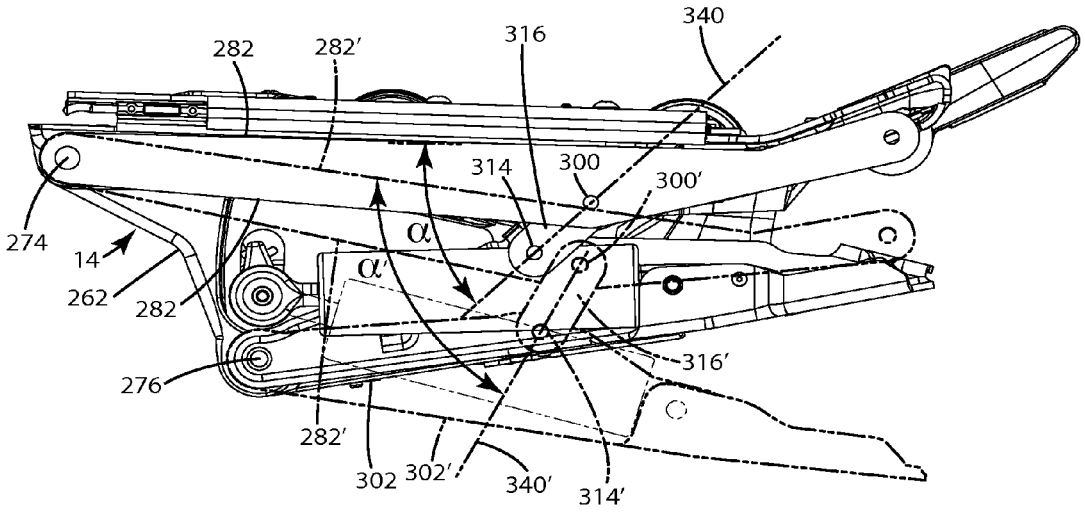
FIG. 25 is a side perspective view of the control assembly showing multiple pivot points associated therewith.

As best illustrated in FIG. 24, the first pivot point 274 is located above and forward of the second pivot point 276 when the chair assembly 10 is at the fully upright position, and when the chair assembly 10 is at the fully reclined position as the base structure 262 remains fixed with respect to the supporting floor surface 13 as the chair assembly 10 is reclined. The third pivot point 300 remains behind and below the relative vertical height of the first pivot point 274 throughout the reclining movement of the chair assembly 10. It is further noted that the distance between the first pivot point 274 and the second pivot point 276 is greater than the distance between the third pivot point 300 and the fourth pivot point 314 throughout the reclining movement of the chair assembly 10. As best illustrated in FIG. 25, a longitudinally extending center line axis 340 of the control link 316 forms an acute angle $\alpha$ with the seat support structure 282 when the chair assembly 10 is in the fully upright position and an acute angle $\alpha'$ when the chair assembly 10 is in the fully reclined position. It is noted that the center line axis 340 of the control link 316 does not rotate past an orthogonal alignment with the seat support structure 282 as the chair assembly 10 is moved between the fully upright and fully reclined positions thereof.

Figure 26:
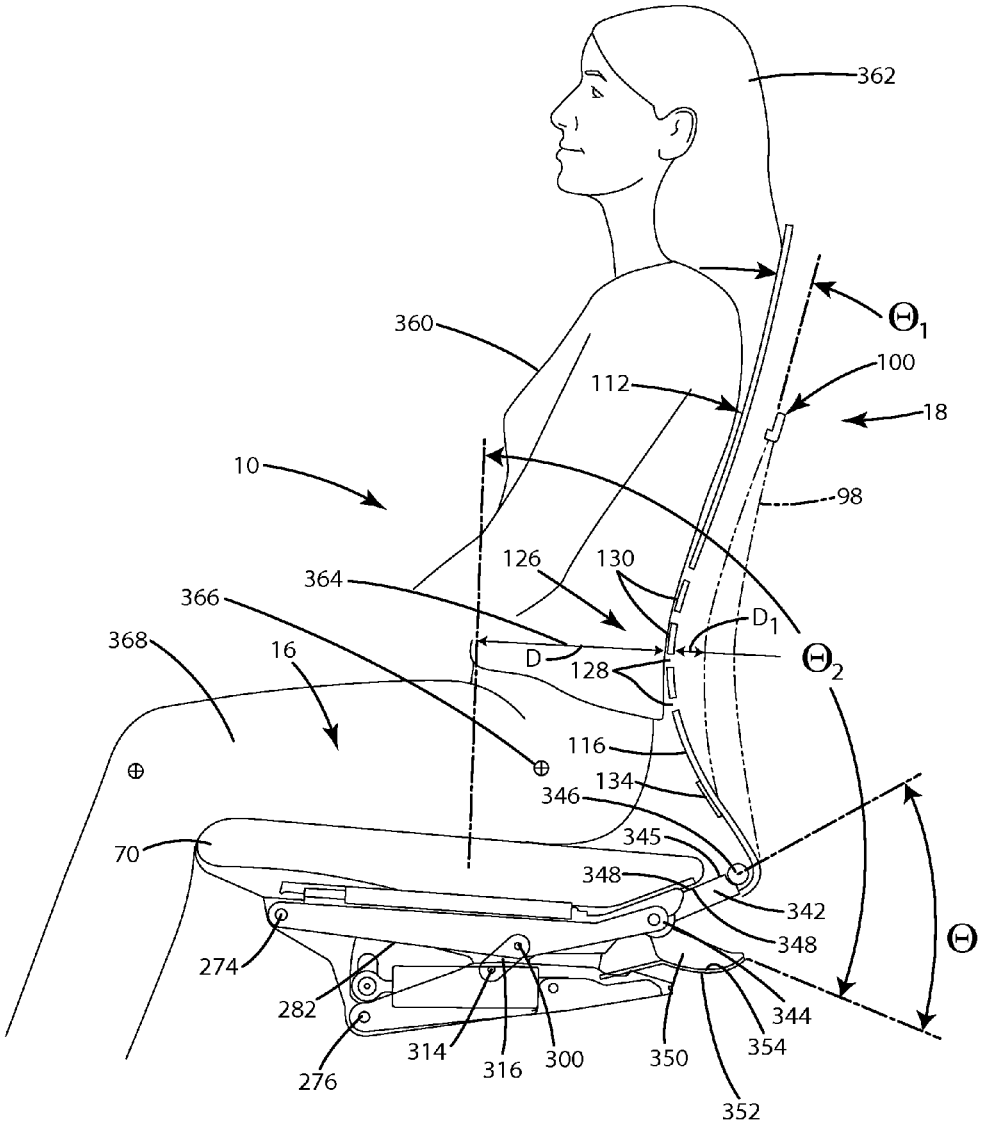
FIG. 26 is a cross-sectional view of the chair showing the back in an upright position with the lumbar adjustment set at a neutral setting.

With further reference to FIG. 26, a back control link 342 includes a forward end that is pivotably connected to the seat support structure 282 at a fifth pivot point 344. A rearward end 345 of the back control link 342 is connected to the lower portion 116 of the back shell 112 at a sixth pivot point 346. The sixth pivot point 346 is optional, and the back control link 342 and the back shell 112 may be rigidly fixed to one another. Also, the pivot point 346 may include a stop feature that limits rotation of the back control link 342 relative to the back shell 112 in a first and/or second rotational direction. For example, with reference to FIG. 26, the pivot 346 may include a stop feature that permits clockwise rotation of the lower portion 116 of the back shell 112 relative to the control link 342. This permits the lumbar to become flatter if a rearward/horizontal force tending to reduce dimension D1 is applied to the lumbar portion of the back shell 112. However, the stop feature may be configured to prevent rotation of the lower portion 116 of the back shell 112 in a counter clockwise direction (FIG. 26) relative to the control link 342. This causes the link 342 and the lower portion 116 of the back shell 112 to rotate at the same angular rate as the back assembly 18 when a user reclines in the chair by pushing against an upper portion of the back assembly 18.

A cam link 350 is also pivotably connected to the seat support structure 282 for rotation about the pivot point or axis 344. The cam link 350 has a curved lower cam surface 352 that slidably engages an upwardly facing cam surface 354 formed in the back support structure 302. A pair of torsion springs 356 (see also FIGS. 18A and 18B) rotatably bias the back control link 342 and the cam link 350 in a manner that tends to increase the angle ϕ (FIG. 26). The torsion springs 356 generate a force tending to rotate the control link 342 in a counter-clockwise direction (FIG. 26), and simultaneously rotate the cam link 350 in a clockwise direction (FIG. 26). Thus, the torsion springs 356 tend to increase the angle ϕ between back the control link 342 and the cam link 350. A stop 348 on the seat support structure 282 limits counter clockwise rotation of the back control link 342 to the position shown in FIG. 26. This force may also bias the control link 342 in a counter clockwise direction into the stop feature.

As discussed above, the back shell 112 is flexible, particularly in comparison to the rigid back frame structure 98. As also discussed above, the back frame structure 98 is rigidly connected to the back support structure 302, and therefore pivots with the back support structure 302. The forces generated by the torsion springs 356 push upwardly against the lower portion 116 of the back shell 112. As also discussed above, the slots 128 in the back shell structure 112 create additional flexibility at the lumbar support portion 126 of the back shell 112. The force generated by the torsion springs 356 also tends to cause the lumbar portion 126 of the back shell 112 to bend forwardly such that the lumbar portion 126 has a higher curvature than the regions adjacent the lumbar portion 126.

Figure 27:
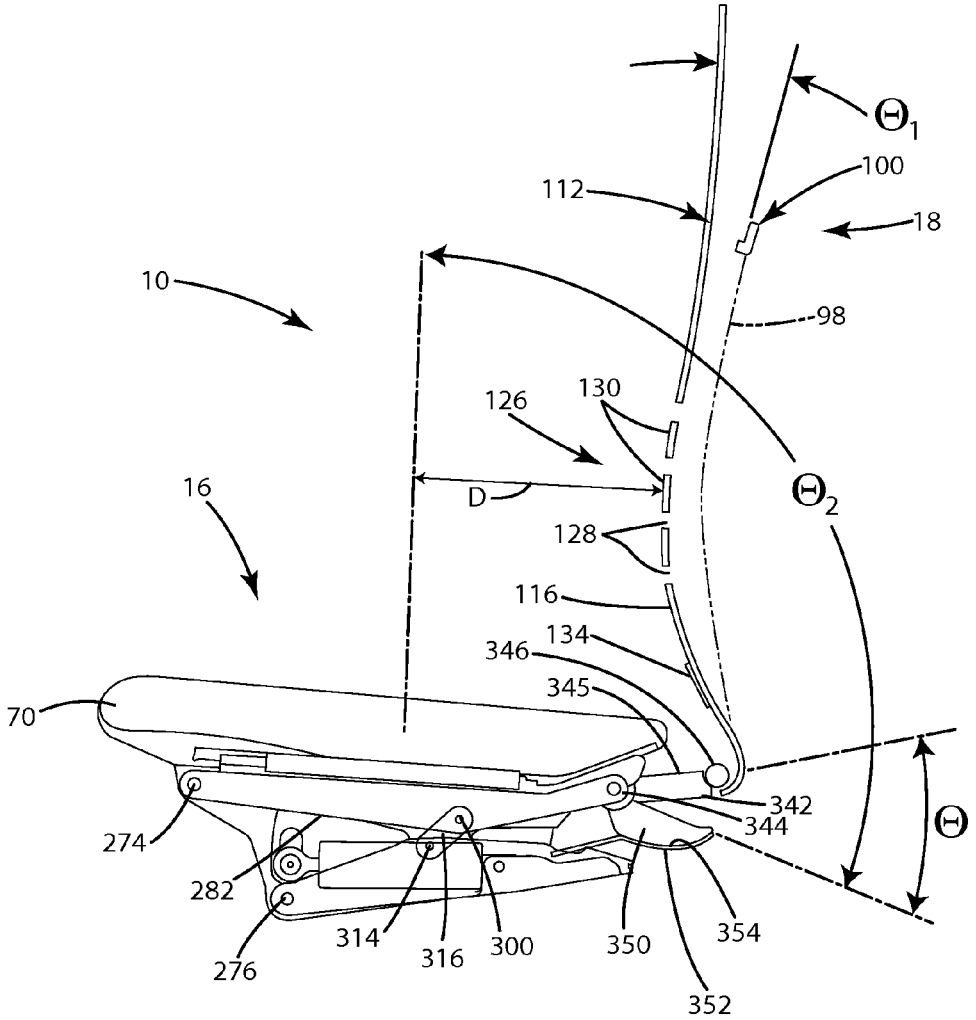
FIG. 27 is a cross-sectional view of the chair showing the back in an upright position with the lumbar portion adjusted to a flat configuration.

As discussed above, the position of the lumbar assembly 186 is vertically adjustable. Vertical adjustment of the lumbar assembly 186 also adjusts the way in which the back shell 112 flexes/curves during recline of the chair back. In FIG. 26, the lumbar assembly 186 is adjusted to an intermediate or neutral position, such that the curvature of the lumbar portion 126 of the back shell 112 is also intermediate or neutral. With further reference to FIG. 27, if the vertical position of the lumbar assembly 186 is adjusted, the angle ϕ is reduced, and the curvature of the lumbar region 126 is reduced. As shown in FIG. 27, this also causes angle ϕ1 to become greater, and the overall shape of the back shell 112 to become relatively flat.

Figure 28:
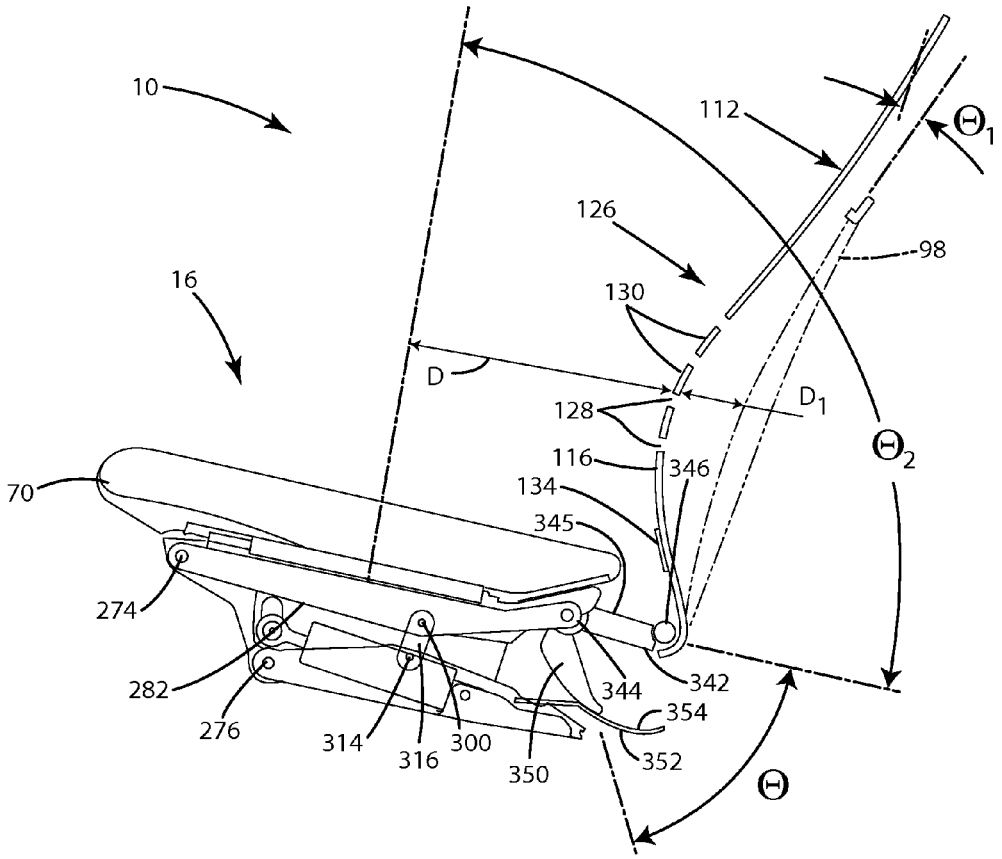
FIG. 28 is a cross-sectional view of the chair showing the back reclined with the lumbar adjusted to a neutral position.

With further reference to FIG. 28, if the height of the lumbar assembly 186 is set at an intermediate level (i.e., the same as FIG. 26), and a user leans back, the 4-bar linkage defined by the links and the structures 262, 282, 302, 316, and the pivot points 274, 276, 300, 314 will shift (as described above) from the configuration of FIG. 26 to the configuration of FIG. 28. This, in turn, causes an increase in the distance between the pivot point 344 and the cam surface 354. This causes an increase in the angle ϕ from about 49.5° (FIG. 26) to about 59.9° (FIG. 28). As the spring rotates toward an open position, some of the energy stored in the spring is transferred into the back shell 112, thereby causing the degree of curvature of the lumbar portion 116 of the back shell 112 to become greater. In this way, the back control link 342, the cam link 350, and the torsion springs 356 provide for greater curvature of the lumbar region 116 to reduce the curvature of a user's back as the user leans back in the chair.

Also, as the chair tilts from the position of FIG. 26 to the position of FIG. 28, the distance D between the lumbar region 126 and the seat 16 increases from 174 mm to 234 mm. A dimension D1 between the lumbar region 126 of the back shell 112 and the back frame structure 98 also increases as the back tilts from the position of FIG. 26 to the position of FIG. 28. Thus, although the distance D increases somewhat, the increase in the dimension D1 reduces the increase in dimension D because the lumbar region 126 of the back shell 112 is shifted forward relative to the back frame 98 during recline.

Referring again to FIG. 26, a spine 360 of a seated user 362 tends to curve forwardly in the lumbar region 364 by a first amount when a user is seated in an upright position. As a user leans back from the position of FIG. 26 to the position of FIG. 28, the curvature of the lumbar region 364 tends to increase, and the user's spine 360 will also rotate somewhat about hip joint 366 relative to a user's femur 368. The increase in the dimension D and the increase in curvature of the lumbar region 126 of the back shell 112 simultaneously ensure that a user's hip joint 366 and femur 368 do not slide on the seat 16, and also accommodate curvature of the lumbar region 364 of a user's spine 360.

Figure 29:
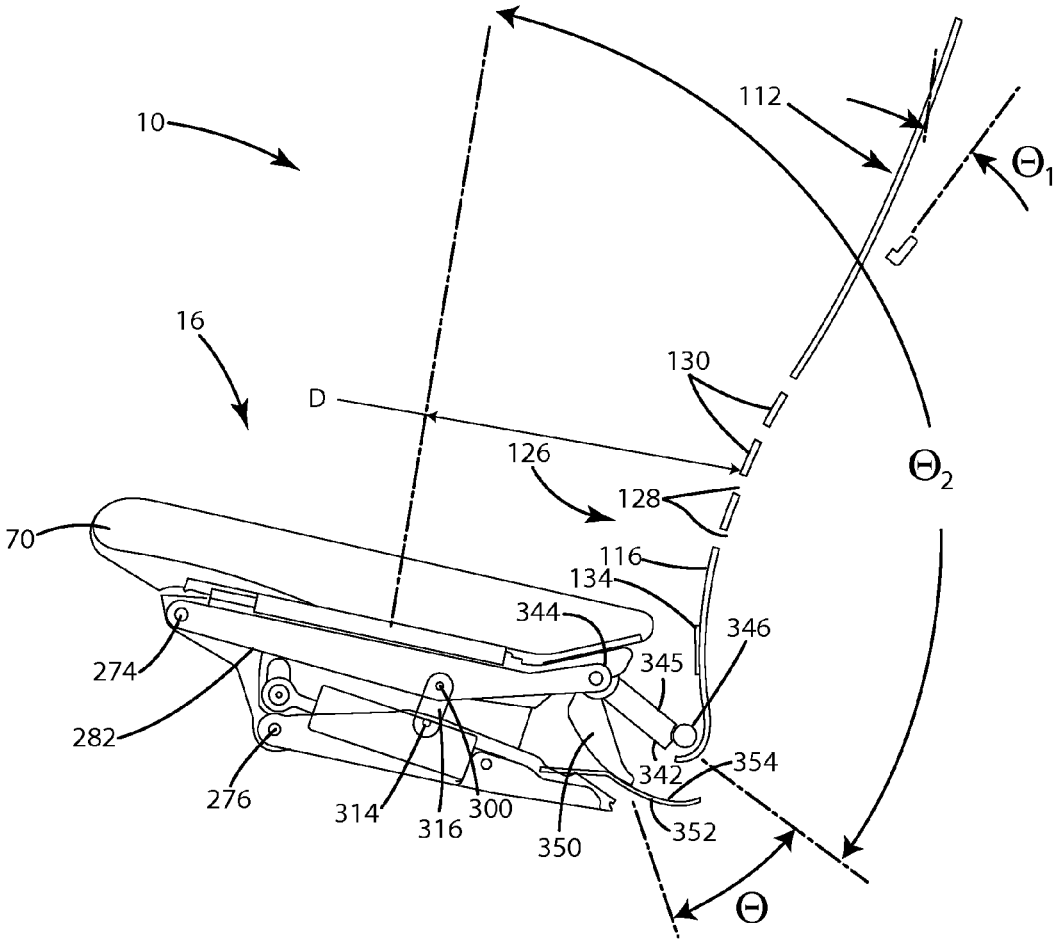
FIG. 29 is a cross-sectional view of the chair in a reclined position with the lumbar adjusted to a flat configuration.

As discussed above, FIG. 27 shows the back assembly 18 of the chair assembly 10 in an upright position with the lumbar region 126 of the back shell 112 adjusted to a flat position. If the back assembly 18 is tilted from the position of FIG. 27 to the position of FIG. 29, the back control link 342 and the cam link 350 both rotate in a clockwise direction. However, the cam link 350 rotates at a somewhat higher rate, and the angle ϕ therefore changes from 31.4° to 35.9°. The distance D changes from 202 mm to 265 mm, and the angle ϕ1 changes from 24.2° to 24.1°.

Figure 29A:
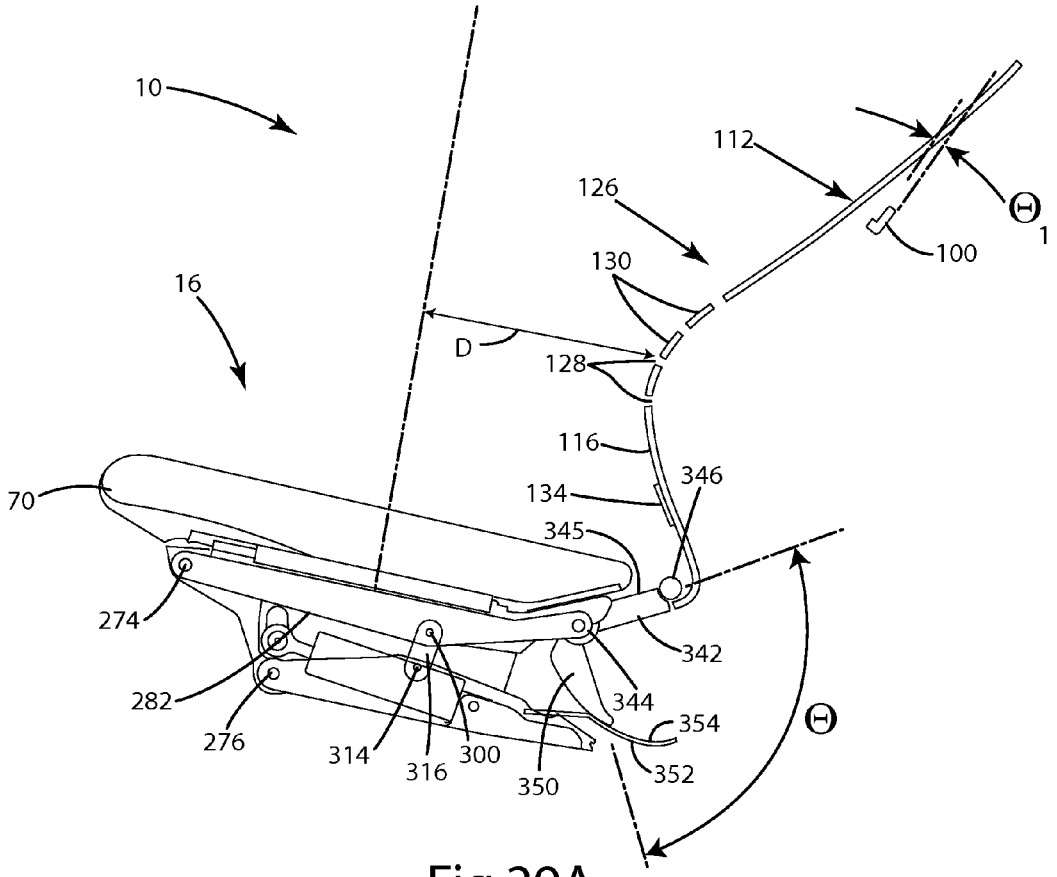
FIG. 29A is a cross-sectional view of the chair showing the back reclined with the lumbar portion of the shell set at a maximum curvature.

With further reference to FIG. 29A, if the back assembly 18 is reclined, and the lumbar adjustment is set high, the angle ϕ is 93.6°, and the distance D is 202 mm.

Thus, the back shell 112 curves as the seat back is tilted rearwardly. However, the increase in curvature in the lumbar region 126 from the upright to the reclined position is significantly greater if the curvature is initially adjusted to a higher level. This accounts for the fact that the curvature of a user's back does not increase as much when a user reclines if the user's back is initially in a relatively flat condition when seated upright. Restated, if a user's back is relatively straight when in an upright position, the user's back will remain relatively flat even when reclined, even though the degree of curvature will increase somewhat from the upright position to the reclined position. Conversely, if a user's back is curved significantly when in the upright position, the curvature of the lumbar region will increase by a greater degree as the user reclines relative to the increase in curvature if a user's back is initially relatively flat.

Figure 22:
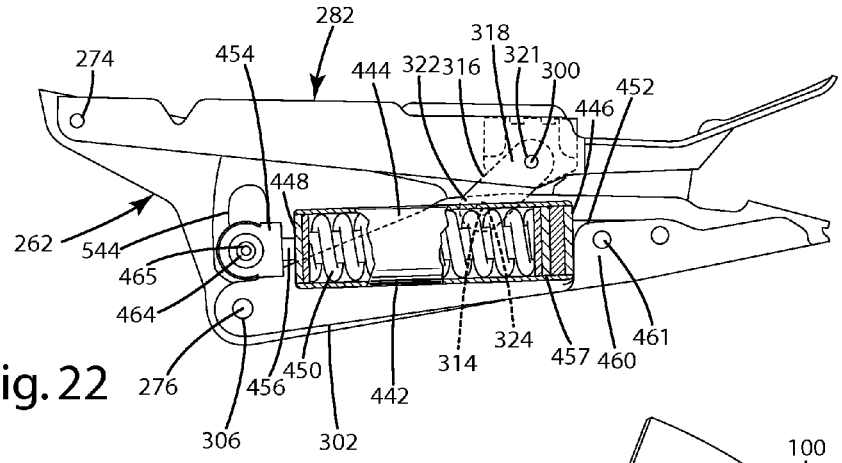
FIG. 22 is a side elevational view of the control input assembly.
Figure 30A:
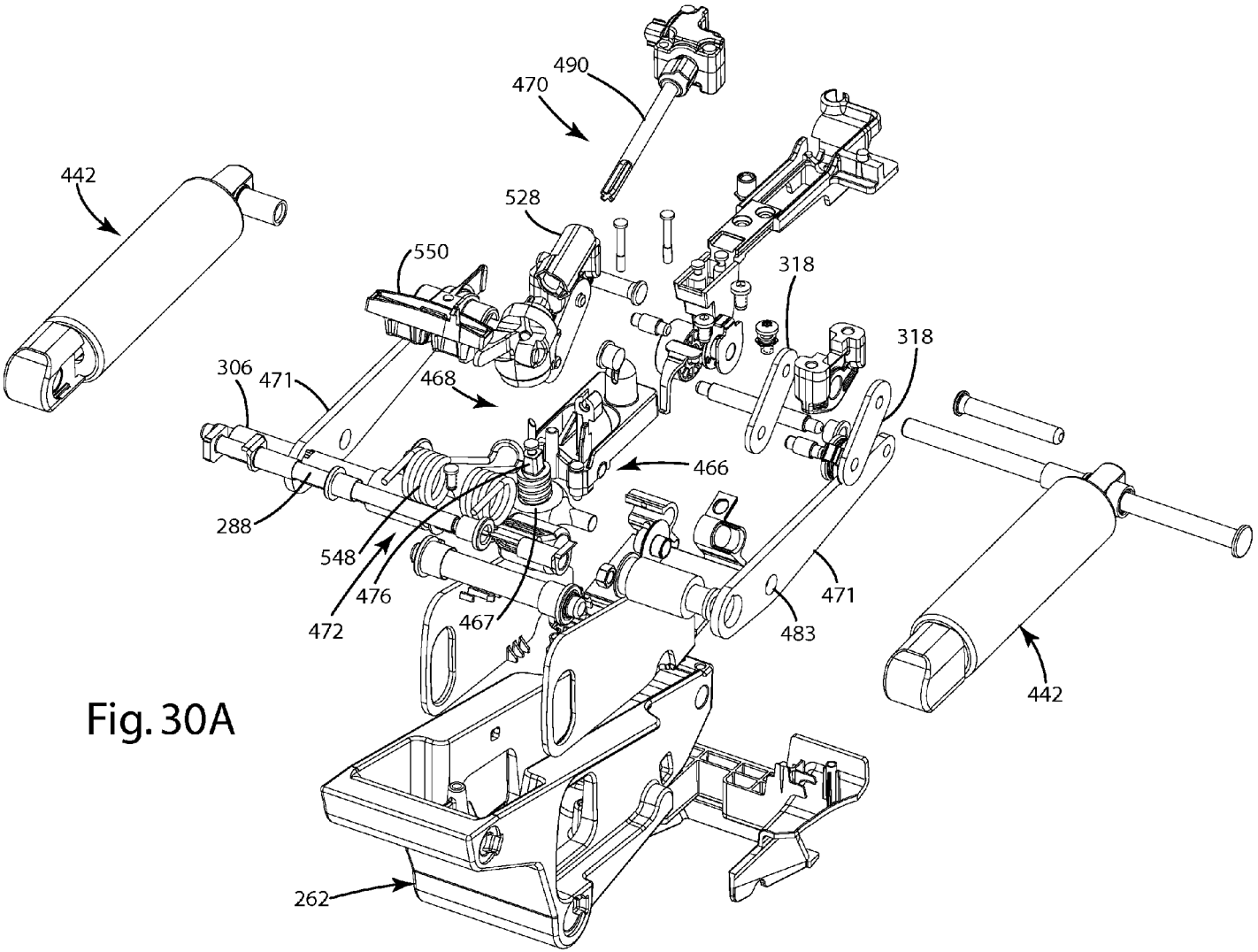
FIG. 30A is an exploded view of a moment arm shift assembly.
Figure 30B:
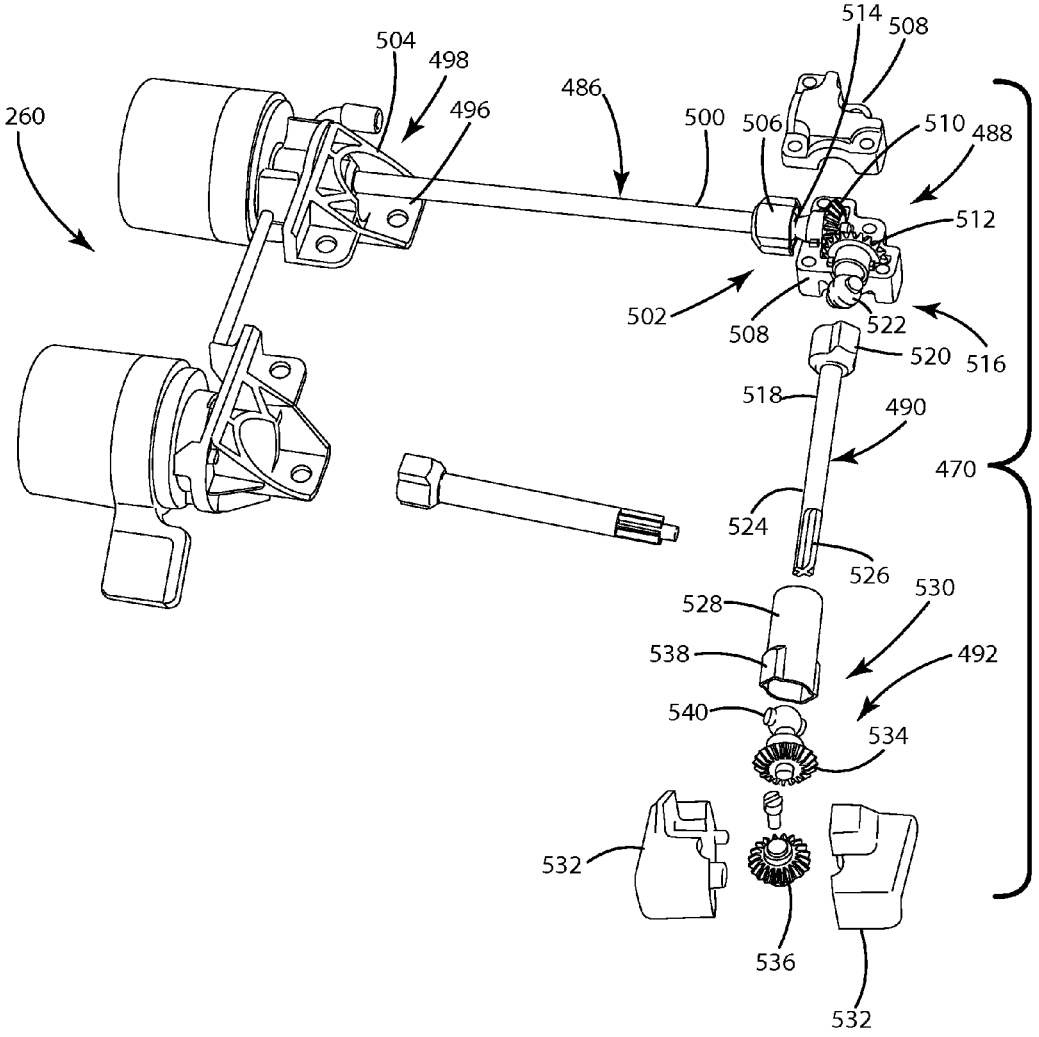
FIG. 30B is an exploded view of a moment arm shift drive assembly.
Figure 31:
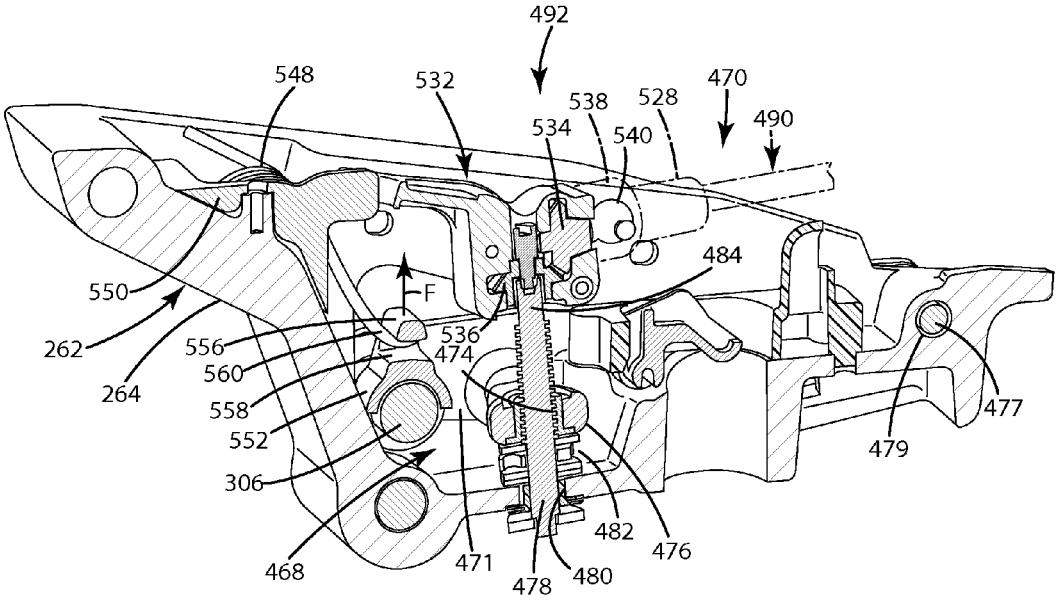
FIG. 31 is a cross-sectional perspective of the moment arm shift assembly.
Figure 32:
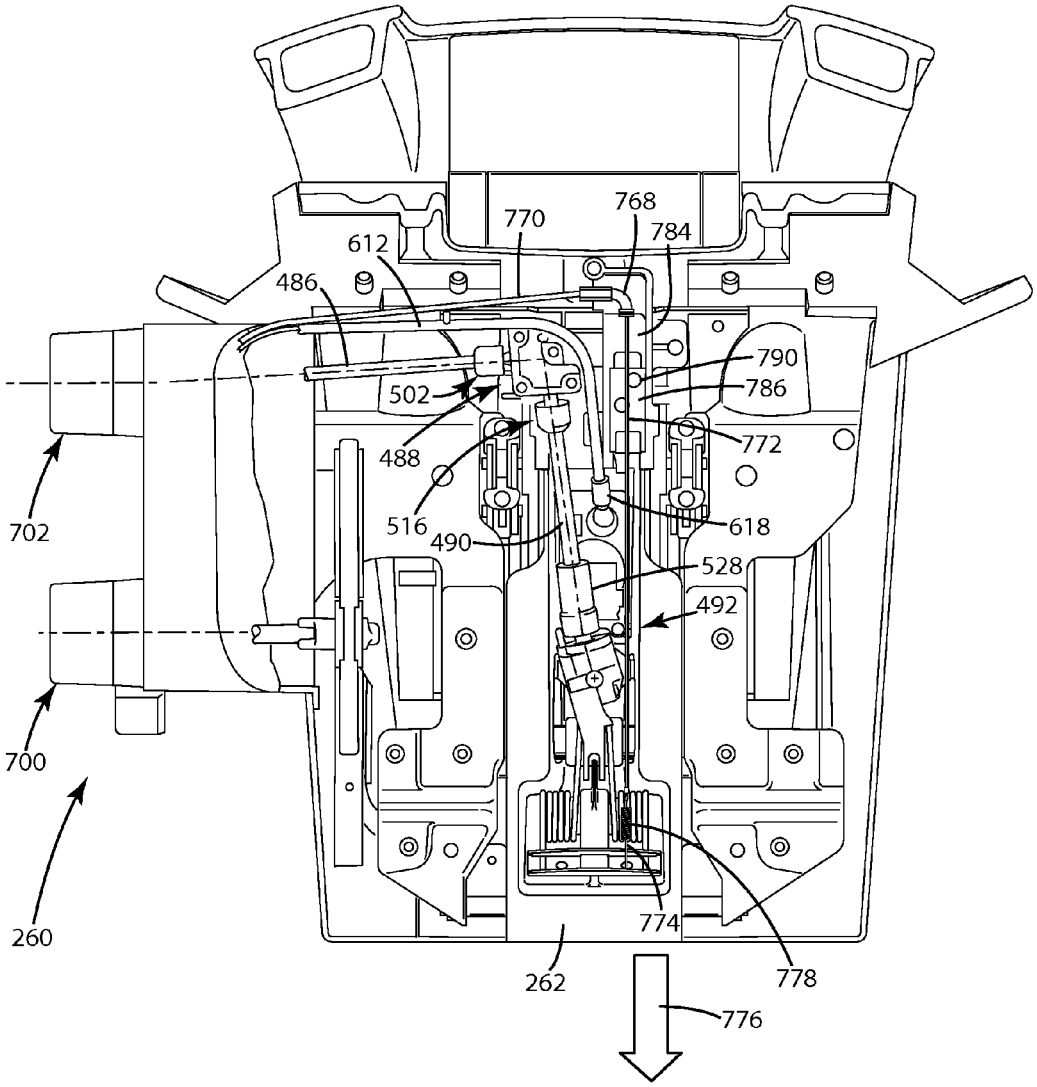
FIG. 32 is a top plan view of a plurality of control linkages.
Figure 33A:
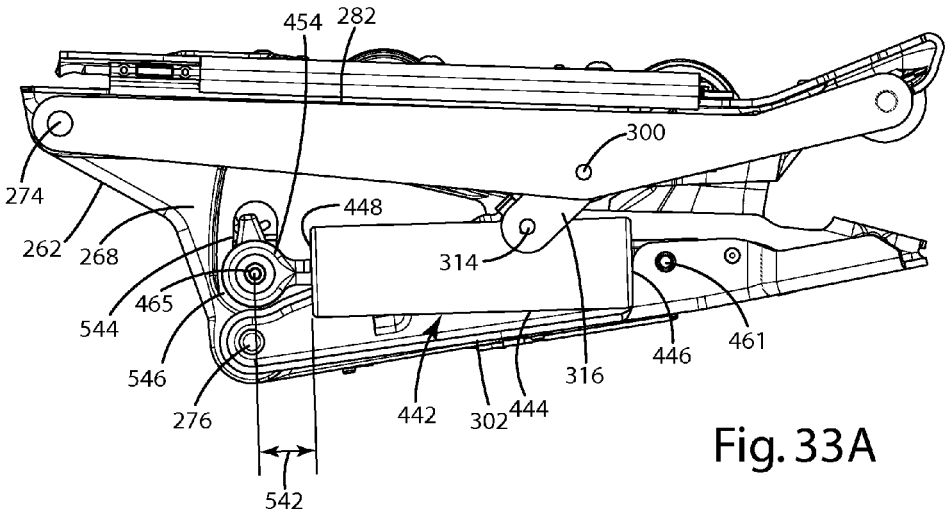
FIG. 33A is a side perspective view of the control assembly with the moment arm shift in a low tension position and the chair assembly in an upright position.
Figure 33B:
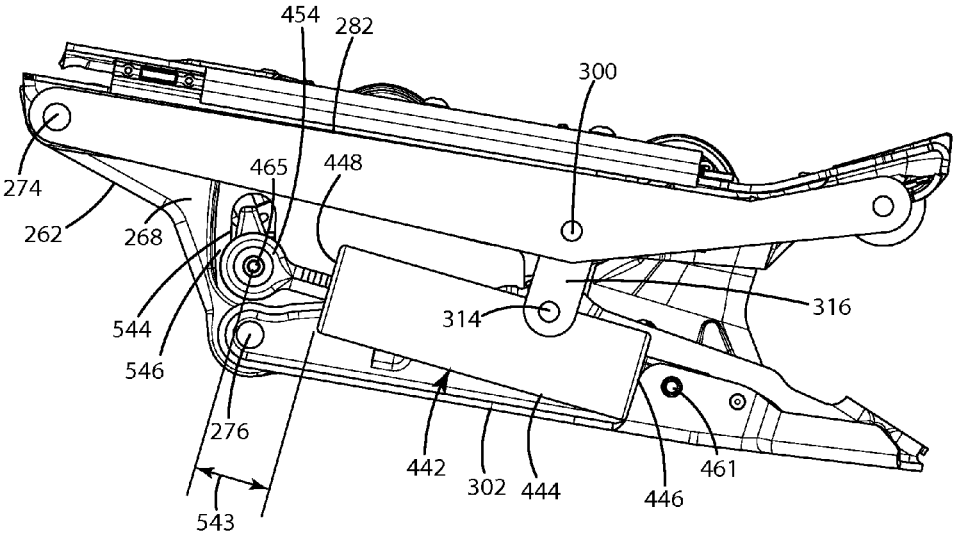
FIG. 33B is a side perspective view of the control assembly with the moment arm shift in a low tension position and the chair assembly in a reclined position.
Figure 34A:
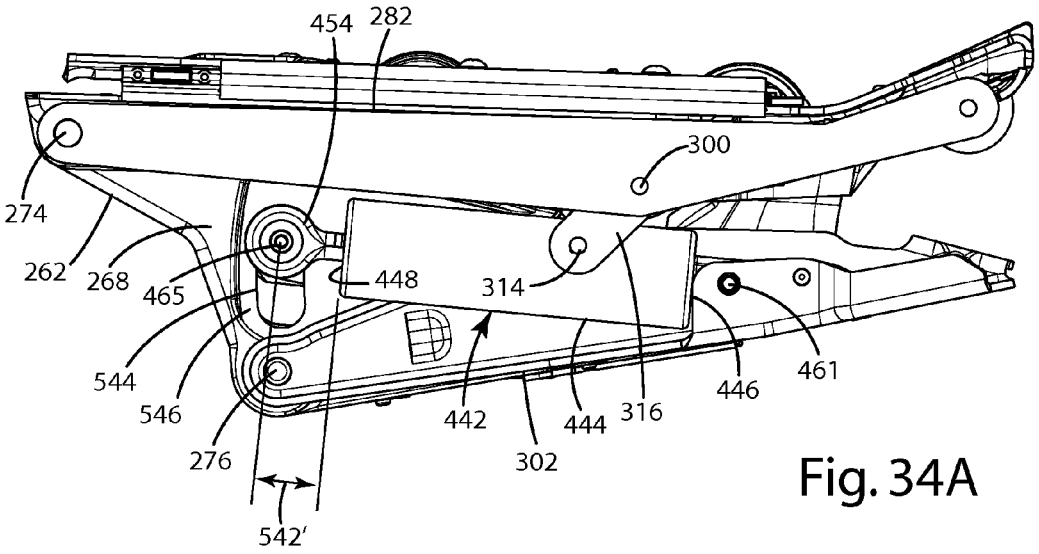
FIG. 34A is a side perspective view of the control assembly with the moment arm shift in a high tension position and the chair assembly in an upright position.
Figure 34B:
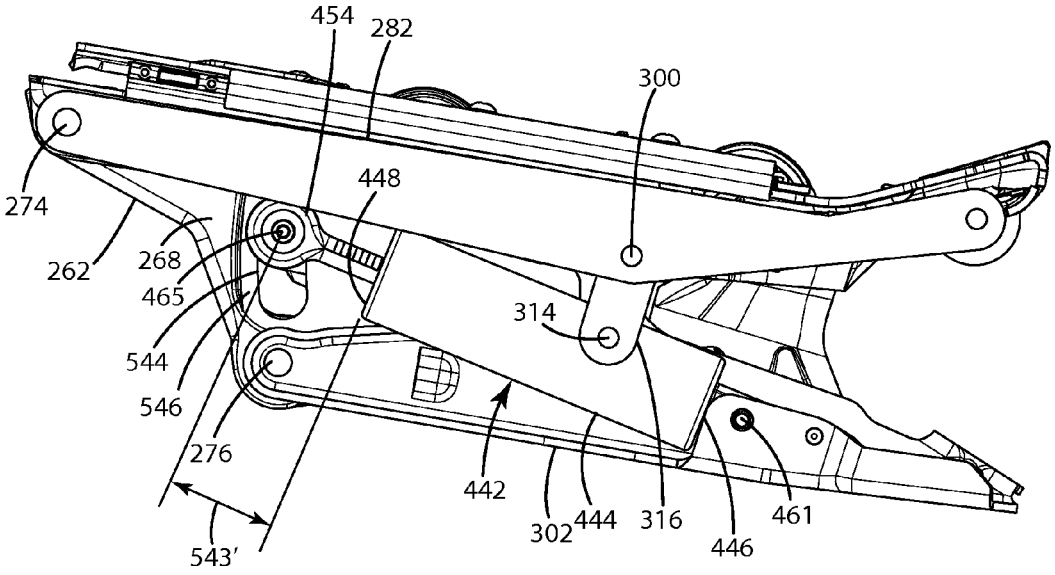
FIG. 34B is a side perspective view of the control assembly with the moment arm shift in a high tension position and the chair assembly in a reclined position.

A pair of spring assemblies 442 (FIGS. 20 and 21) bias the back assembly 18 from the reclined position F towards the upright position E. As best illustrated in FIG. 22, each spring assembly 442 includes a cylindrically-shaped housing 444 having a first end 446 and a second end 448. Each spring assembly 442 further includes a compression coil spring 450, a first coupler 452 and a second coupler 454. In the illustrated example, the first coupler is secured to the first end 446 of the housing 444, while the second coupler 454 is secured to a rod member 456 that extends through the coil spring 450. A washer 457 is secured to a distal end of the rod member 458 and abuts an end of the coil spring 450, while the opposite end of the coil spring 450 abuts the second end 448 of the housing 444. The first coupler 452 is pivotably secured to the back support structure 302 by a pivot pin 460 for pivoting movement about a pivot point 461, wherein the pivot pin 460 is received within pivot apertures 462 of the back support structure 302, while the second coupler 454 is pivotably coupled to a moment arm shift assembly 466 (FIGS. 30-32) by a shaft 464 for pivoting about a pivot point 465. The moment arm shift assembly is adapted to move the biasing or spring assembly 442 from a low tension setting (FIG. 33A) to a high tension setting (FIG. 34A) wherein the force exerted by the biasing assembly 442 on the back assembly 18 is increased relative to the low-tension setting.

As illustrated in FIGS. 30A-32, the moment arm shift assembly 466 includes an adjustment assembly 468, a moment arm shift linkage assembly 470 operably coupling the control input assembly 260 to the adjustment assembly 468 and allowing the operator to move the biasing assembly 442 between the low and high tension settings, and an adjustment assist assembly 472 that is adapted to reduce the amount of input force required to be exerted by the user on the control input assembly 260 to move the moment arm shift assembly 466 from the low tension setting to the high tension setting, as described below.

The adjustment assembly 468 comprises a pivot pin 467 that includes a threaded aperture that threadably receives a threaded adjustment shaft 476 therein. The adjustment shaft 476 includes a first end 478 and a second end 484, wherein the first end 478 extends through an aperture 480 of the base structure 262 and is guided for pivotal rotation about a longitudinal axis by a bearing assembly 482. The pivot pin 467 is supported from the base structure 262 by a linkage assembly 469 that includes a pair of linkage arms 471 each having a first end 473 pivotably coupled to the second coupler 454 by the pivot pin 464 and a second end 475 pivotably coupled to the base structure 262 by a pivot pin 477 pivotably received within a pivot aperture 479 of the base structure 262 for pivoting about a pivot point 481, and an aperture 483 that receives a respective end of the pivot pin 467. The pivot pin 467 is pivotably coupled with the linkage arms 471 along the length thereof.

The moment arm shift linkage assembly 470 (FIGS. 30A and 30B) includes a first drive shaft 486 extending between the control input assembly 260 and a first beveled gear assembly 488, and a second drive shaft 490 extending between and operably coupling the first beveled gear assembly 488 with a second beveled gear assembly 492, wherein the second beveled gear assembly 492 is connected to the adjustment shaft 476. The first drive shaft 486 includes a first end 496 operably coupled to the control input assembly 260 by a first universal joint assembly 498, while the second end 500 of the first drive shaft 486 is operably coupled to the first beveled gear assembly 488 by a second universal joint assembly 502. In the illustrated example, the first end 496 of the first drive shaft 486 includes a female coupler portion 504 of the first universal joint assembly 498, while the second end 500 of the first drive shaft 486 includes a female coupler portion 506 of the second universal joint assembly 502. The first beveled gear assembly 488 includes a housing assembly 508 that houses a first beveled gear 510 and a second beveled gear 512 therein. As illustrated, the first beveled gear 510 includes an integral male coupler portion 514 of the second universal joint 502. The first end 496 of the second drive shaft 490 is coupled to the first beveled gear assembly 488 by a third universal joint assembly 516. A first end 518 of the second drive shaft 490 includes a female coupler portion 520 of the third universal joint assembly 516. The second beveled gear 512 includes an integral male coupler portion 522 of the third universal joint assembly 516. A second end 524 of the second drive shaft 490 includes a plurality of longitudinally extending splines 526 that mate with corresponding longitudinally extending splines (not shown) of a coupler member 528. The coupler member 528 couples the second end 524 of the second drive shaft 490 with the second beveled gear assembly 492 via a fourth universal joint assembly 530. The fourth universal joint assembly 530 includes a housing assembly 532 that houses a first beveled gear 534 coupled to the coupler member 528 via the fourth universal joint assembly 530, and a second beveled gear 536 fixed to the second end 484 of the adjustment shaft 476. The coupler member 428 includes a female coupler portion that receives a male coupler portion 540 integral with the first beveled gear 534.

In assembly, the adjustment assembly 468 of the moment arm shift assembly 466 is operably supported by the base structure 262, while the control input assembly 260 is operably supported by the control input assembly mounting portion 296 of the seat support structure 282. As a result, the relative angles and distances between the control input assembly 260 and the adjustment assembly 468 of the moment arm shift assembly 466 change as the seat support structure 282 is moved between the fully upright position G and the fully reclined H. The third and fourth universal joint assemblies 516, 530, and the spline assembly between the splines cooperate to compensate for these relative changes in angle and distance.

As is best illustrated in FIGS. 33A-34B, the moment arm shift assembly 466 functions to adjust the biasing assemblies 442 between the low-tension and high-tension settings. Specifically, the biasing assemblies 442 are shown in a low-tension setting with the chair assembly 10 in an upright position in FIG. 33A, and the low-tension setting with the chair assembly 10 in a reclined position in FIG. 33B, while FIG. 34A illustrates the biasing assemblies 442 in the high-tension setting with the chair in an upright position, and FIG. 34B the biasing assemblies is in the high-tension setting with the chair assembly 10 in the reclined position. The distance 542, as measured between the pivot point 465 and the second end 448 of the housing 444 of the spring assembly 442, serves as a reference to the amount of compression exerted on the spring assembly 442 when the moment arm shift assembly 466 is positioned in the low-tension setting and the chair is in the upright position. The distance 542' (FIG. 33B) comparatively illustrates the increased amount of compressive force exerted on the spring assembly 442 when the moment arm shift assembly 466 is in the high-tension setting and the chair is in the upright position. The user adjusts the amount of force exerted by the biasing assemblies 442 on the back support structure 302 by moving the moment arm shift assembly 466 from the low-tension setting to the high-tension setting. Specifically, the operator, through an input to the control input assembly 260, drives the adjustment shaft 476 of the adjustment assembly 468 in rotation via the moment arm shift linkage assembly 470, thereby causing the pivot shaft 467 to travel along the length of the adjustment shaft 476, thus changing the compressive force exerted on the spring assemblies 442 as the pivot shaft 467 is adjusted with respect to the base structure 262. The pivot shaft 467 travels within a slot 544 located within a side plate member 546 attached to a side wall 268 of the base structure 262. It is noted that the distance 542' when the moment arm shift assembly 466 is in the high-tension setting and the chair assembly 10 is in the upright position is greater than the distance 542 when the moment arm shift 466 is in the low-tension setting and the chair is in the upright position, thereby indicating that the compressive force as exerted on the spring assemblies 442, is greater when the moment arm shift is in the high-tension setting as compared to a low-tension setting. Similarly, the distance 543 (FIG. 33B) is greater than the distance 543' (FIG. 34B), resulting in an increase in the biasing force exerted by the biasing assemblies 442 and forcing the back assembly 18 from the reclined position towards the upright position. It is noted that the change in the biasing force exerted by the biasing assemblies 442 corresponds to a change in the biasing torque exerted about the second pivot point 276, and that in certain configurations, a change in the biasing torque is possible without a change in the length of the biasing assemblies 442 or a change in the biasing force.

Figure 35:
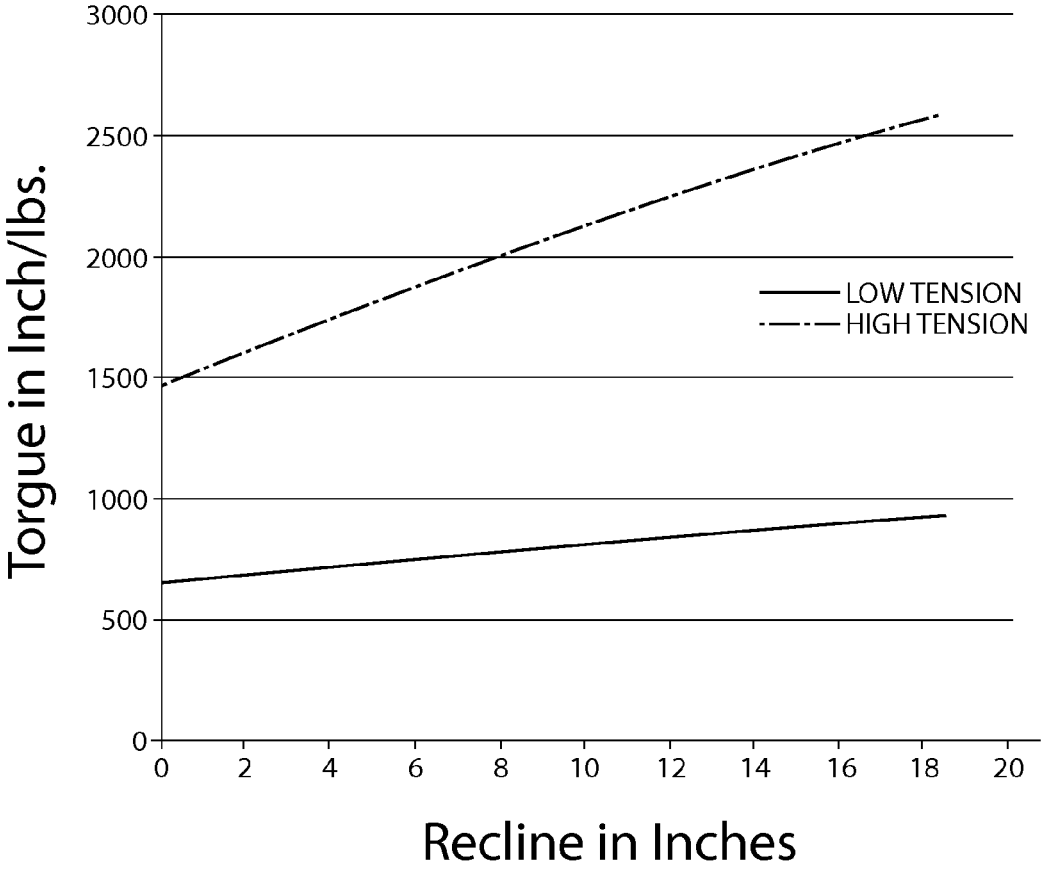
FIG. 35 is a chart of torque vs. amount of recline for low and high tension settings.

FIG. 35 is a graph of the amount of torque exerted about the second pivot point 276 forcing the back support structure 302 from the reclined position towards the upright position as the back support structure 302 is moved between the reclined and upright positions. In the illustrated example, the biasing assemblies 442 exert a torque about the second pivot point 276 of about 652 inch-pounds when the back support structure is in the upright position and the moment arm shift 466 is in the low tension setting, and of about 933 inch-pounds when the back support structure is in the reclined position and the moment arm shift 466 is in the low tension setting, resulting in a change of approximately 43%. Likewise, the biasing assemblies 442 exert a torque about the second pivot point 274 of about 1.47E+03 inch-pounds when the back support structure is in the upright position and the moment arm shift 466 is in the high tension setting, and of about 2.58E+03 inch-pounds when the back support structure is in the reclined position and the moment arm shift 466 is in the high tension setting, resulting in a change of approximately 75%. This significant change in the amount of torque exerted by the biasing assembly 442 between the low tension setting and the high tension setting of the moment arm shift 466 as the back support structure 302 is moved between the upright and reclined positions allows the overall chair assembly 10 to provide proper forward back support to users of varying height and weight.

The adjustment assist assembly 472 assists an operator in moving the moment arm shift assembly 466 from the high-tension setting to the low-tension setting. The adjustment assist assembly 472 includes a coil spring 548 secured to the front wall 264 of the base structure 262 by a mounting structure 550, and a catch member 552 that extends about the shaft 306 fixed with the linkage arms 471, and that includes a catch portion 556 defining an aperture 558 that catches a free end 560 of the coil spring 548. The coil spring 548 exerts a force F on the catch member 552 and shaft 306 and the linkage arms 471 in an upward vertical direction, thereby reducing the amount of input force the user must exert on the control input assembly 260 to move the moment arm shift assembly 466 from the low-tension setting to the high-tension setting.

Figure 3:
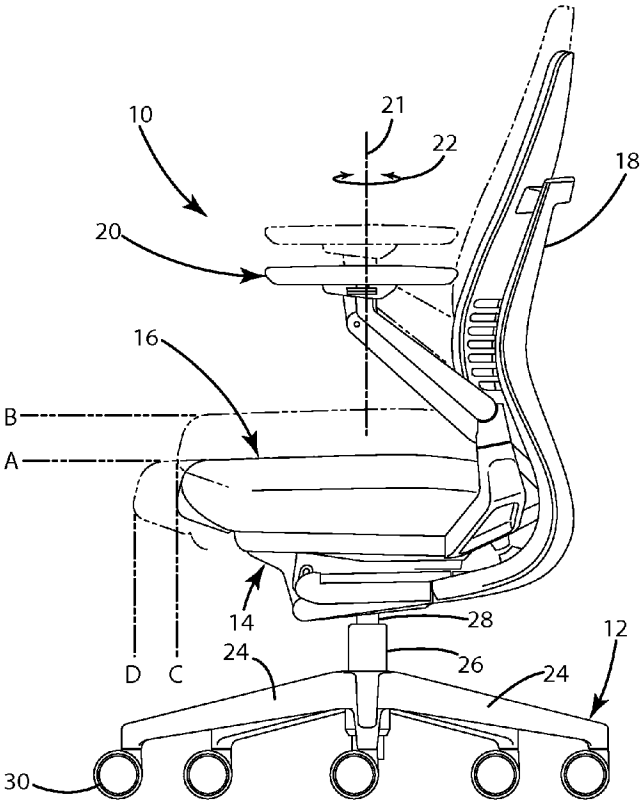
FIG. 3 is a side elevational view of the chair assembly showing the chair assembly in a lowered position and in a raised position in dashed line, and a seat assembly in a retracted position and in an extended position in dashed line.
Figure 19:
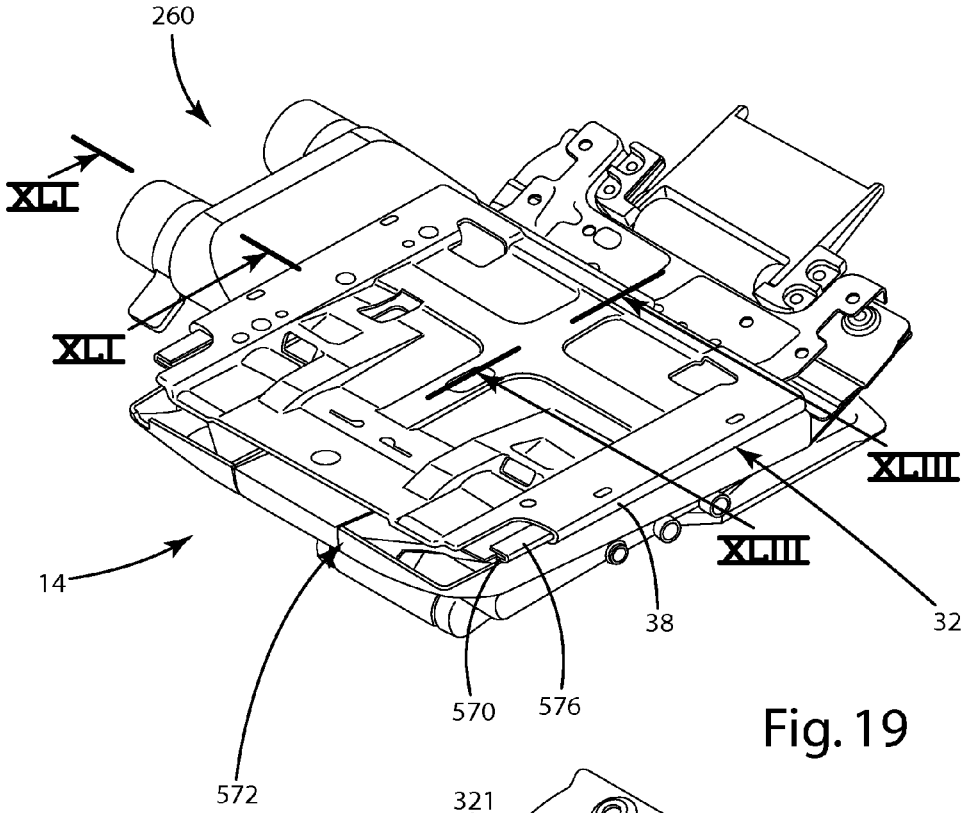
FIG. 19 is a perspective view of a control input assembly supporting a seat support plate thereon.
Figure 36:
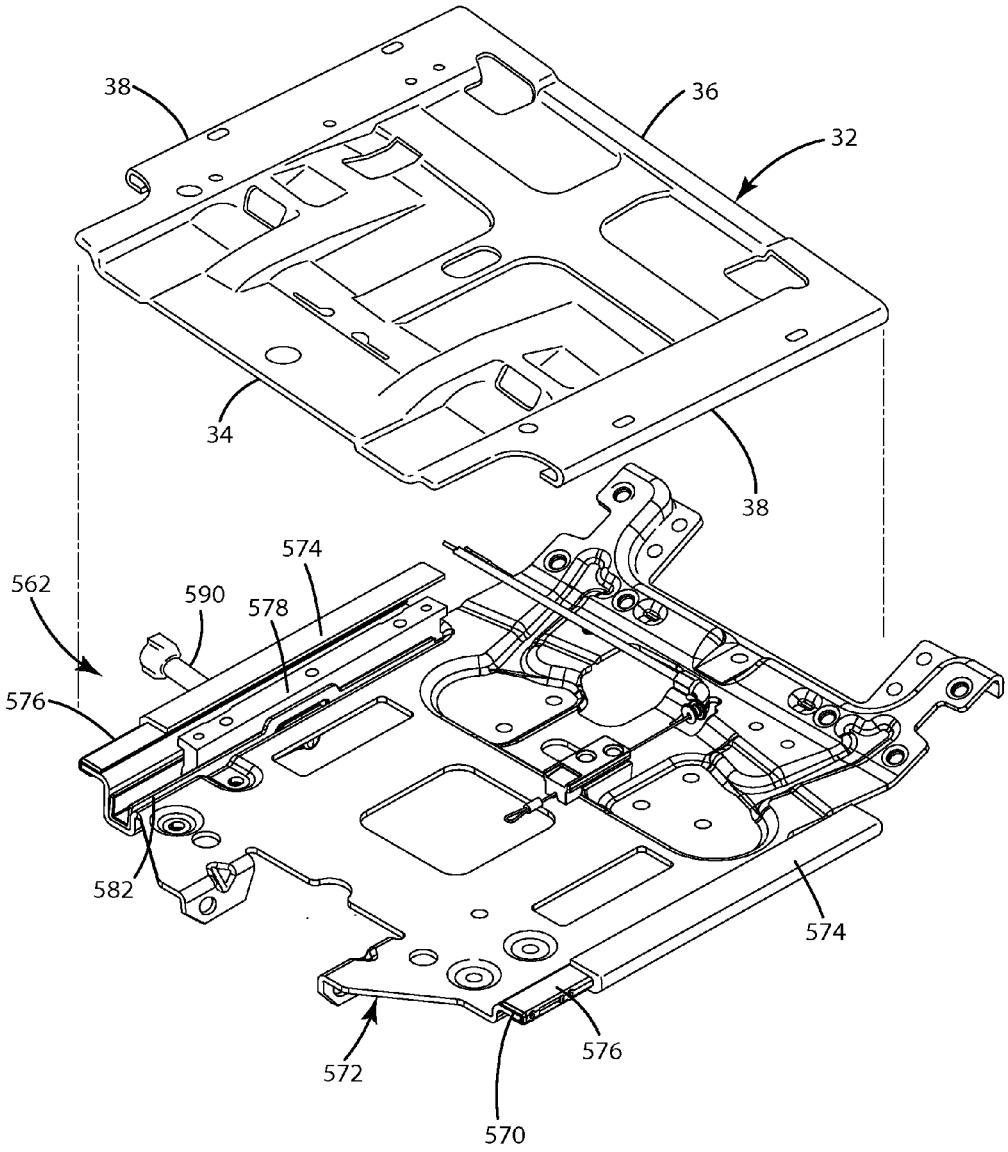
FIG. 36 is a perspective view of a direct drive assembly with the seat support plate exploded therefrom.
Figure 37:
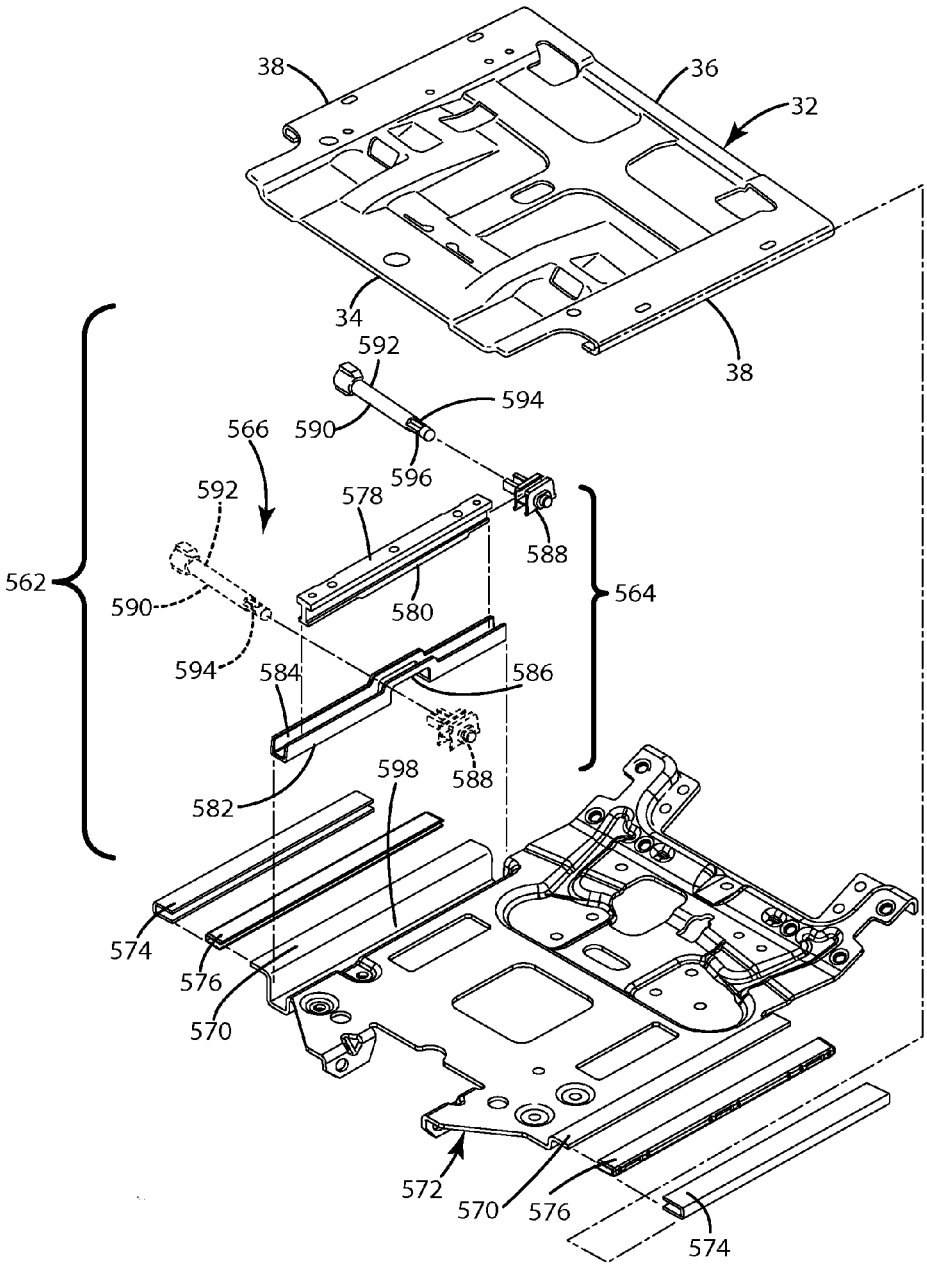
FIG. 37 is an exploded perspective view of the direct drive assembly.

As noted above, the seat assembly 16 is longitudinally shiftable with respect to the control assembly 14 between a retracted position C and an extended position D (FIG. 3). As best illustrated in FIGS. 19, 36 and 37, a direct drive assembly 562 includes a drive assembly 564 and a linkage assembly 566 that couples the control input assembly 260 with the drive assembly 564, thereby allowing a user to adjust the linear position of the seat by adjusting the linear position of the seat assembly 16 with respect to the control assembly 14. In the illustrated example, the seat support plate 32 includes the C-shaped guiderails 38 which wrap about and slidably engage corresponding guide flanges 570 of a control plate 572 of the control assembly 14. A pair of C-shaped, longitudinally extending connection rails 574 are positioned within the corresponding guiderails 38 and are coupled with the seat support plate 32. A pair of C-shaped bushing members 576 extend longitudinally within the connection rails 574 and are positioned between the connection rails 574 and the guide flanges 570. The drive assembly 564 includes a rack member 578 having a plurality of downwardly extending teeth 580. The drive assembly 564 further includes a rack guide 582 having a C-shaped cross-sectional configuration defining a channel 584 that slidably receives the rack member 578 therein. The rack guide 582 includes a relief 586 located along the length thereof that matingly receives a bearing member 588 therein. Alternatively, the bearing member 588 may be formed as an integral portion of the rack guide 582. The drive assembly 564 further includes a drive shaft 590 having a first end universally coupled with the control input assembly 260 and the second end 594 having a plurality of radially-spaced teeth 596. In assembly, the seat support plate 32 is slidably coupled with the control plate 572 as described above, with the rack member 578 being secured to an underside of the seat support plate 32 and the rack guide 582 being secured within an upwardly opening channel 598 of the control plate 572. In operation, an input force exerted by the user to the control input assembly 260 is transferred to the drive assembly 564 via the linkage assembly 566, thereby driving the teeth 596 of the drive shaft 590 against the teeth 580 of the rack member 578 and causing the rack member 578 and the seat support plate 32 to slide with respect to the rack guide 582 and the control plate 572.

Figure 38:
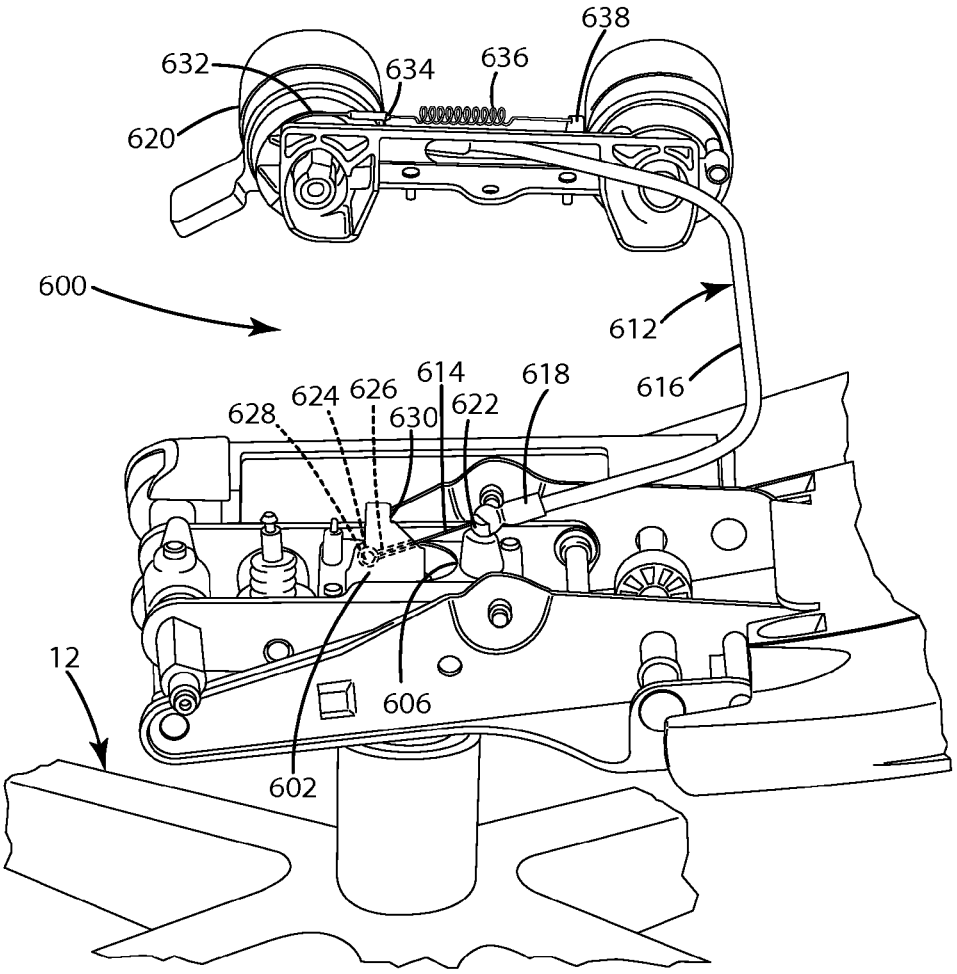
FIG. 38 is a perspective view of a vertical height control assembly.
Figure 39:
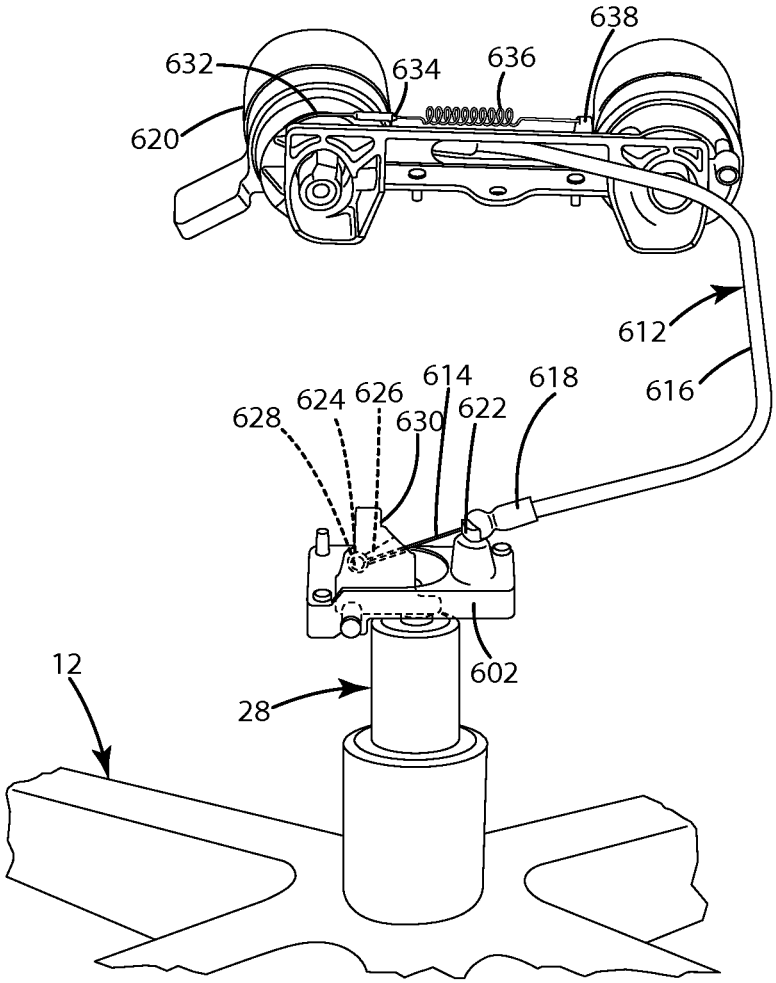
FIG. 39 is a side elevational view of the vertical height control assembly.
Figure 40:
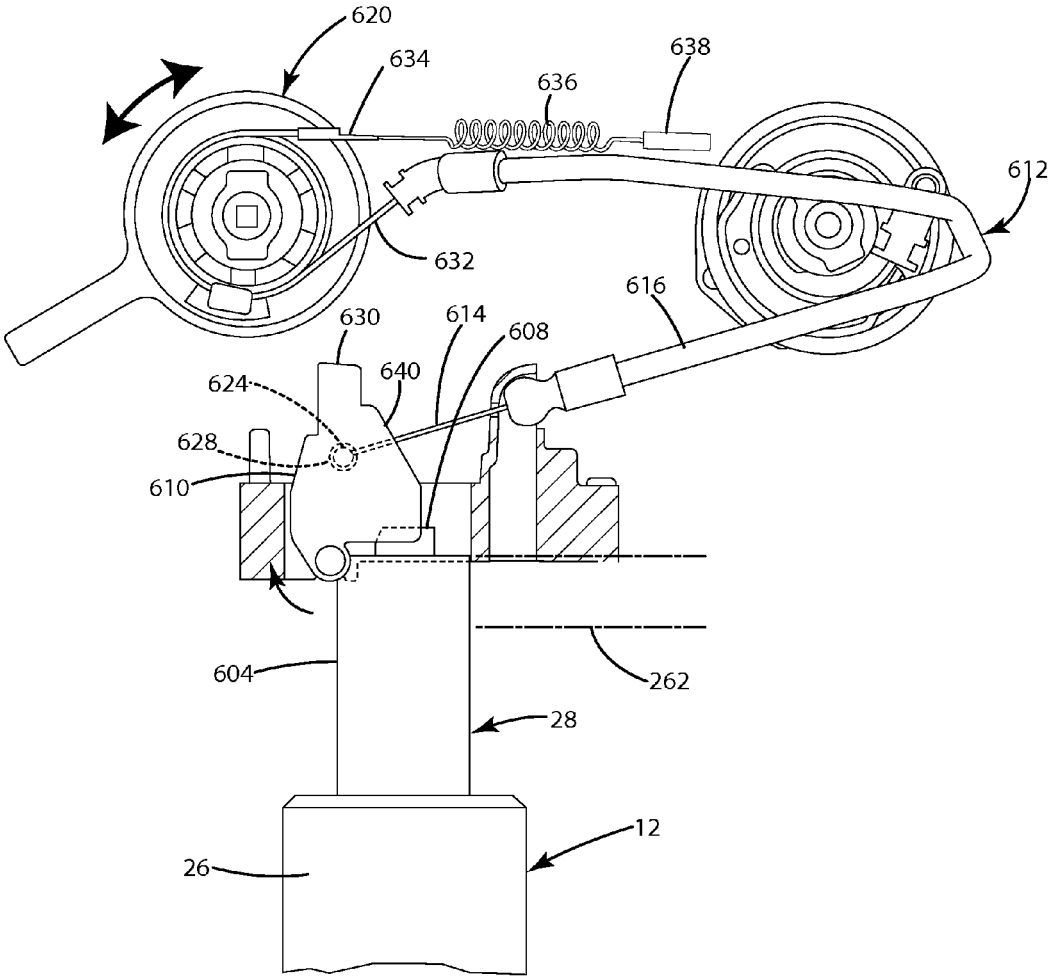
FIG. 40 is a side elevational view of the vertical height control assembly.
Figure 41:
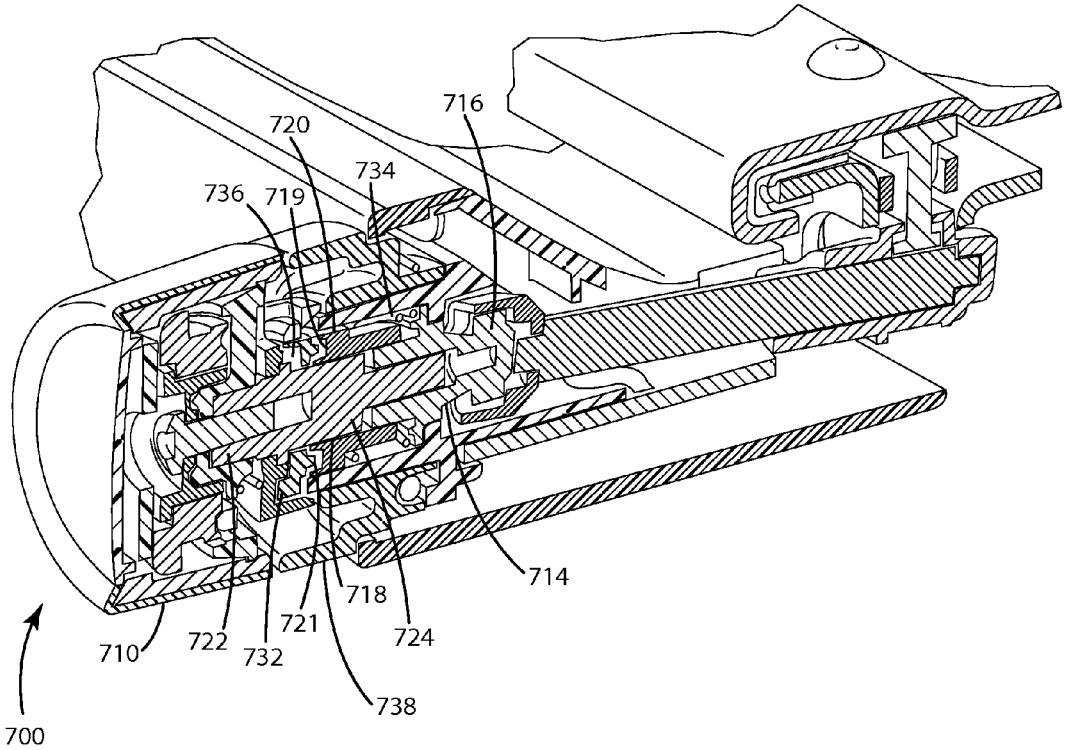
FIG. 41 is a cross-sectional front elevational view of a first input control assembly.
Figures 42A, 42B:
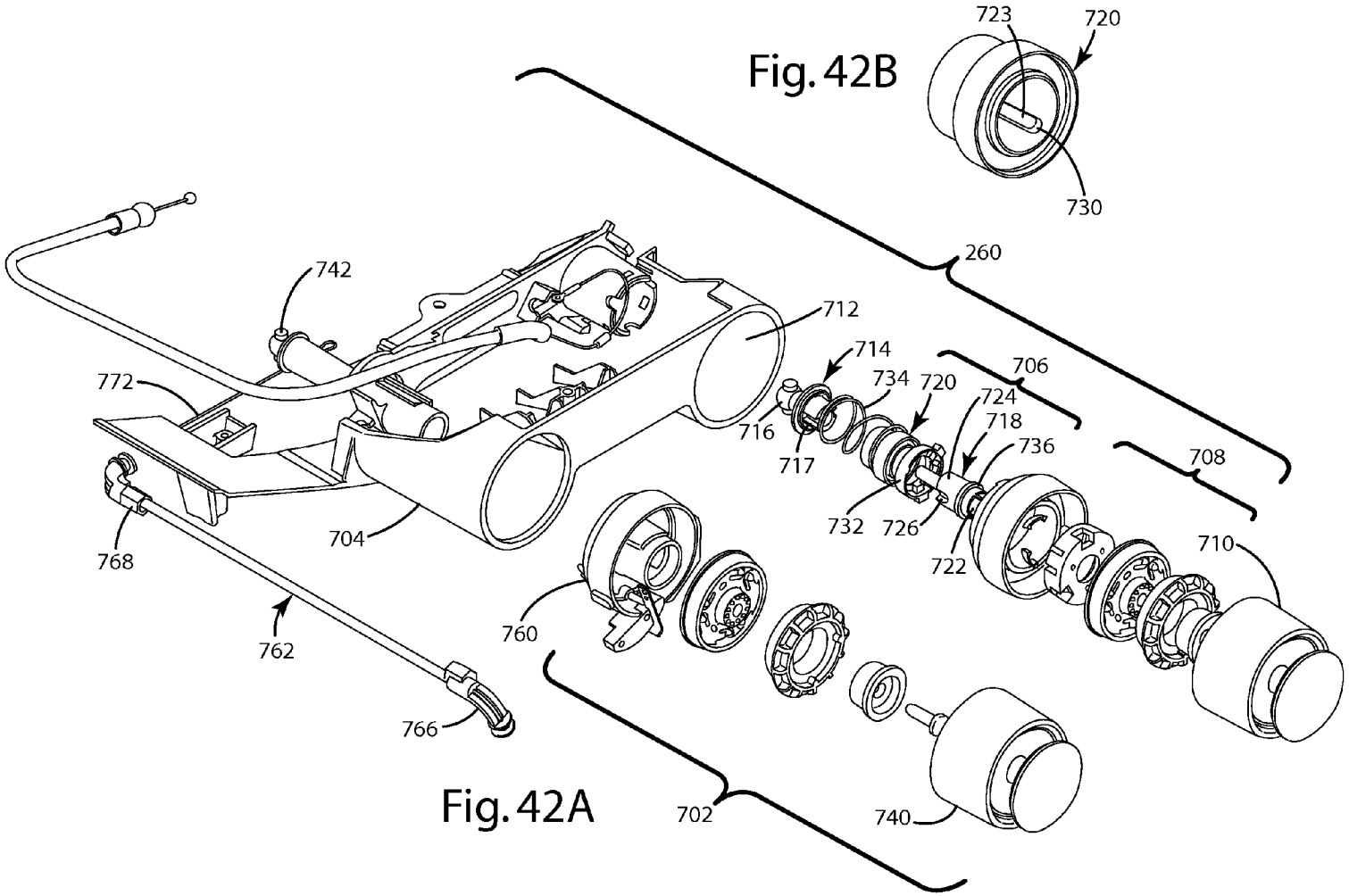
FIG. 42A is an exploded view of a control input assembly.
FIG. 42B is an enlarged perspective view of a clutch member of a first control input assembly.
Figure 42C:
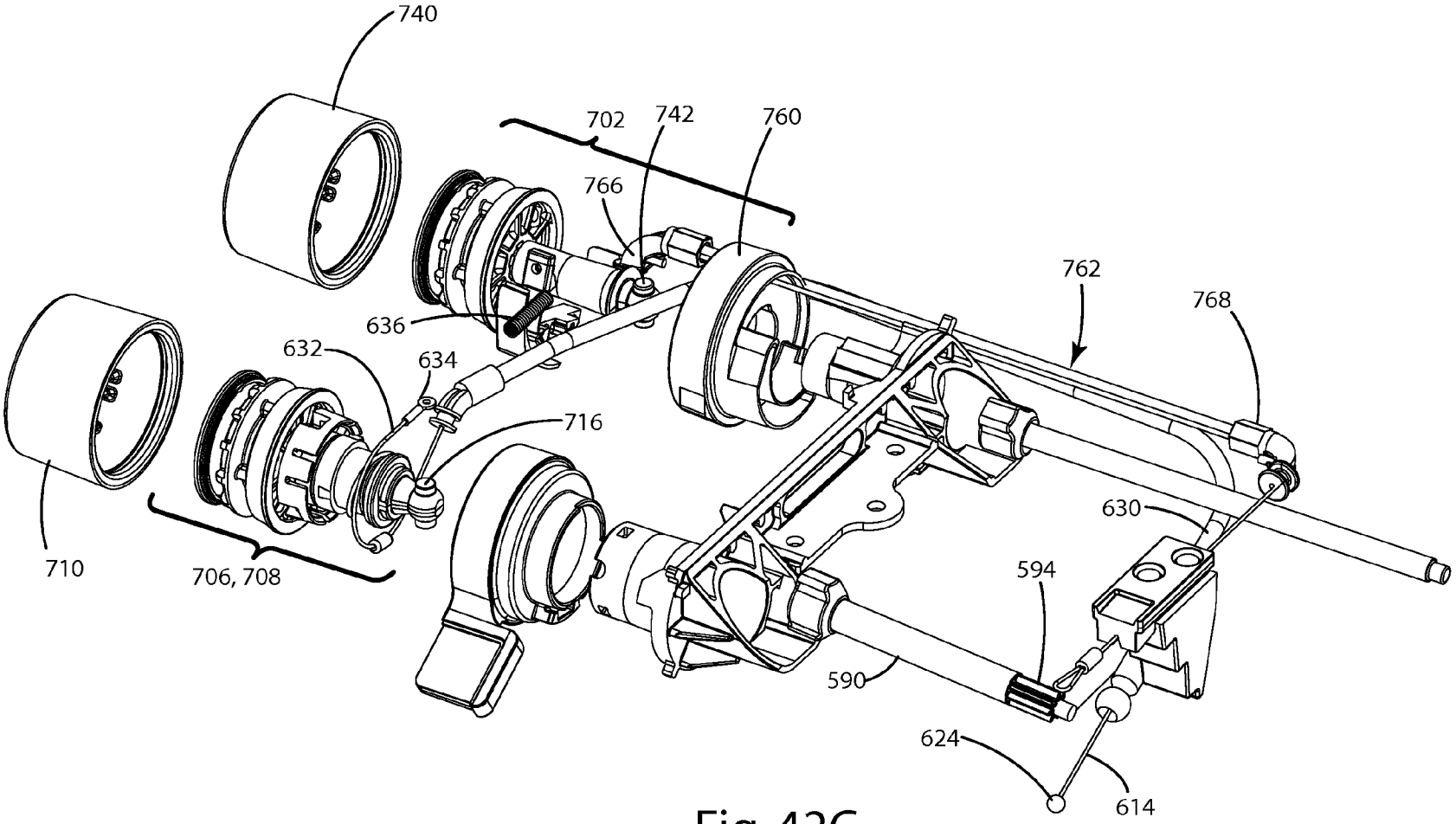
FIG. 42C is a exploded view of the control input assembly.

With further reference to FIGS. 38-40, the chair assembly 10 includes a height adjustment assembly 600 that permits vertical adjustment of seat 16 and back 18 relative to the base assembly 12. Height adjustment assembly 600 includes a pneumatic cylinder 28 that is vertically disposed in central column 26 of base assembly 12 in a known manner.

A bracket structure 602 is secured to housing or base structure 262, and upper end portion 604 of pneumatic cylinder 28 is received in opening 606 of base structure 262 in a known manner. Pneumatic cylinder 28 includes an adjustment valve 608 that can be shifted down to release pneumatic cylinder 28 to provide for height adjustment. A bell crank 610 has an upwardly extending arm 630 and a horizontally extending arm 640 that is configured to engage a release valve 608 of pneumatic cylinder 28. Bell crank 610 is rotatably mounted to bracket 602. A cable assembly 612 operably interconnects bell crank 610 with adjustment wheel/lever 620. Cable assembly 612 includes an inner cable 614 and an outer cable or sheath 616. Outer sheath 616 includes a spherical ball fitting 618 that is rotatably received in a spherical socket 622 formed in bracket 602. A second ball fitting 624 is connected to end 626 of inner cable 614. Second ball fitting 624 is rotatably received in a second spherical socket 628 of upwardly extending arm 630 of bell crank 610 to permit rotational movement of the cable end during height adjustment.

A second or outer end portion 632 of inner cable 614 wraps around wheel 620, and an end fitting 634 is connected to inner cable 614. A tension spring 636 is connected to end fitting 634 and to the seat structure at point 638. Spring 636 generates tension on inner cable 614 in the same direction that cable 614 is shifted to rotate bell crank 610 when valve 608 is being released. Although spring 636 does not generate enough force to actuate valve 608, spring 636 does generate enough force to bias arm 640 of bell crank 610 into contact with valve 608. In this way, lost motion or looseness that could otherwise exist due to tolerances in the components is eliminated. During operation, a user manually rotates adjustment wheel 620, thereby generating tension on inner cable 614. This causes bell crank 610 to rotate, causing arm 640 of bell crank 610 to press against and actuate valve 608 of pneumatic cylinder 28.

An internal spring (not shown) of pneumatic cylinder 28 biases valve 608 upwardly, causing valve 608 to shift to a non-actuated position upon release of adjustment wheel 620.

The control input assembly 260 (FIGS. 19 and 41-43) comprises a first control input assembly 700 and a second control input assembly 702 each adapted to communicate inputs from the user to the chair components and features coupled thereto, and housed within a housing assembly 704. The control input assembly 260 includes an anti-back drive assembly 706, an overload clutch assembly 708, and a knob 710. The anti-back drive mechanism or assembly 706 that prevents the direct drive assembly 562 (FIGS. 36 and 37) and the seat assembly 16 from being driven between the retracted and extended positions C, D without input from the control assembly 700. The anti-back drive assembly 706 is received within an interior 712 of the housing assembly 704 and includes an adaptor 714 that includes a male portion 716 of a universal adaptor coupled to the second end 594 of the drive shaft 590 (FIG. 37) at one end thereof, and including a spline connector 717 at the opposite end. A cam member 718 is coupled with the adaptor 714 via a clutch member 720. Specifically, the cam member 718 includes a spline end 722 coupled for rotation with the knob 710, and a cam end 724 having an outer cam surface 726. The clutch member 720 includes an inwardly disposed pair of splines 723 that slidably engage the spline connector 717 having a cam surface 730 that cammingly engages the outer cam surface 726 of the cam member 718, as described below. The clutch member 720 has a conically-shaped clutch surface 719 that is engagingly received by a locking ring 732 that is locked for rotation with respect to the housing assembly 704 and includes a conically-shaped clutch surface 721 corresponding to the clutch surface 719 of the clutch member 720, and cooperating therewith to form a cone clutch. A coil spring 734 biases the clutch member 720 towards engaging the locking ring 732.

Without input, the biasing spring 734 forces the conical surface of the clutch member 720 into engagement with the conical surface of the locking ring 732, thereby preventing the "back drive" or adjustment of the seat assembly 16 between the retracted and extended positions C, D, simply by applying a rearward or forward force to the seat assembly 16 without input from the first control input assembly 700. In operation, an operator moves the seat assembly 16 between the retracted and extended positions C, D by actuating the direct drive assembly 562 via the first control input assembly 700. Specifically, the rotational force exerted on the knob 710 by the user is transmitted from the knob 710 to the cam member 718. As the cam member 718 rotates, the outer cam surface 726 of the cam member 718 acts on the cam surface 730 of the clutch member 720, thereby overcoming the biasing force of the spring 734 and forcing the clutch member 720 from an engaged position, wherein the clutch member 720 disengages the locking ring 732. The rotational force is then transmitted from the cam member 718 to the clutch member 720 and then to the adaptor 714, which is coupled to the direct drive assembly 762 via the linkage assembly 566.

It is noted that a slight amount of tolerance within the first control input assembly 700 allows a slight movement (or "slop") of the cam member 718 in the linear direction and rotational direction as the clutch member 720 is moved between the engaged and disengaged positions. A rotational ring-shaped damper element 736 comprising a thermoplastic elastomer (TPE), is located within the interior 712 of the housing 704, and is attached to the clutch member 720. In the illustrated example, the damper element 736 is compressed against and frictionally engages the inner wall of the housing assembly 704.

The first control input assembly 700 also includes a second knob 738 adapted to allow a user to adjust the vertical position of the chair assembly between the lowered position A and the raised position B, as described below.

The second control input assembly 702 is adapted to adjust the tension exerted on the back assembly 18 during recline, and to control the amount of recline of the back assembly 18. A first knob 740 is operably coupled to the moment arm shift assembly 466 by the moment arm shift linkage assembly 470. Specifically, the second control input assembly 702 includes a male universal coupling portion 742 that couples with the female universal coupler portion 504 (FIGS. 30 and 31) of the shaft 486 of the moment arm shift linkage assembly 470.

Figure 43:
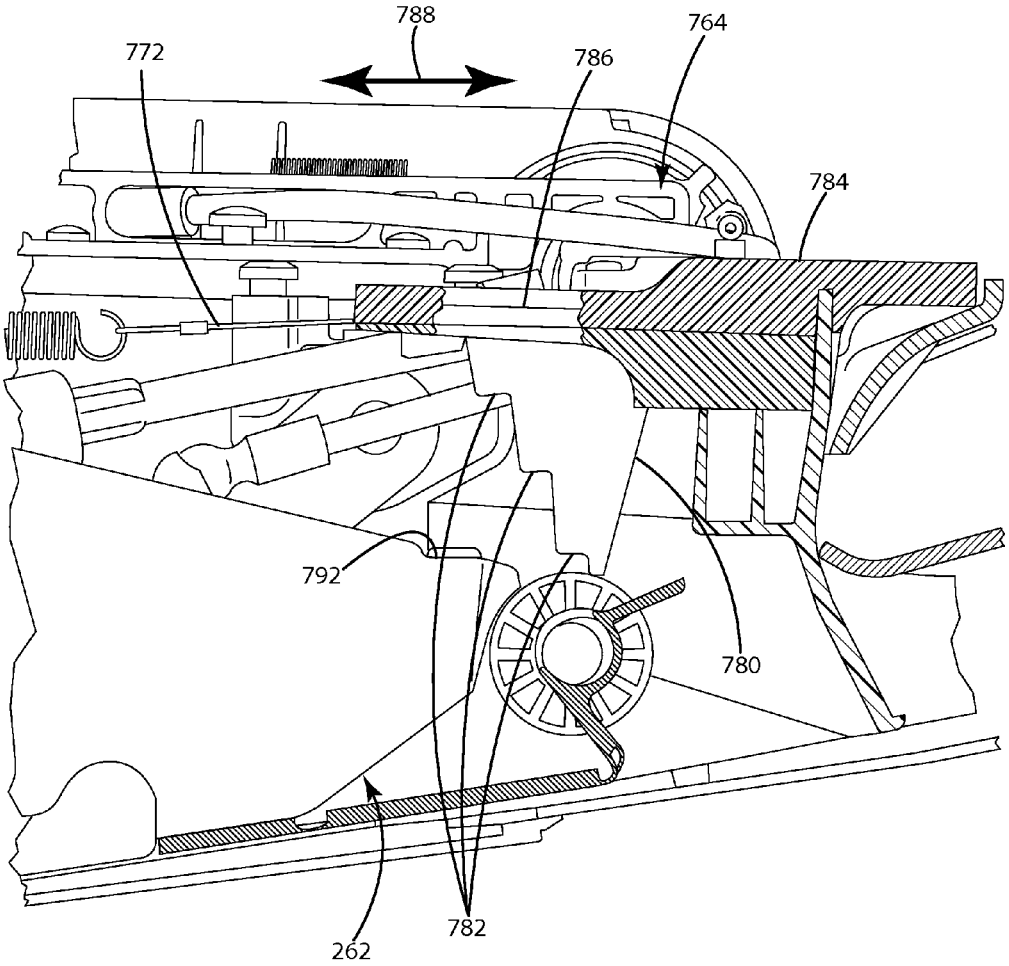
FIG. 43 is a side perspective view of a variable back control assembly.

A second knob 760 is adapted to adjust the amount of recline of the back assembly 18 via a cable assembly 762 operably coupling the second knob 760 to a variable back stop assembly 764 (FIG. 43). The cable assembly 762 includes a first cable routing structure 766, a second cable routing structure 768 and a cable tube 770 extending therebetween and slidably receiving an actuator cable 772 therein. The cable 772 includes a distal end 774 that is fixed with respect to the base structure 262, and is biased in a direction 776 by a coil spring 778. The variable back stop assembly 764 includes a stop member 780 having a plurality of vertically graduated steps 782, a support bracket 784 fixedly supported with respect to the seat assembly 16, and a slide member 786 slidably coupled to the support bracket 784 to slide in a fore-to-aft direction 788 and fixedly coupled to the stop member 780 via a pair of screws 790. The cable 772 is clamped between the stop member 780 and the slide member 786 such that longitudinal movement of the cable 772 causes the stop member 780 to move in the fore-and-aft direction 788. In operation, a user adjusts the amount of back recline possible by adjusting the location of the stop member 780 via an input to the second knob 760. The amount of back recline available is limited by which select step 782 of the stop member 780 contacts a rear edge 792 of the base structure 262 as the back assembly 18 moves from the upright towards the reclined position.

Figure 44:
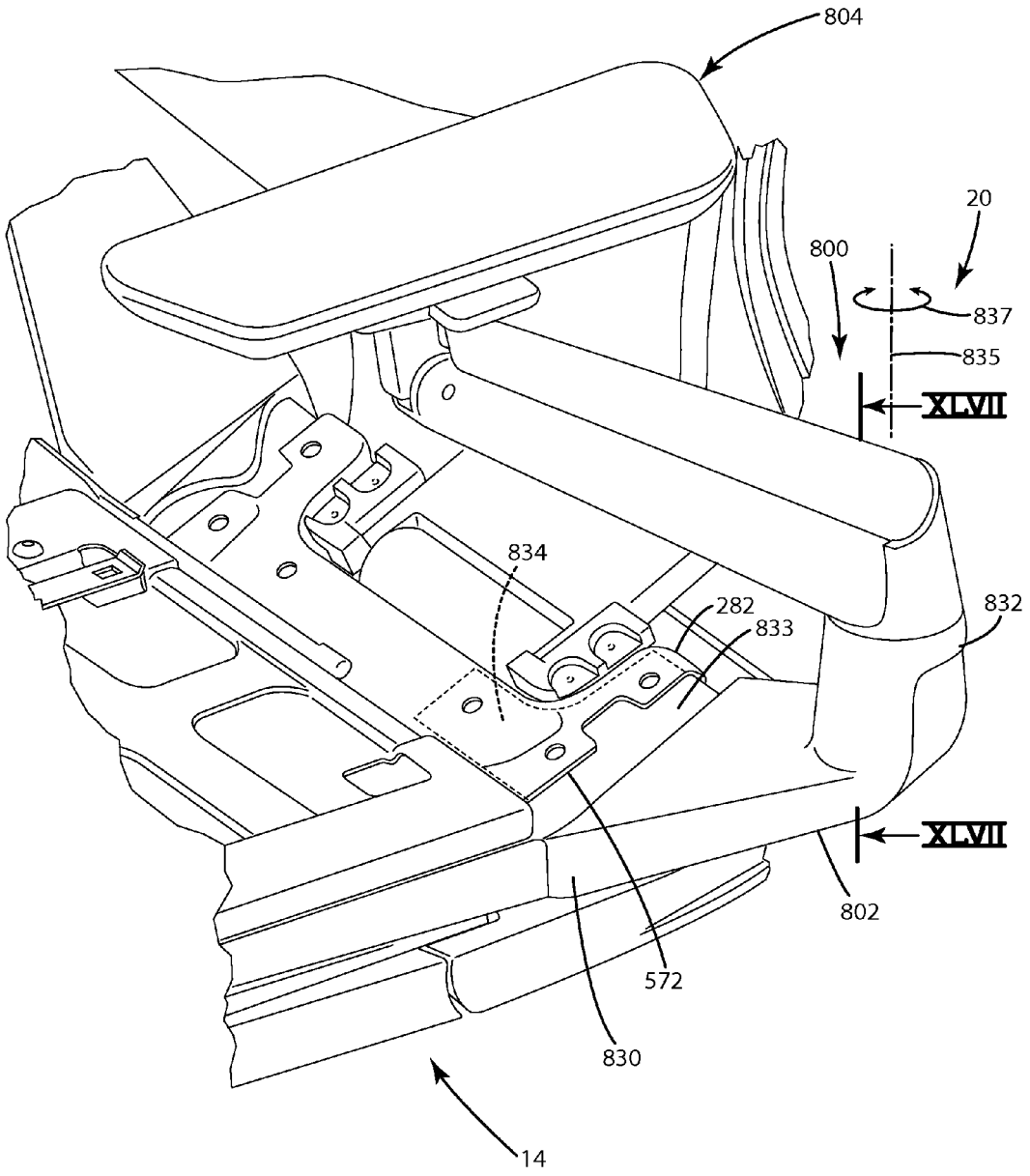
FIG. 44 is a perspective view of an arm assembly.
Figure 45:
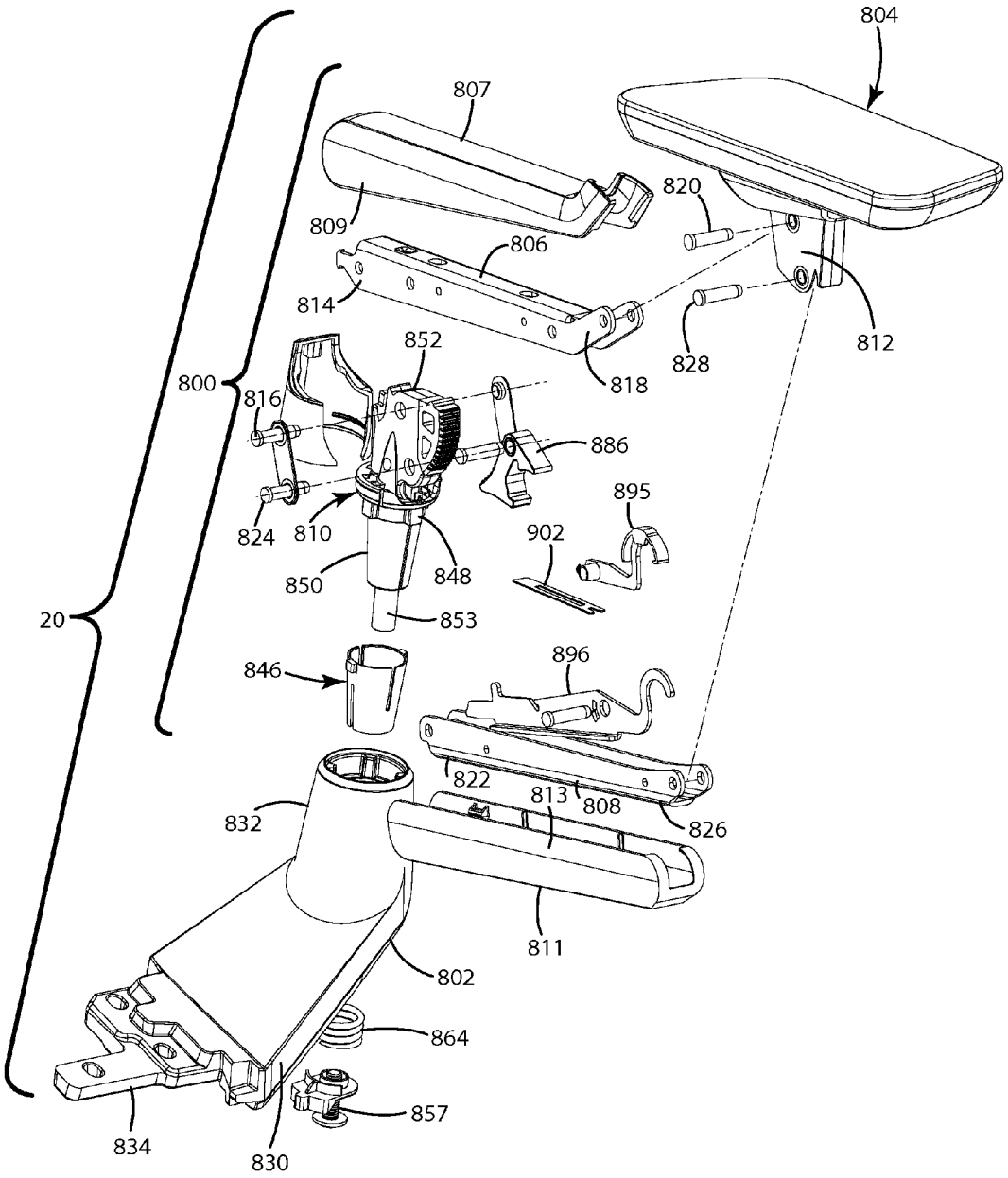
FIG. 45 is an exploded perspective view of the arm assembly.
Figure 46:
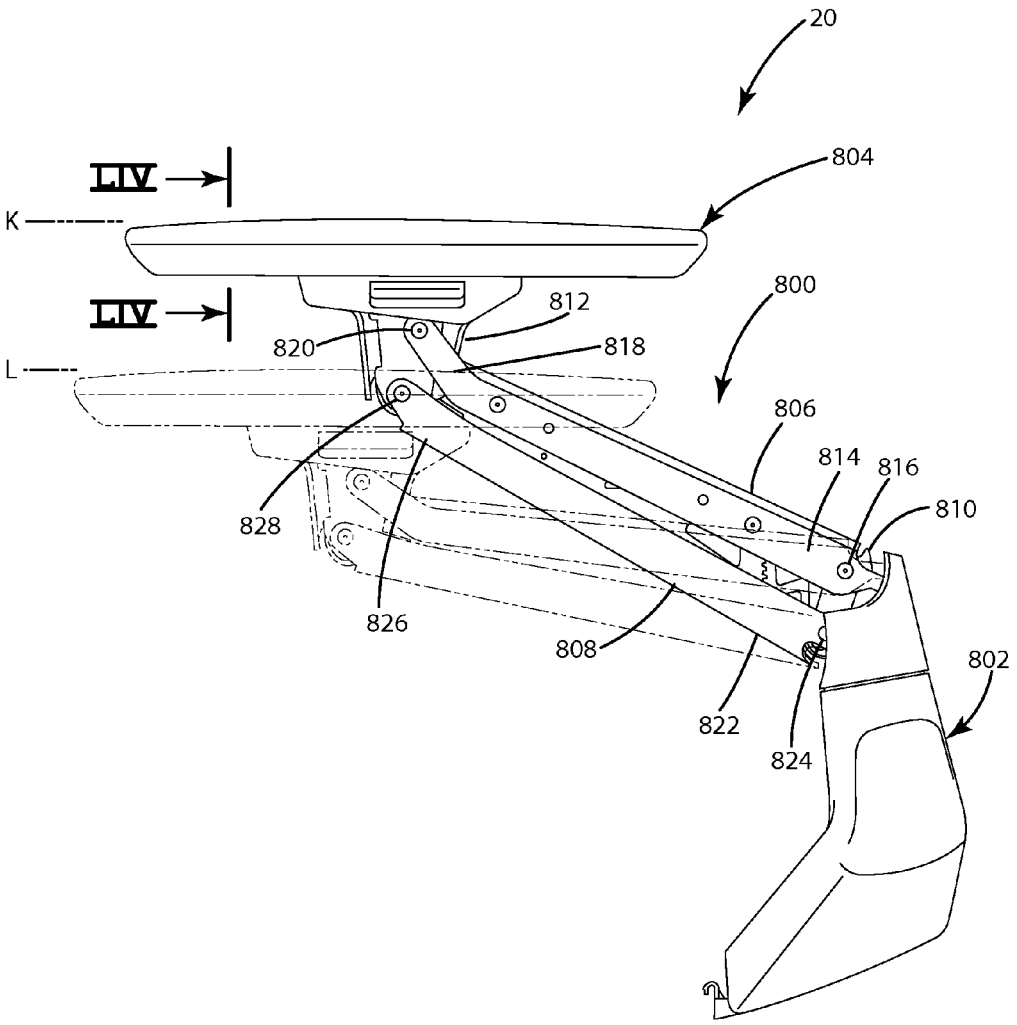
FIG. 46 is a side elevational view of the arm assembly in an elevated position and a lowered position in dashed line.

Each arm assembly 20 (FIGS. 44-46) includes an arm support assembly 800 pivotably supported from an arm base structure 802, and adjustably supporting an armrest assembly 804. The arm support assembly 800 includes a first arm member 806, a second arm 808, an arm support structure 810, and an armrest assembly support member 812 that cooperate to form a 4-bar linkage assembly. In the illustrated example, the first arm member 806 has a U-shaped cross-sectional configuration and includes a first end 814 pivotably coupled to the arm support structure 810 for pivoting about a pivot point 816, and a second end 818 pivotably coupled to the armrest assembly support member 812 for pivoting movement about a pivot point 820. The second arm member 808 has a U-shaped cross-sectional configuration and includes a first end 822 pivotably coupled to the arm support structure 810 for pivoting about a pivot point 824, and a second end 826 pivotably coupled to the armrest assembly support member 812 for pivoting about a pivot point 828. As illustrated, the 4-bar linkage assembly of the arm support assembly 800 allows the armrest assembly 804 to be adjusted between a fully raised position K and a fully lowered position L, wherein the distance between the fully raised position K and fully lowered position L is preferably at least about 4 inches. Each arm assembly further includes a first arm cover member 807 having a U-shaped cross-sectional configuration and including a first edge portion 809, and a second arm cover member 811 having a U-shaped cross-sectional configuration and including a second edge portion 813, wherein the first arm member 806 is housed within the first arm cover member 807 and the second arm member 808 is housed within the second arm cover member 811, such that the second edge portion 813 overlaps with the first edge portion 809.

Each arm base structure 802 includes a first end 830 connected to the control assembly 14, and a second end 832 pivotably supporting the arm support structure 810 for rotation of the arm assembly 20 about a vertical axis 835 in a direction 837. The first end 830 of the arm base structure 802 includes a body portion 833 and a narrowed bayonet portion 834 extending outwardly therefrom. In assembly, the body portion 833 and bayonet portion 834 of the first end 830 of the arm base structure 802 are received between the control plate 572 and the seat support structure 282, and are fastened thereto by a plurality of mechanical fasteners (not shown) that extend through the body portion 833 and bayonet portion 834 of the arm-base structure 802, the control plate 572 and the seat support structure 282. The second end 832 of the arm base structure 802 pivotably receives the arm support structure 810 therein.

Figure 47:
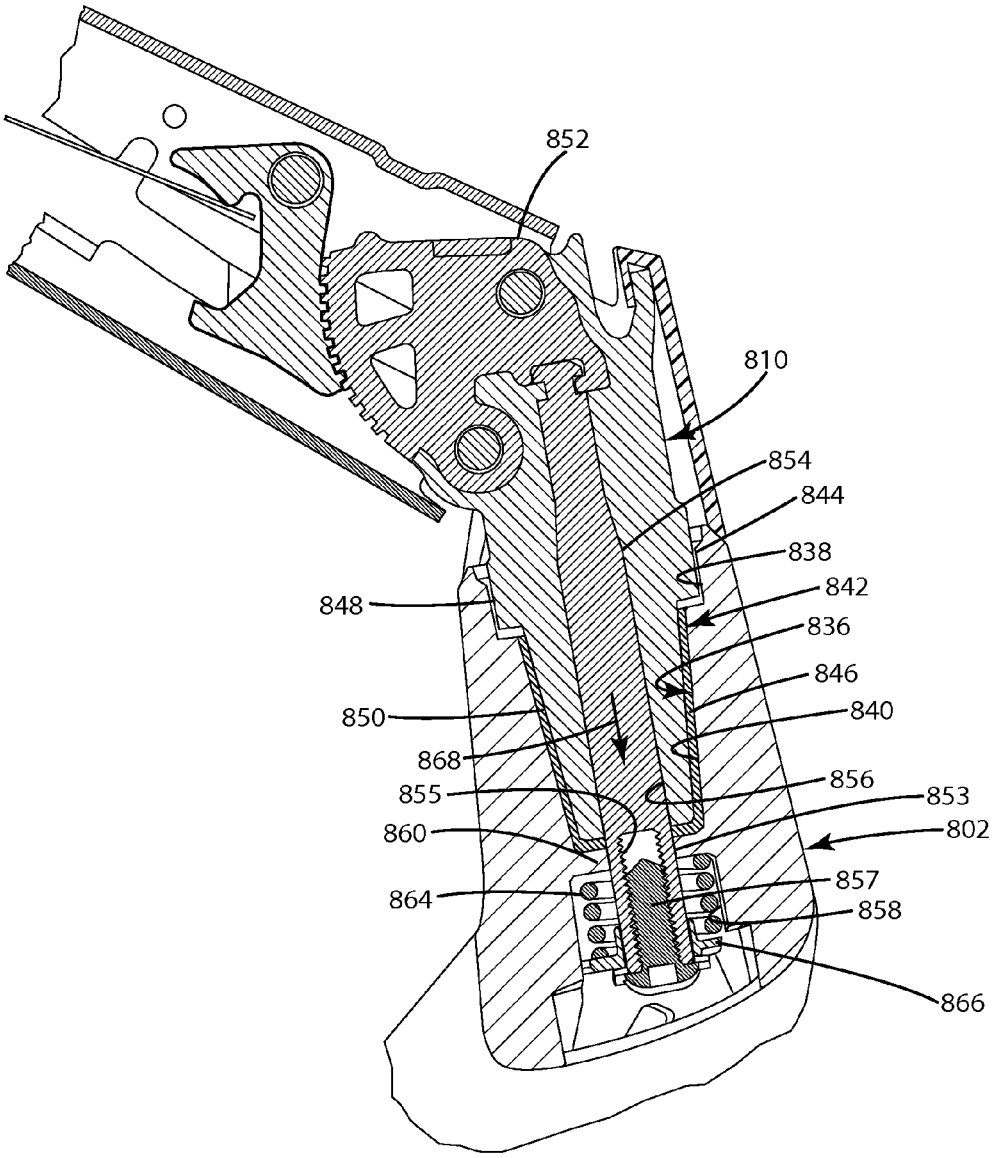
FIG. 47 is a partial cross-sectional view of the arm assembly.
Figure 48:
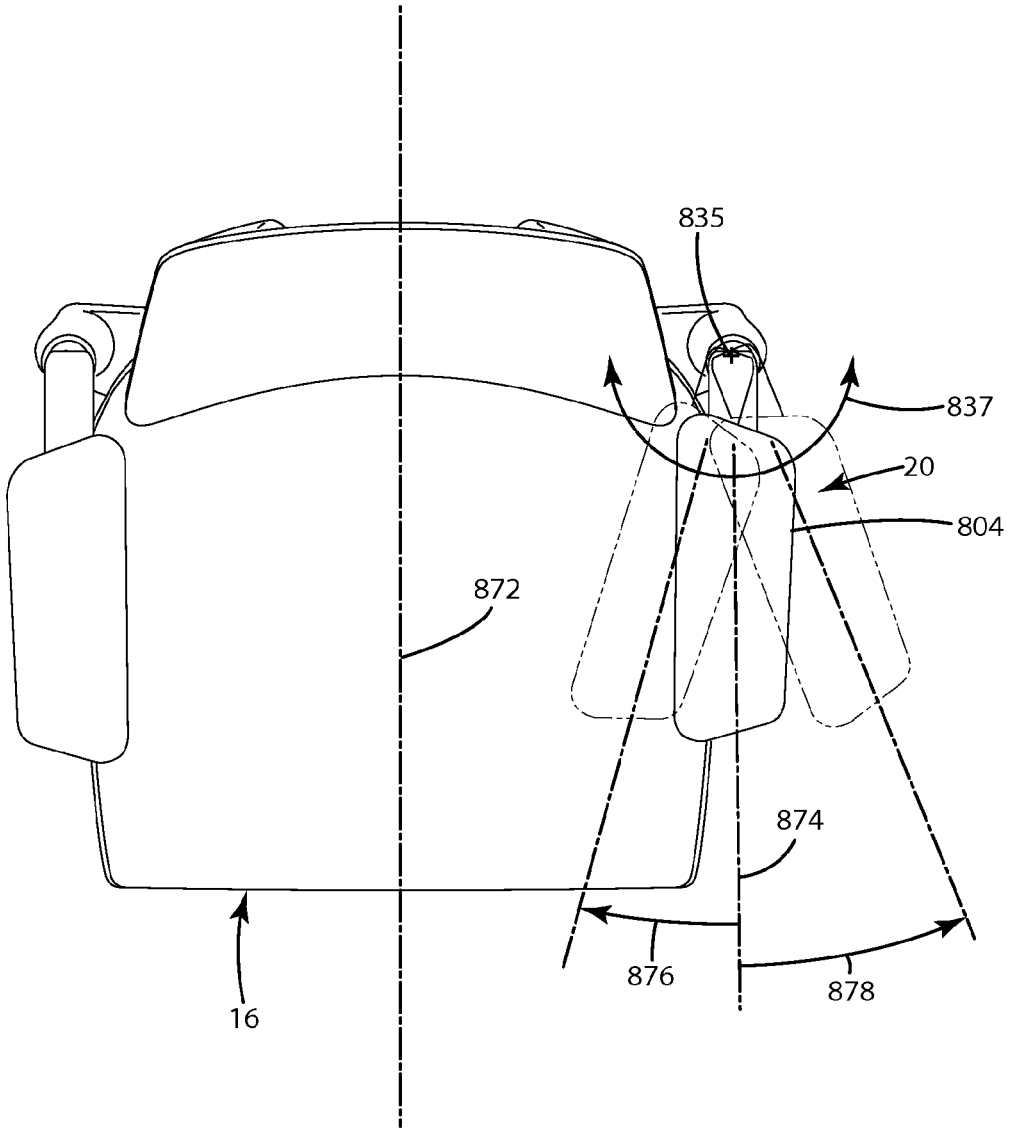
FIG. 48 is a top plan view of the chair assembly showing the arm assembly in an in-line position and in angled positions in dashed line.

As best illustrated in FIG. 47, the arm base structure 802 includes an upwardly opening bearing recess 836 having a cylindrically-shaped upper portion 838 and a conically-shaped lower portion 840. A bushing member 842 is positioned within the bearing recess 836 and is similarly configured as the lower portion 840 of the bearing recess 836, including a conically-shaped portion 846. The arm support structure 810 includes a lower end having a cylindrically-shaped upper portion 848 and a conically-shaped lower portion 850 received within the lower portion 846 of the bushing member 842. An upper end 852 of the arm support structure 810 is configured to operably engage within a vertical locking arrangement, as described below. A pin member 854 is positioned within a centrally located and axially extending bore 856 of the arm support structure 810. In the illustrated example, the pin member 854 is formed from steel, while the upper end 852 of the arm support structure 810 comprises a powdered metal that is formed about a proximal end of the pin member 854, and wherein the combination of the upper end 852 and the pin member 854 is encased within an outer aluminum coating. A distal end 853 of the pin member 854 includes an axially extending threaded bore 855 that threadably receives an adjustment screw 857 therein. The arm base structure 802 includes a cylindrically-shaped second recess 858 separated from the bearing recess 836 by a wall 860. A coil spring 864 is positioned about the distal end 853 of the pin member 854 within the second recess 858, and is trapped between the wall 860 of the arm base structure 802 and a washer member 866, such that the coil spring 864 exerts a downward force in the direction of arrow 868 on the pin member 854, thereby drawing the lower end of the arm support structure 810 into close frictional engagement with the bushing member 842 and drawing the bushing member 842 into close frictional engagement with the bearing recess 836 of the arm base structure 802. The adjustment screw 857 may be adjusted so as to adjust the amount of frictional interference between the arm support structure 810, the bushing member 842 and the arm base structure 802 and increasing the force required to be exerted by the user to move the arm assembly 20 about the pivot access 835 in pivot direction 837. The pivot connection between the arm support structure 810 and the arm base structure 802 allows the overall arm assembly 800 to be pivoted inwardly in a direction 876 (FIG. 48) from a line 874 extending through pivot access 835 and extending parallel with a center line axis 872 of the seat assembly 16, and outwardly from the line 874 in a direction 878. Preferably, the arm assembly 20 pivots greater than or equal to about 17° in the direction 876 from the line 874, and greater than or equal to about 22° in the direction 878 from the line 874.

Figure 49:
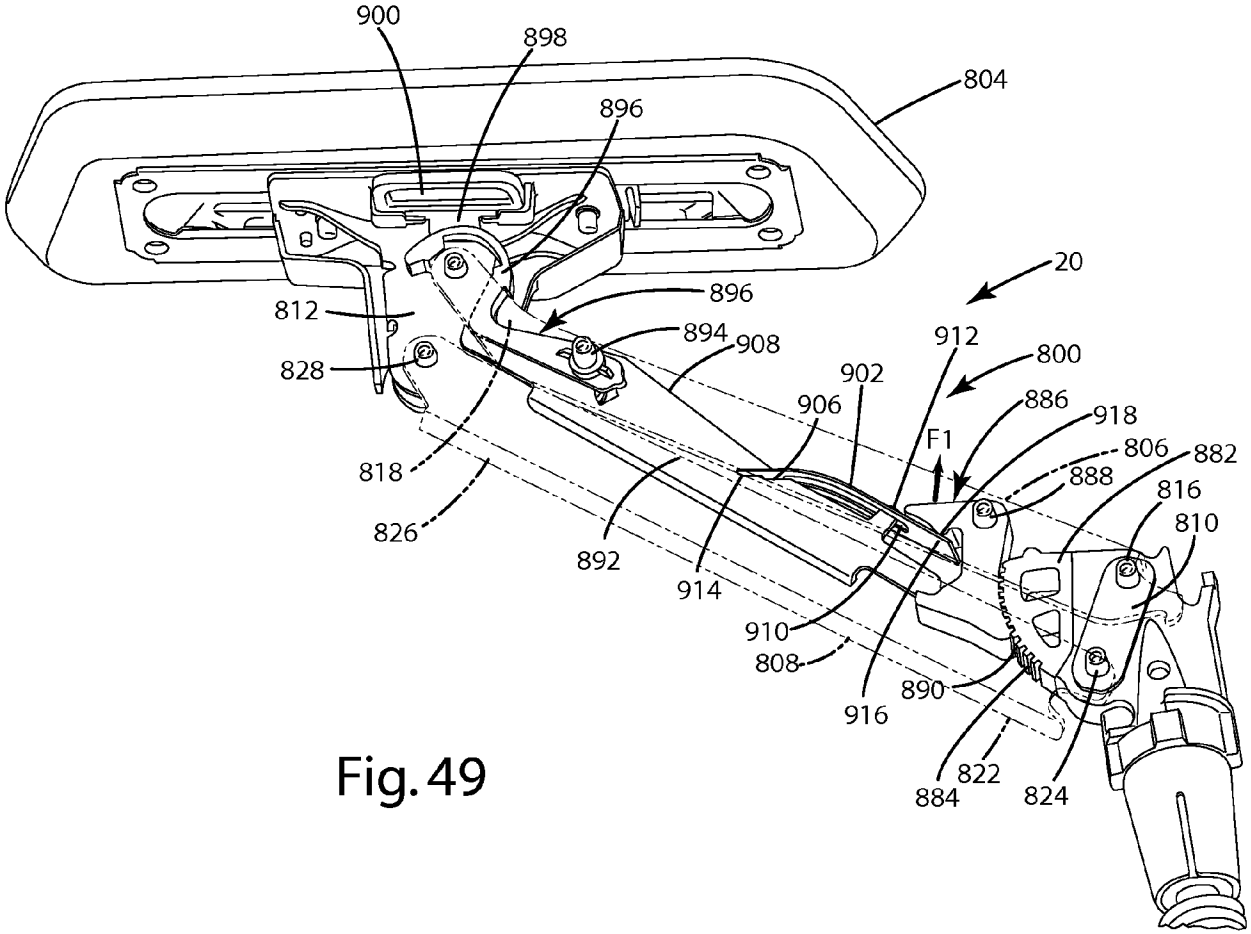
FIG. 49 is an isometric view of an arm assembly including a vertical height adjustment lock.
Figure 50:
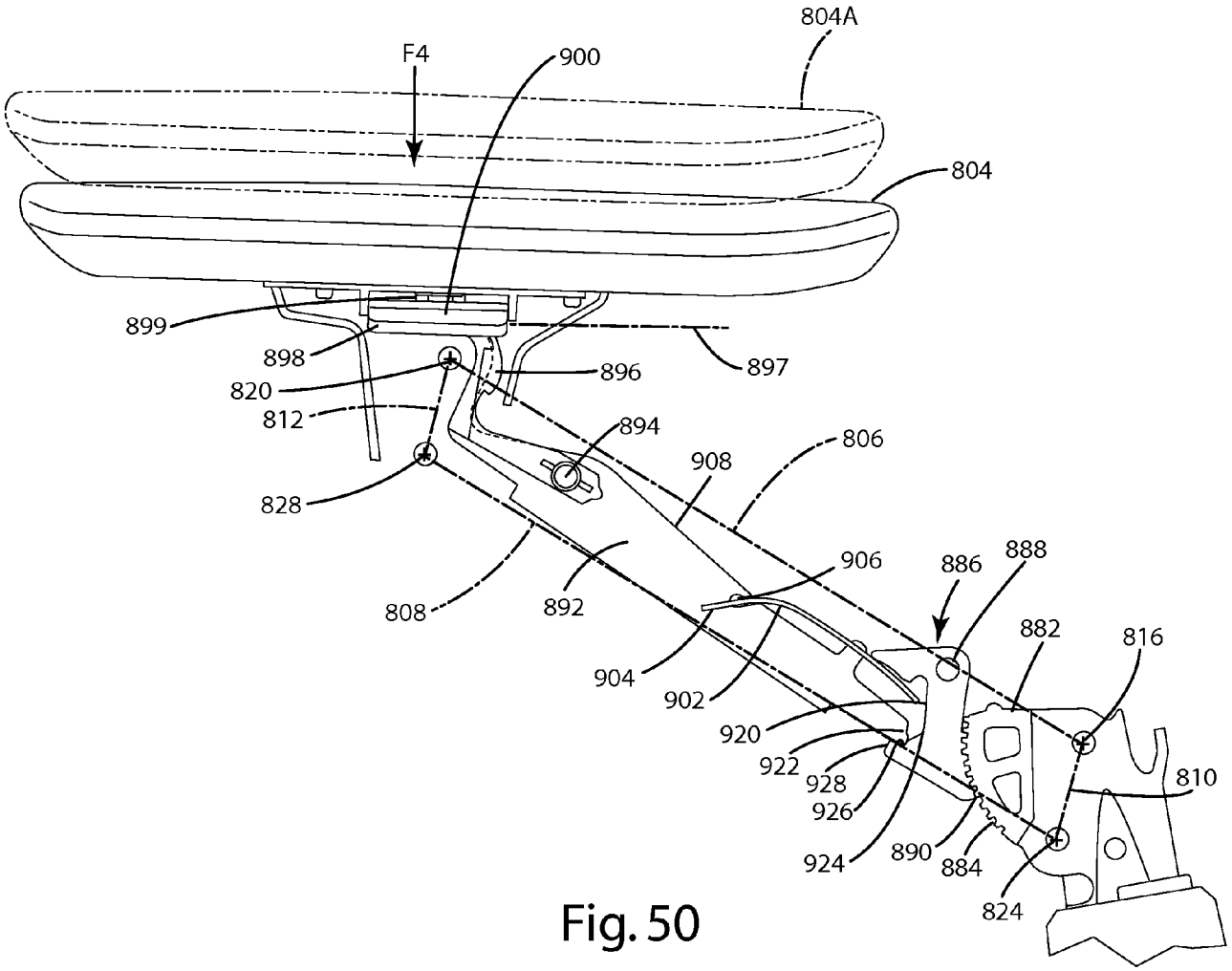
FIG. 50 is an isometric view of an arm assembly including a vertical height adjustment lock.
Figure 51:
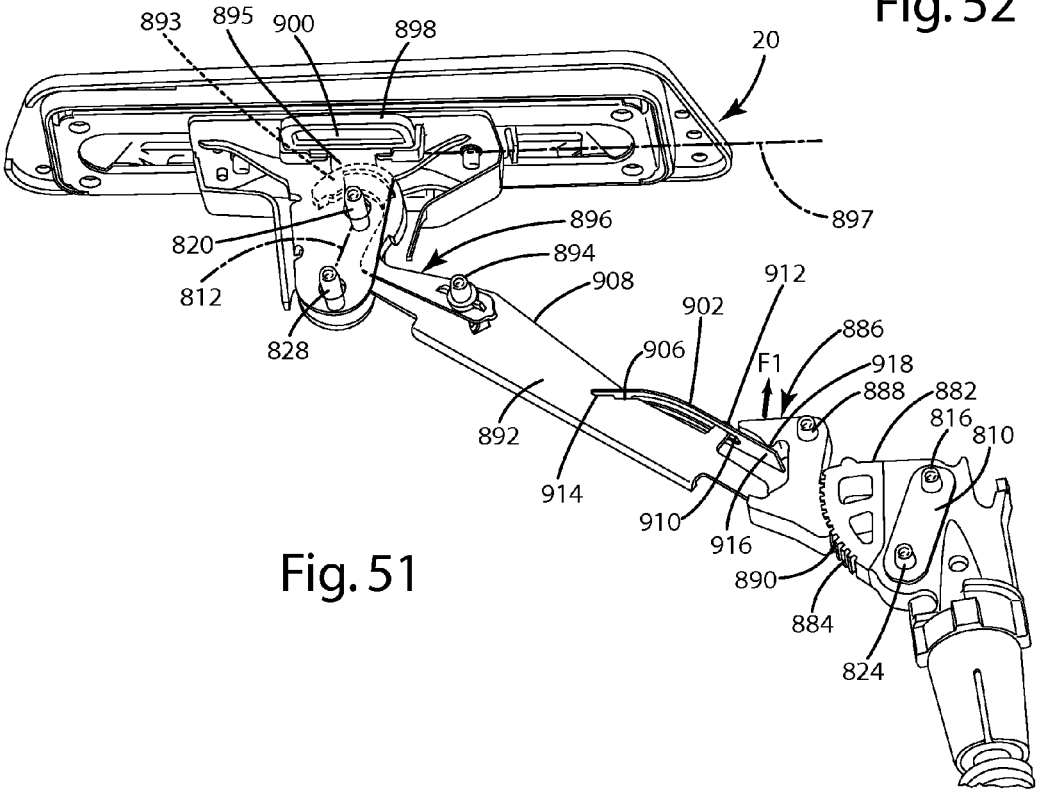
FIG. 51 is an isometric view of an arm assembly including a vertical height adjustment lock.

With further reference to FIGS. 49-51, vertical height adjustment of the arm rest is accomplished by rotating the 4-bar linkage formed by first arm member 806, second arm member 808, arm support structure 810 and arm rest assembly support member 812. A gear member 882 includes a plurality of teeth 884 that are arranged in an arc about pivot point 816. A lock member 886 is pivotably mounted to arm 806 at pivot 888, and includes a plurality of teeth 890 that selectively engage teeth 884 of gear member 882. When teeth 884 and 890 are engaged, the height of the arm rest 804 is fixed due to the rigid triangle formed between pivot points 816, 824 and 888. If a downward force F4 is applied to the armrest, a counter clockwise (FIG. 50) moment is generated on lock member 886. This moment pushes teeth 890 into engagement with teeth 884, thereby securely locking the height of the armrest.

An elongated lock member 892 is rotatably mounted to arm 806 at pivot 894. A low friction polymer bearing member 896 is disposed over upper curved portion 893 of elongated lock member 892. As discussed in more detail below, a manual release lever or member 898 includes a pad 900 that can be shifted upwardly by a user to selectively release teeth 890 of lock member 886 from teeth 884 of gear member 882 to permit vertical height adjustment of the armrest.

A leaf spring 902 includes a first end 904 that engages a notch 906 formed in upper edge 908 of elongated locking member 892. Thus, leaf spring 902 is cantilevered to locking member 892 at notch 906. An upwardly-extending tab 912 of elongated locking member 892 is received in an elongated slot 910 of leaf spring 902 to thereby locate spring 902 relative to locking member 892. The end 916 of leaf spring 902 bears upwardly (F1) on knob 918 of locking member 886, thereby generating a moment tending to rotate locking member 886 in a clockwise (released) direction (FIG. 51) about pivot 888. Leaf spring 902 also generates a clockwise moment on elongated locking member 892 at notch 906, and also generates a moment on locking member 886 tending to rotate locking member 886 about pivot 888 in a clockwise (released) direction. This moment tends to disengage gears 890 from gears 884. If gears 890 are disengaged from gears 884, the height of the arm rest assembly can be adjusted.

Locking member 886 includes a recess or cut-out 920 (FIG. 50) that receives pointed end 922 of elongated locking member 892. Recess 920 includes a first shallow V-shaped portion having a vertex 924. The recess also includes a small recess or notch 926, and a transverse, upwardly facing surface 928 immediately adjacent notch 926.

As discussed above, the leaf spring 902 generates a moment acting on locking member 886 tending to disengage gears 890 from gears 884. However, when the tip or end 922 of elongated locking member 892 is engaged with the notch 926 of recess 920 of locking member 886, this engagement prevents rotational motion of locking member 886 in a clockwise (released) direction, thereby locking gears 890 and 884 into engagement with one another and preventing height adjustment of the armrest.

To release the arm assembly for height adjustment of the armrest, a user pulls upwardly on pad 900 against a small leaf spring 899 (FIG. 50). The release member 898 rotates about an axis 897 that extends in a fore-aft direction, and an inner end of manual release lever 898 pushes downwardly against bearing member 896/upper curved portion 893 (FIG. 51) of elongated locking member 892. This generates a downward force causing elongated locking member 892 to rotate about pivot 894. This shifts end 922 (FIG. 50) of elongated locking member 892 upwardly so it is adjacent to the shallow vertex 924 of recess 920 of locking member 886. This shifting of locking member 892 releases locking member 886, such that locking member 886 rotates in a clockwise (release) direction due to the bias of leaf spring 902. This rotation causes gears 890 to disengage from gears 884 to permit height adjustment of the arm rest assembly.

The arm rest assembly is also configured to prevent disengagement of the height adjustment member while a downward force F4 (FIG. 50) is being applied to the arm rest pad 804. Specifically, due to the 4-bar linkage formed by arm members 806, 808, arm support structure 810, and arm rest assembly support member 812, downward force F4 will tend to cause pivot point 820 to move towards pivot point 824. However, the elongated locking member 892 is generally disposed in a line between the pivots 820 and 824, thereby preventing downward rotation of the 4-bar linkage. As noted above, downward force F4 causes teeth 890 to tightly engage teeth 884, securely locking the height of the armrest. If release lever 898 is actuated while downward force F4 is being applied to the armrest, the locking member 892 will move, and end 922 of elongated locking member 892 will disengage from notch 926 of recess 920 of locking member 886. However, the moment on locking member 886 causes teeth 890 and 884 to remain engaged even if locking member 892 shifts to a release position. Thus, the configuration of the 4-bar linkage and locking member 886 and gear member 882 provides a mechanism whereby the height adjustment of the arm rest cannot be performed if a downward force F4 is acting on the arm rest.

Figure 52:
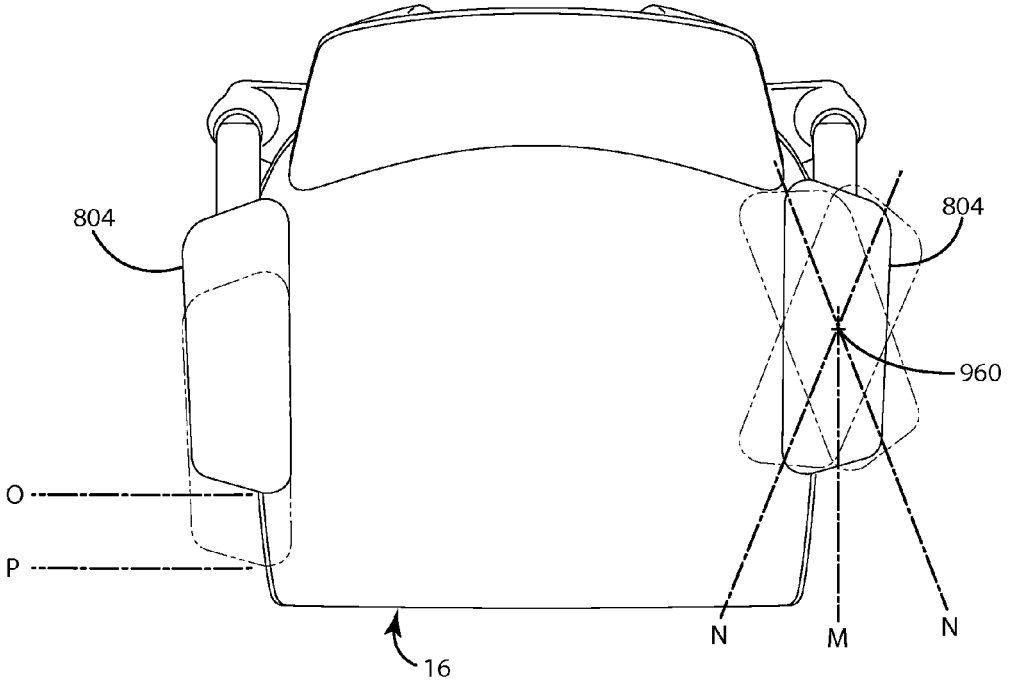
FIG. 52 is a top plan view of the chair assembly showing an arm rest assembly in an in-line position and rotated positions in dashed line, and in a retracted position and an extended position in dashed line.
Figure 53:
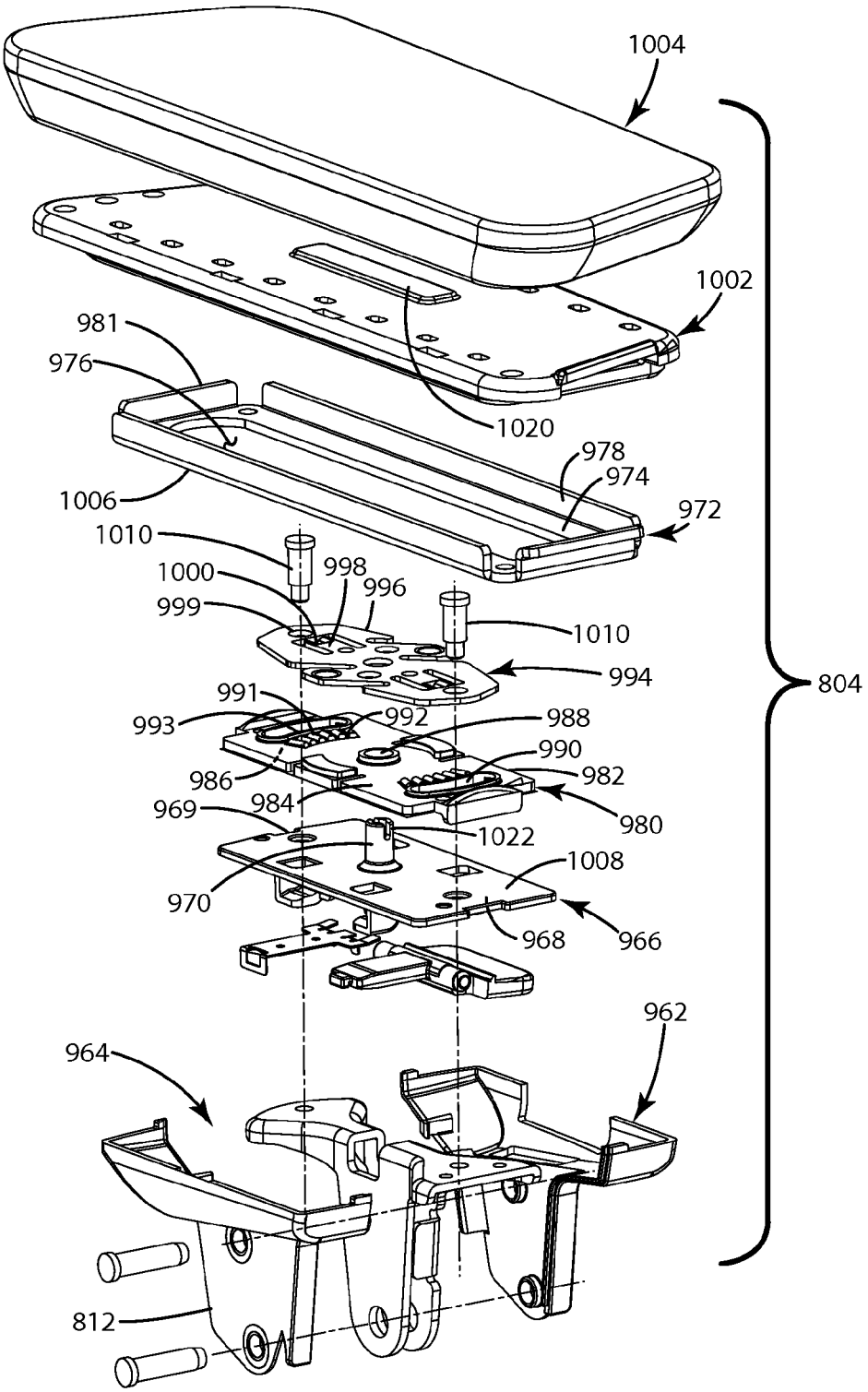
FIG. 53 is an exploded view of the arm rest assembly.
Figure 54:
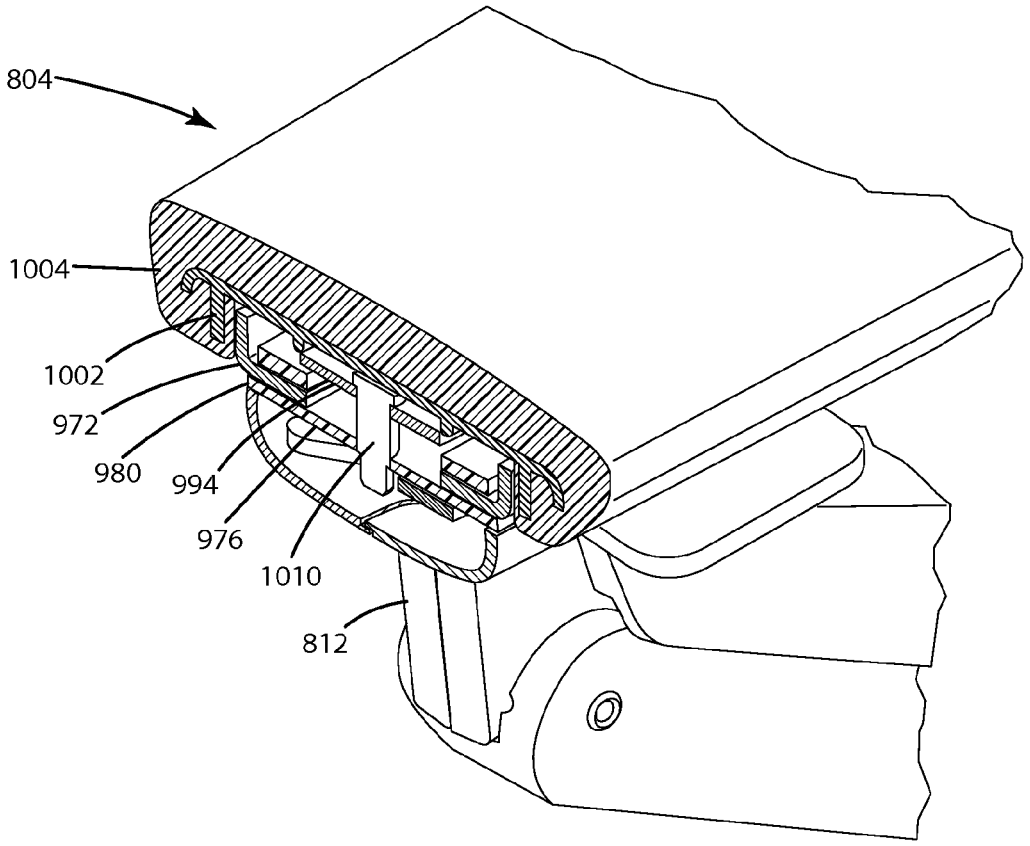
FIG. 54 is a cross-sectional view of the arm rest assembly.

As best illustrated in FIGS. 52 and 53, each arm rest assembly 804 is adjustably supported from the associated arm support assembly 800 such that the arm rest assembly 804 may be pivoted inwardly and outwardly about a pivot point 960 between an in-line position M and pivoted positions N. Each arm rest assembly is also linearly adjustable with respect to the associated arm support assembly 800 between a retracted position O and an extended position P. Each arm rest assembly 804 (FIG. 53) includes an armrest housing assembly 962 integral with the arm rest assembly support member 812 and defining an interior space 964. The arm rest assembly 804 also includes a support plate 966 having a planar body portion 968 and having a pair of mechanical fastener receiving apertures 969, and an upwardly extending pivot boss 970. A rectangularly-shaped slider housing 972 includes a planar portion 974 having an oval-shaped aperture 976 extending therethrough, a pair of side walls 978 extending longitudinally along and perpendicularly from the planar portion 974, and a pair of end walls 981 extending laterally across the ends of and perpendicularly from the planar portion 974. The arm rest assembly 804 further includes rotational and linear adjustment member 980 having a planar body portion defining an upper surface 984 and a lower surface 986. A centrally located aperture 988 extends through the body portion 982 and pivotally receives the pivot boss 970 therein. The rotational and linear adjustment member 980 further includes a pair of arcuately-shaped apertures 990 located at opposite ends thereof and a pair of laterally spaced and arcuately arranged sets of ribs 991 extending upwardly from the upper surface 984 and defining a plurality of detents 993 therebetween. A rotational selection member 994 includes a planar body portion 996 and a pair of flexibly resilient fingers 998 centrally located therein and each including a downwardly extending engagement portion 1000. Each arm rest assembly 804 further includes an arm pad substrate 1002 and an arm pad member 1004 over-molded onto the substrate 1002.

In assembly, the support plate 966 is positioned over the arm rest housing assembly 962, the slider housing 972 above the support plate 966 such that a bottom surface 1006 of the planar portion 974 frictionally abuts a top surface 1008 of the support plate 966, the rotational and linear adjustment member 980 between the side walls 978 and end walls 980 of the slider housing 972 such that the bottom surface 986 of the rotational and linear adjustment member frictionally engages the planar portion 974 of the slider housing 972, and the rotational selection member 994 above the rotational and linear adjustment member 980. A pair of mechanical fasteners such as rivets 1010 extend through the apertures 999 of the rotational selection member 994, the arcuately-shaped apertures 990 of the rotational and linear adjustment member 980, and the apertures 969 of the support plate 966, and are threadably secured to the arm rest housing assembly 962, thereby securing the support plate 966, and the rotational and linear adjustment member 980 and the rotational selection member 994 against linear movement with respect to the arm rest housing 962. The substrate 1002 and the arm pad member 1004 are then secured to the slider housing 972. The above-described arrangement allows the slider housing 972, the substrate 1002 and the arm pad member 1004 to slide in a linear direction such that the arm rest assembly 804 may be adjusted between the protracted position O and the extended position P. The rivets 1010 may be adjusted so as to adjust the clamping force exerted on the slider housing 972 by the support plate 966 and the rotational and linear adjustment member 980. The substrate 1002 includes a centrally-located, upwardly extending raised portion 1020 and a corresponding downwardly disposed recess having a pair of longitudinally-extending side walls (not shown). Each side wall includes a plurality of ribs and detents similar to the ribs 991 and the detents 993 previously described. In operation, the pivot boss 970 engages the detents of the recess as the arm pad 1004 is moved in the linear direction, thereby providing a haptic feedback to the user. In the illustrated example, the pivot boss 970 includes a slot 1022 that allows the end of the pivot boss 970 to elastically deform as the pivot boss 970 engages the detents, thereby reducing wear thereto. The arcuately-shaped apertures 990 of the rotational and linear adjustment member 980 allows the adjustment member 980 to pivot about the pivot boss 970 of the support plate 966, and the arm rest assembly 804 to be adjusted between the in-line position M and the angled positions N. In operation, the engagement portion 1000 of each finger 998 of the rotational selection member selectively engages the detents 992 defined between the ribs 991, thereby allowing the user to position the arm rest assembly 804 in a selected rotational position and providing haptic feedback to the user as the arm rest assembly 804 is rotationally adjusted.

Figure 55:
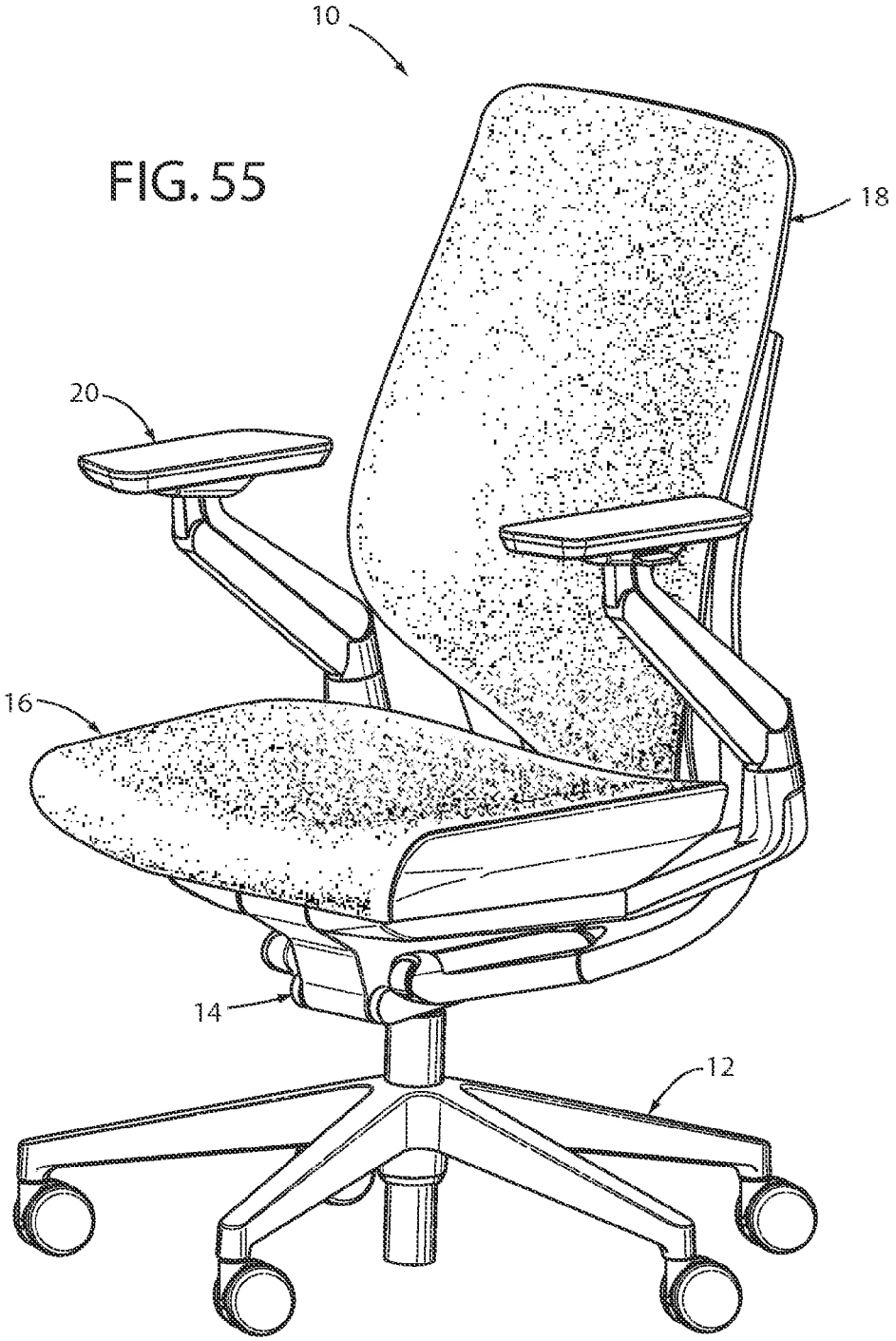
FIG. 55 is a perspective view of the chair assembly.
Figure 56:
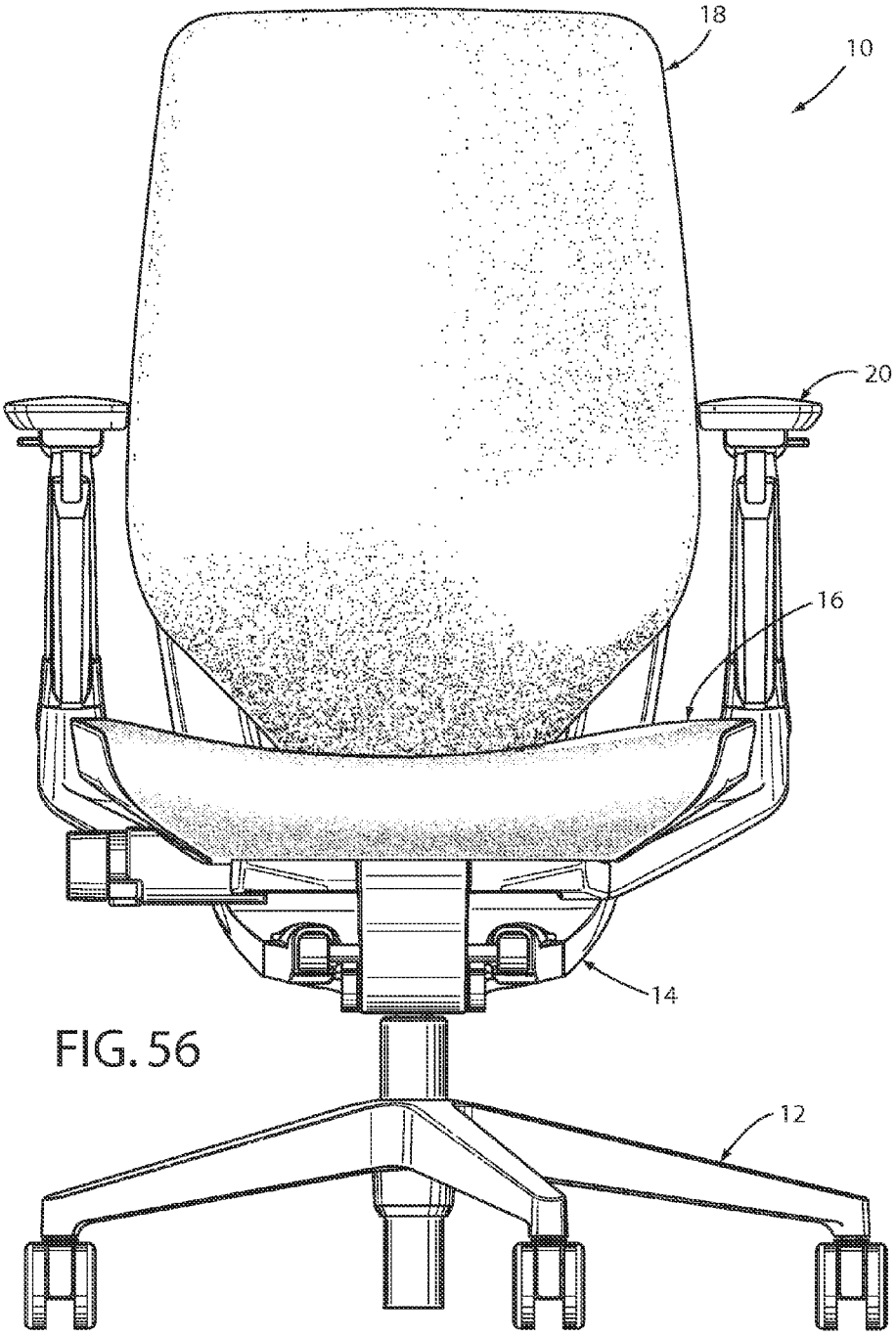
FIG. 56 is a front elevational view of the chair assembly.
Figure 57:
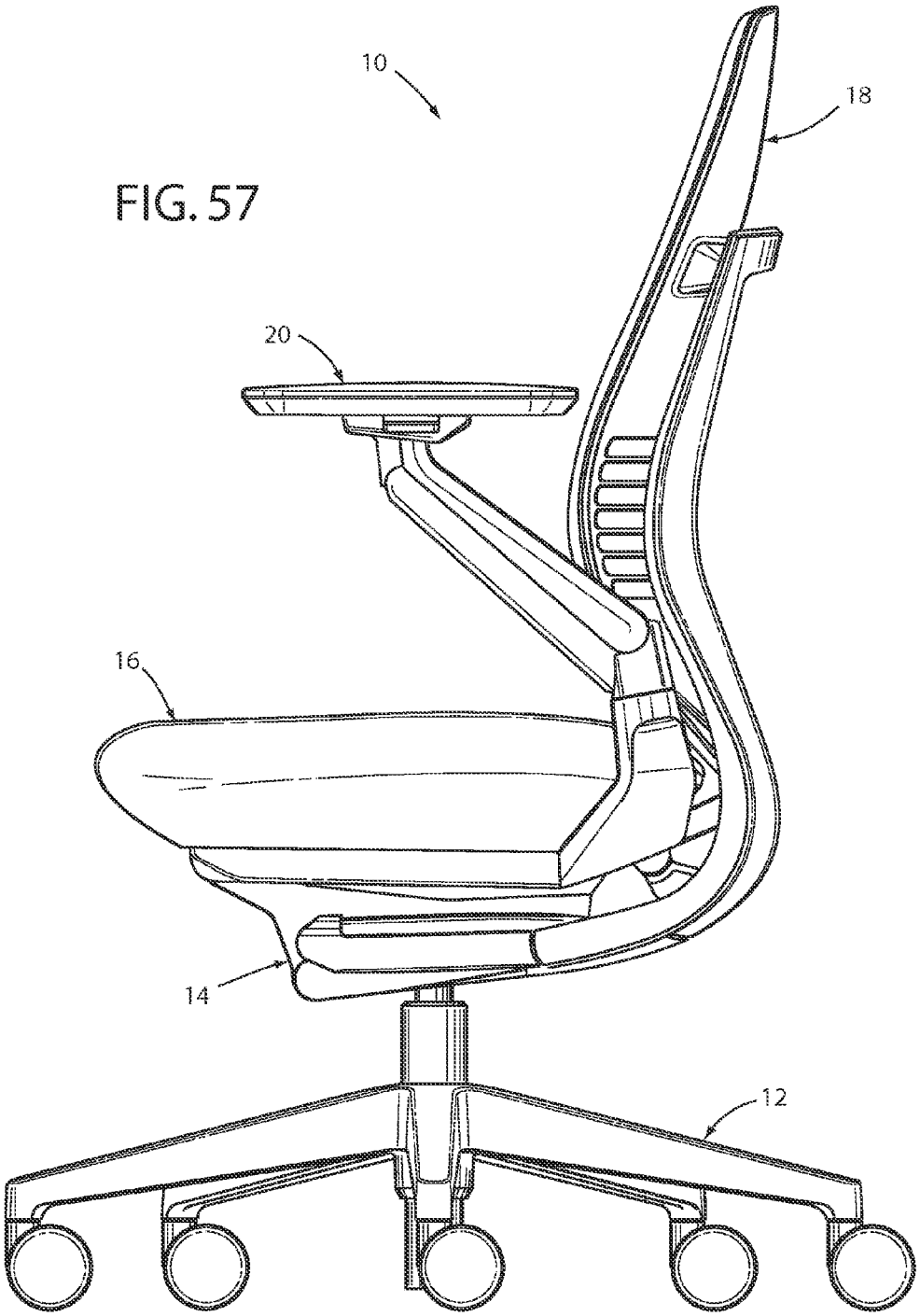
FIG. 57 is a first side elevational view of the chair assembly.
Figure 58:
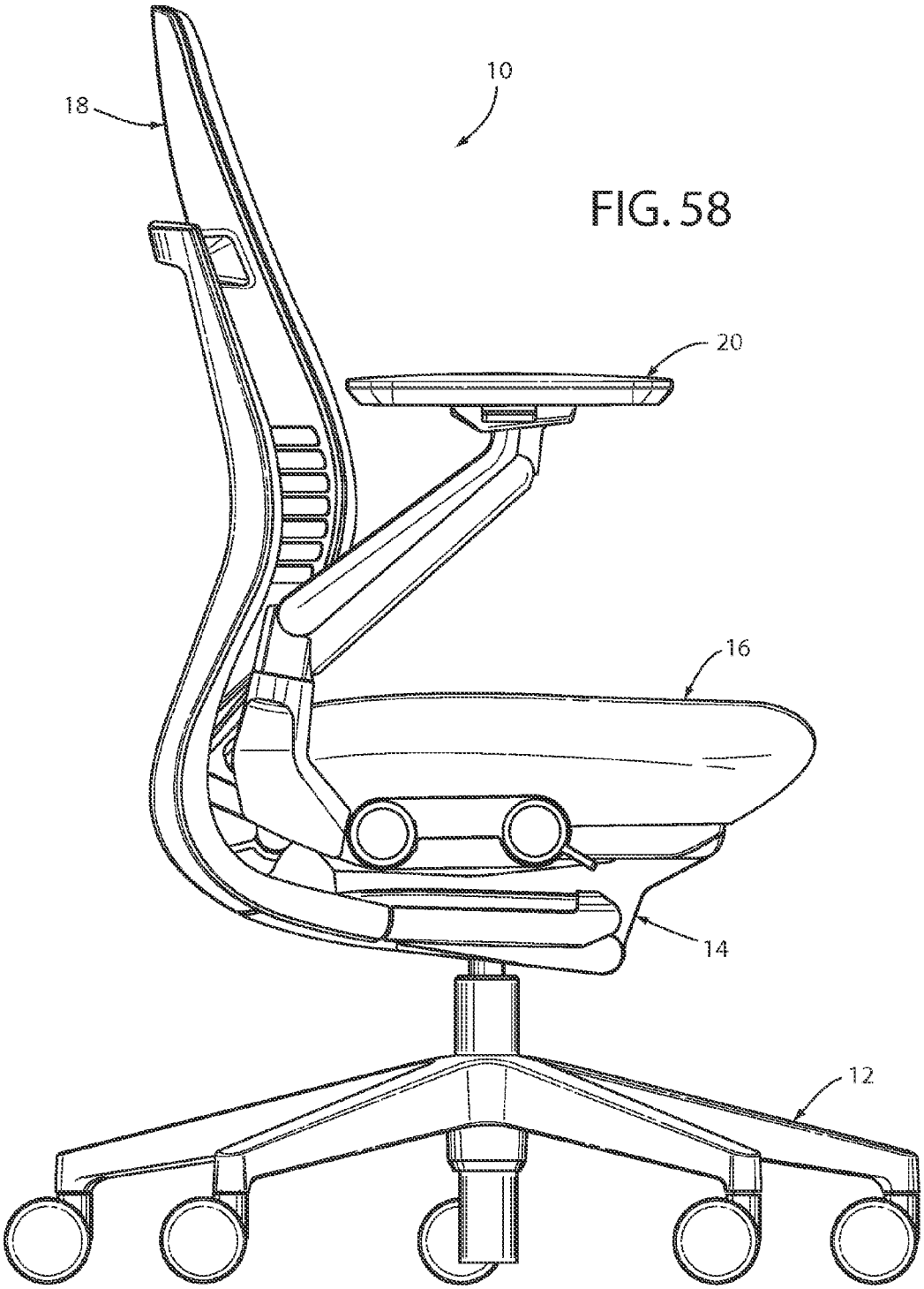
FIG. 58 is a second side elevational view of the chair assembly.
Figure 59:
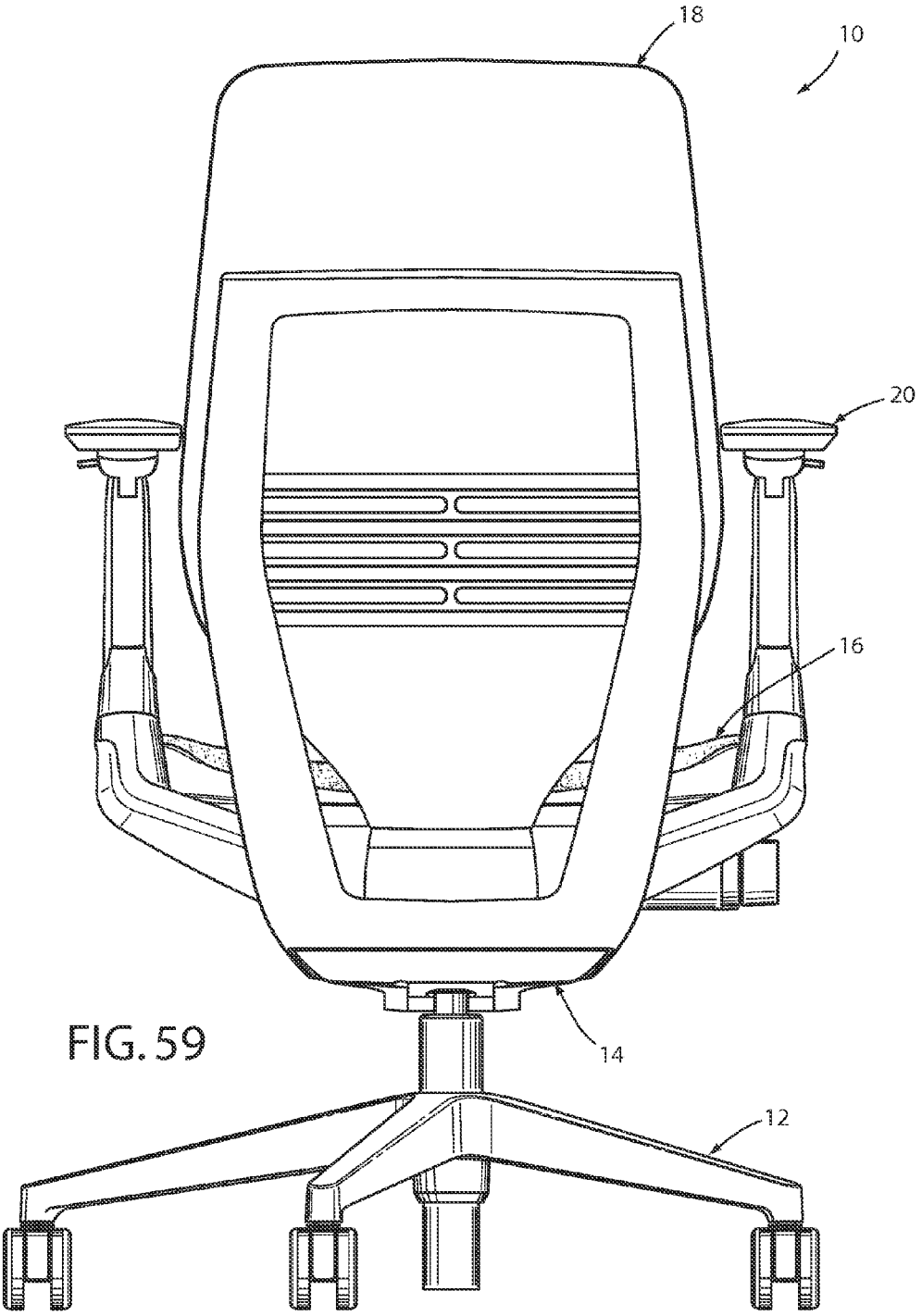
FIG. 59 is a rear elevational view of the chair assembly.
Figure 60:
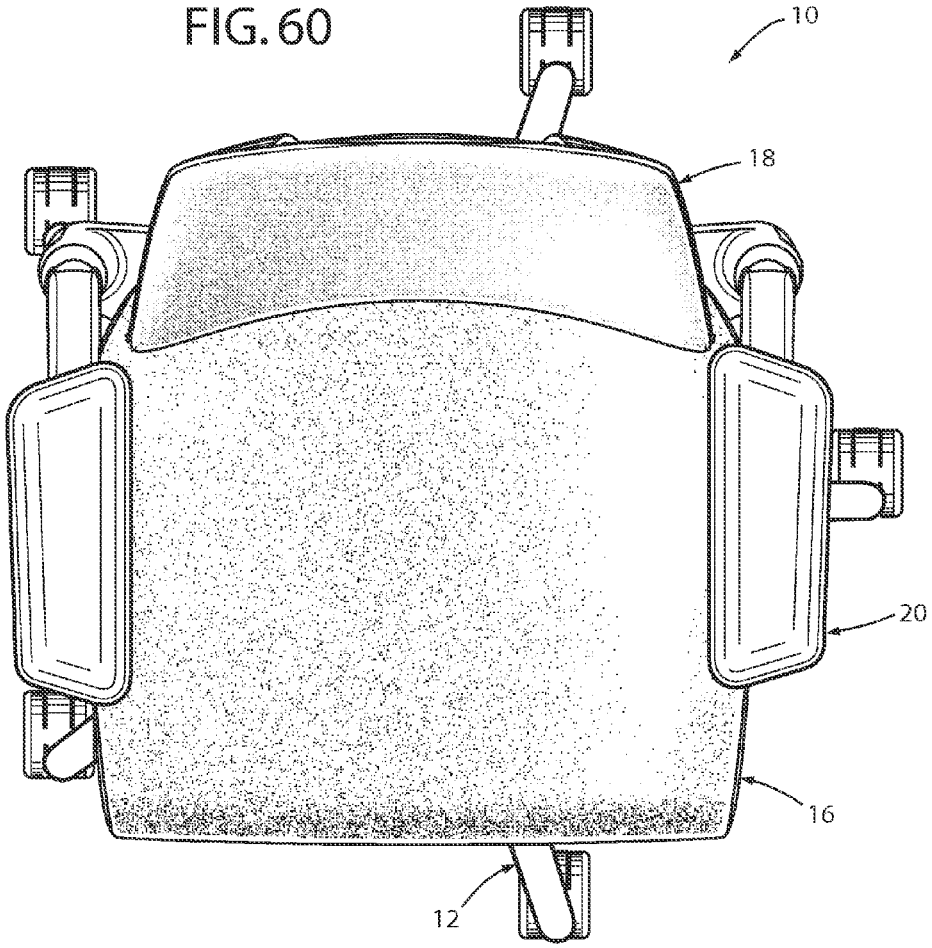
FIG. 60 is a top plan view of the chair assembly.
Figure 61:
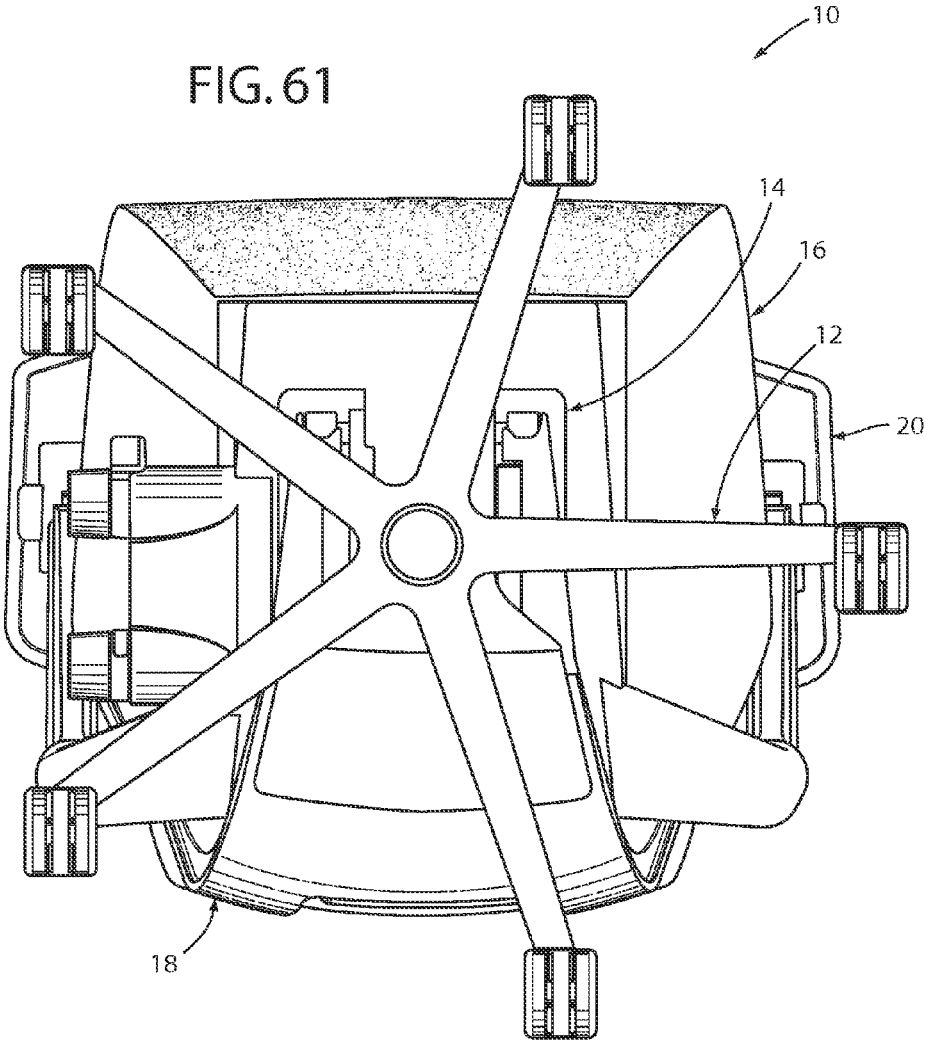
FIG. 61 is a bottom plan view of the chair assembly.
Figure 62:
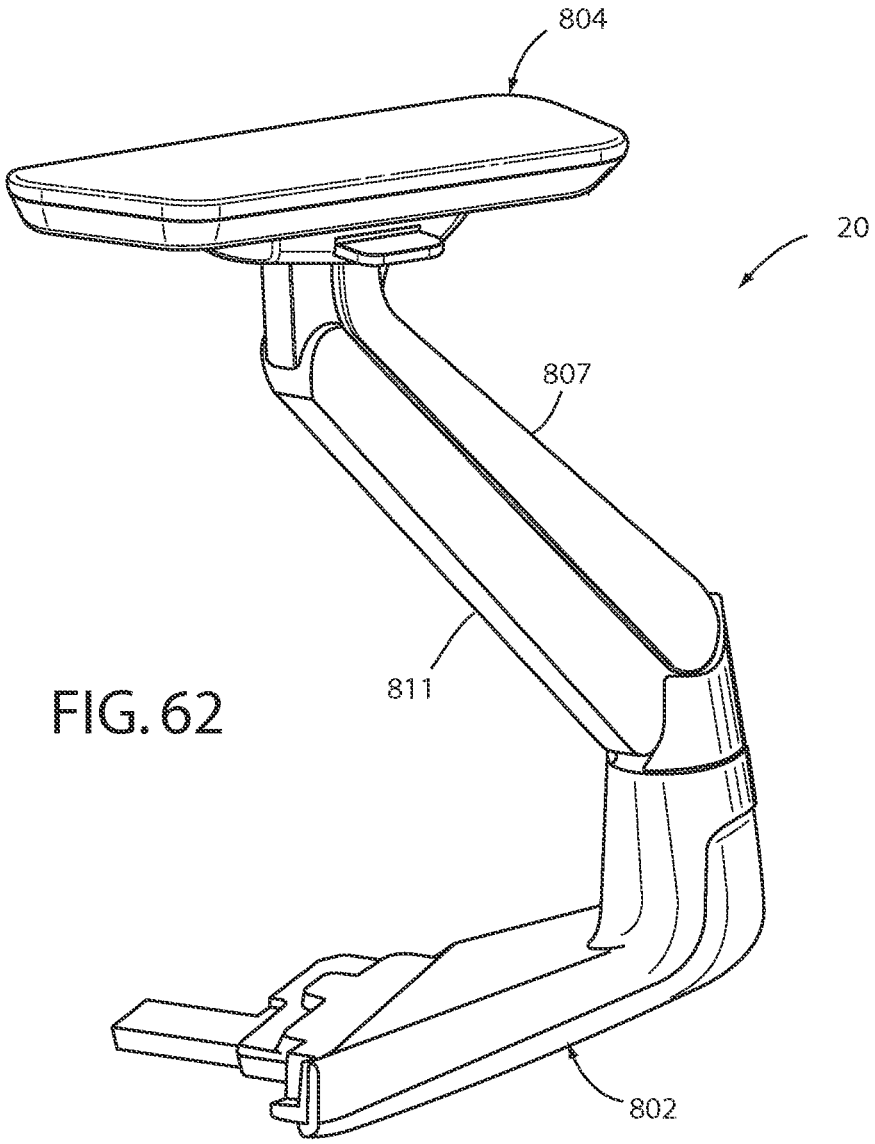
FIG. 62 is a perspective view of the arm assembly.
Figure 63:
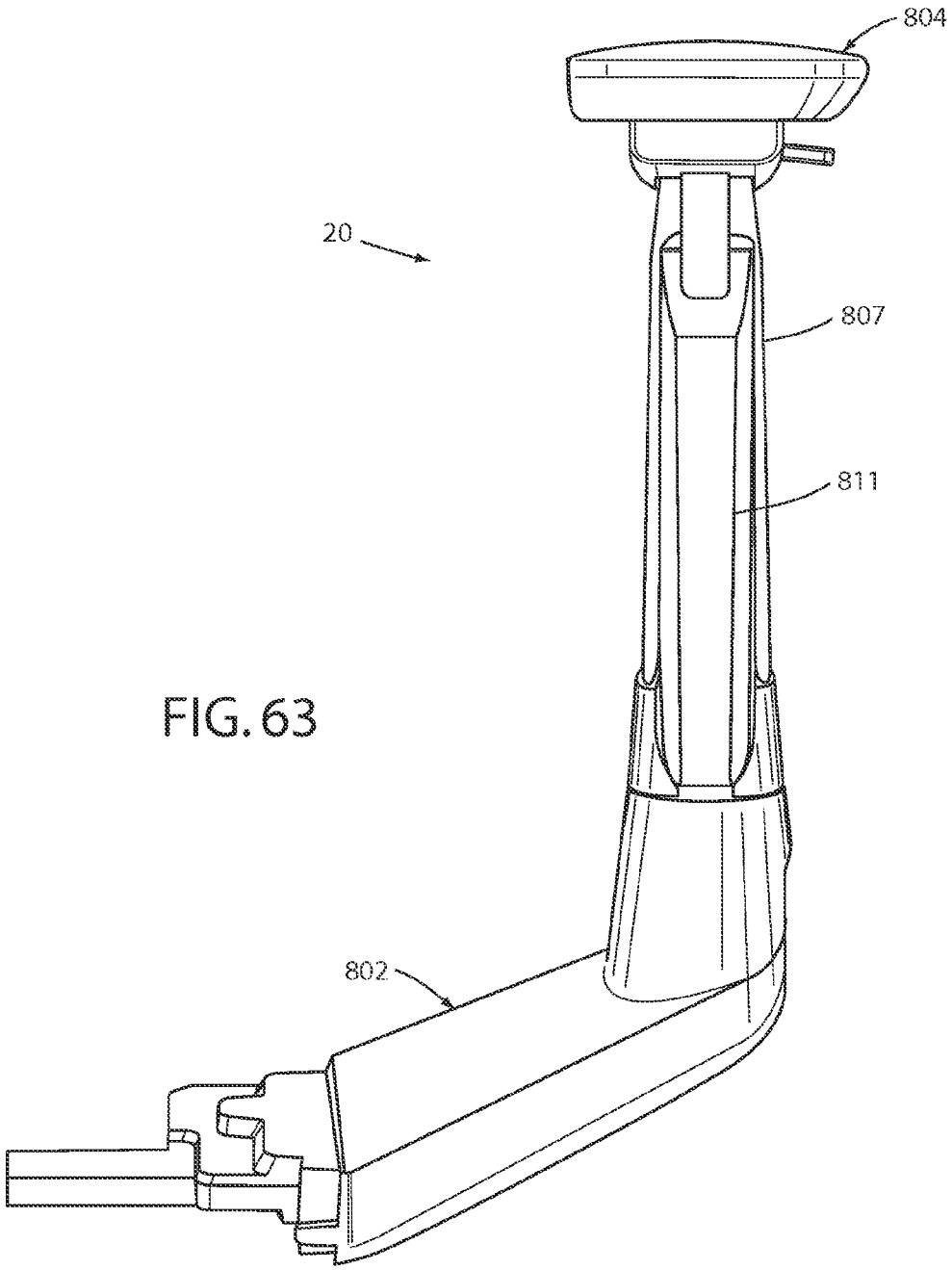
FIG. 63 is a front elevational view of the arm assembly.
Figure 64:
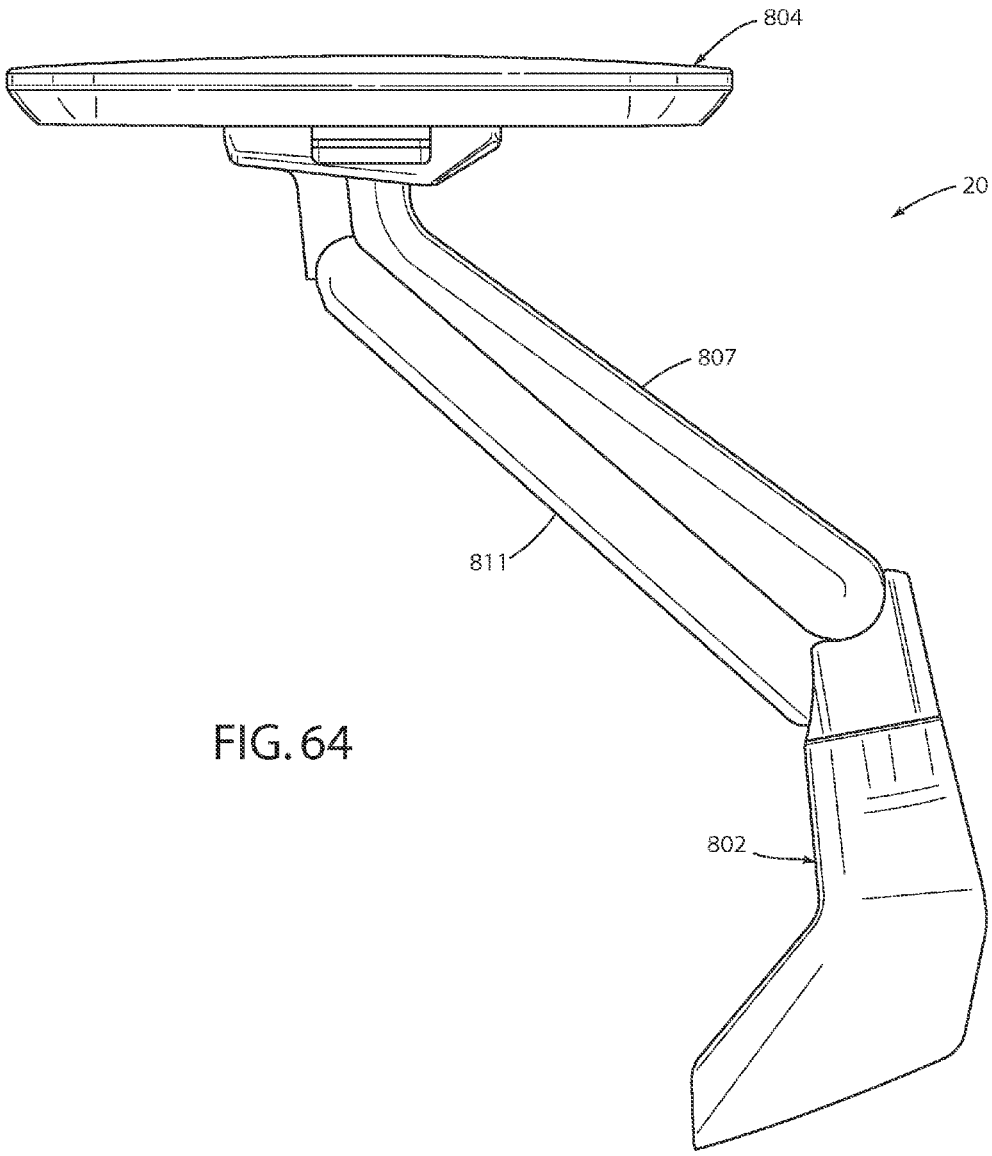
FIG. 64 is a first side elevational view of the arm assembly.
Figure 65:
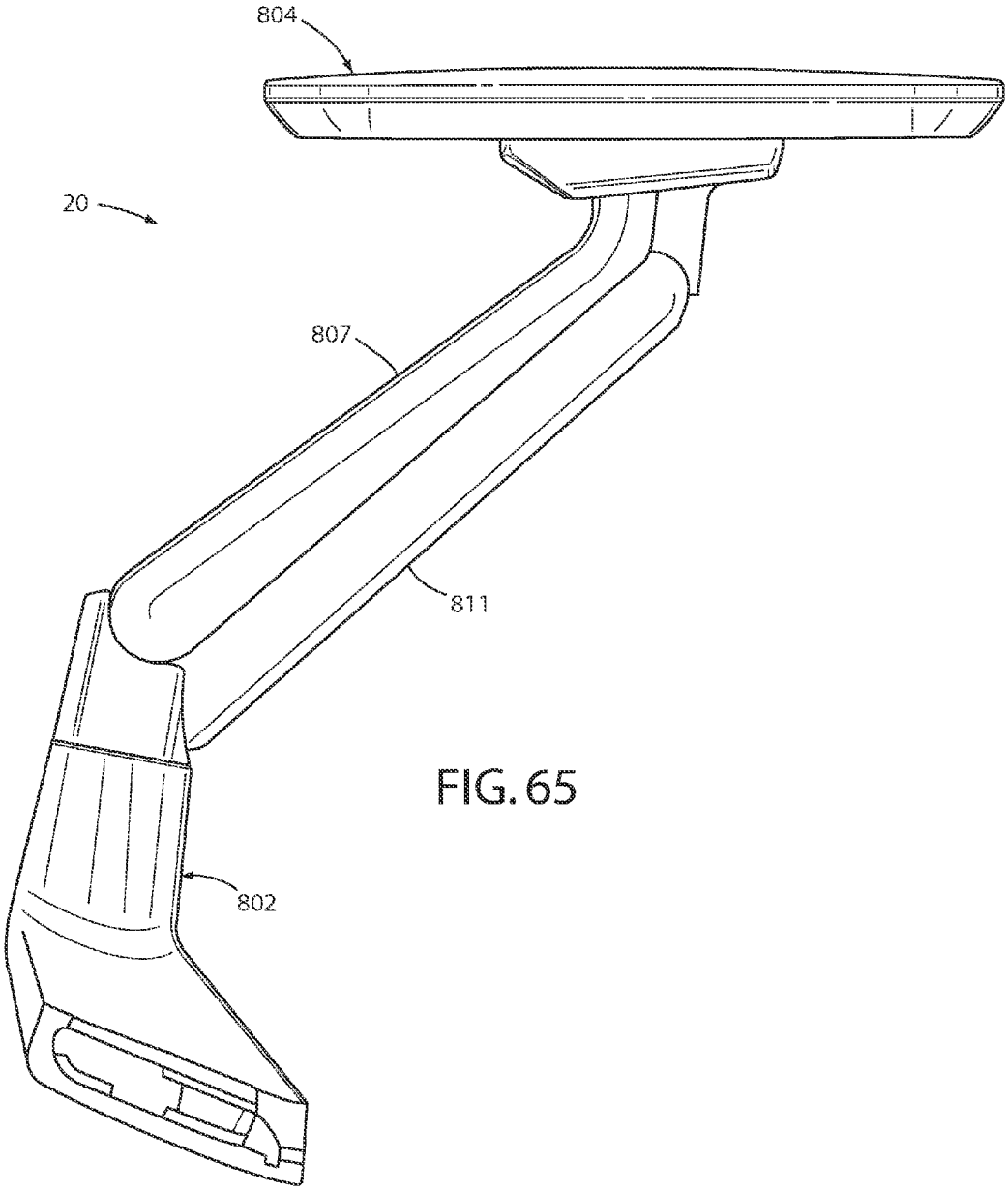
FIG. 65 is a second side elevational view of the arm assembly.
Figure 66:
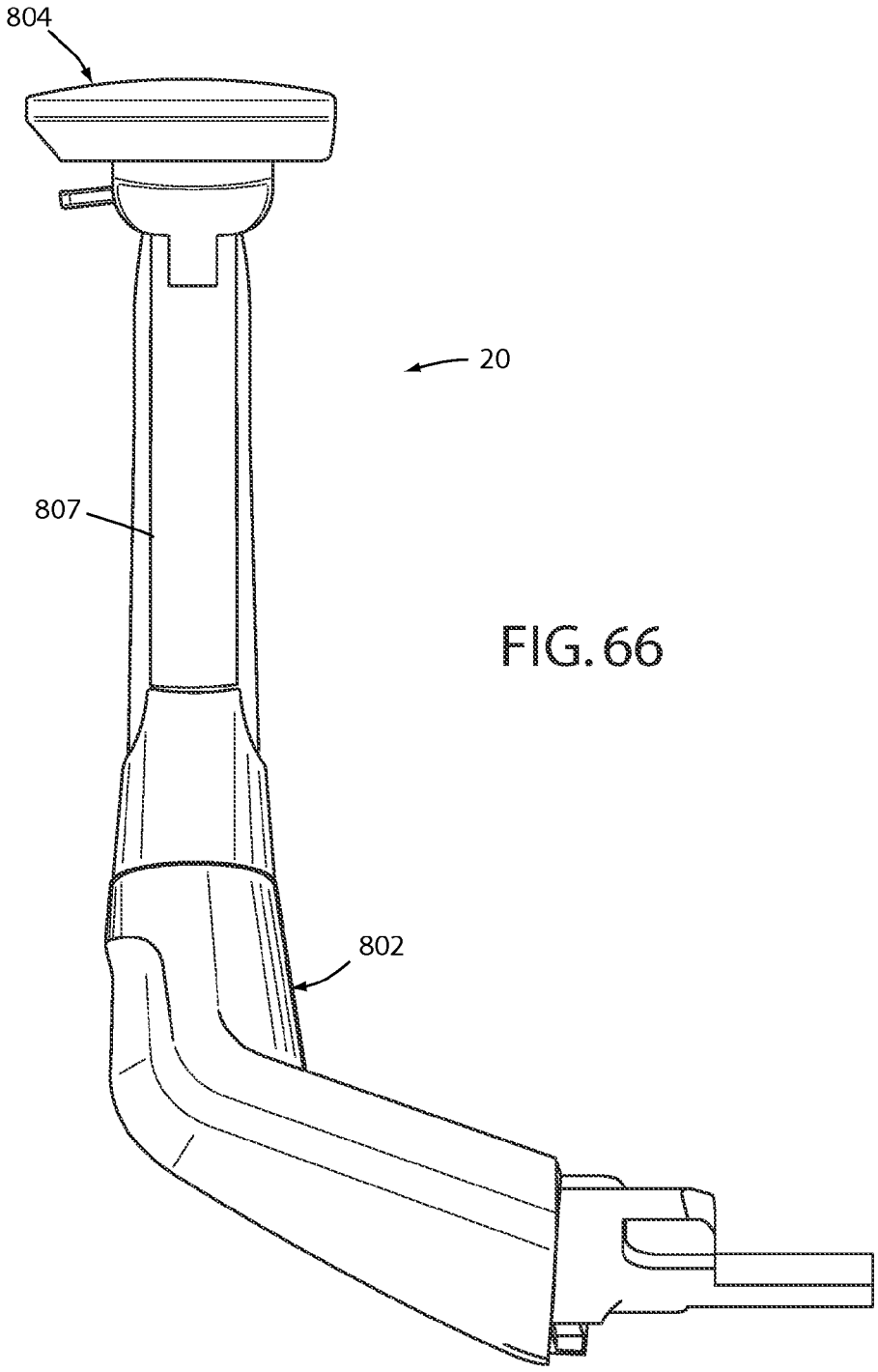
FIG. 66 is a rear side elevational view of the arm assembly.
Figure 67:
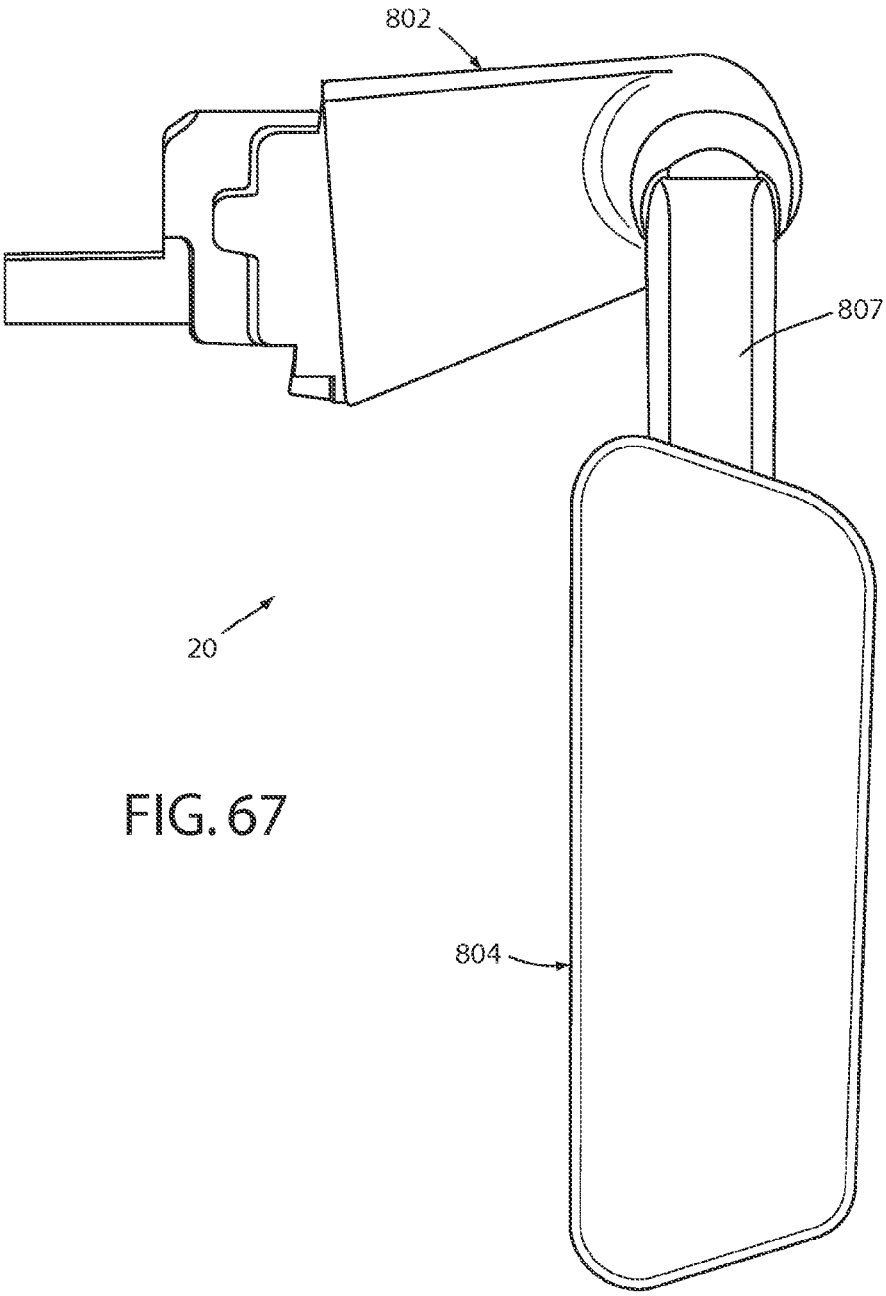
FIG. 67 is a top plan view of the arm assembly.
Figure 68:
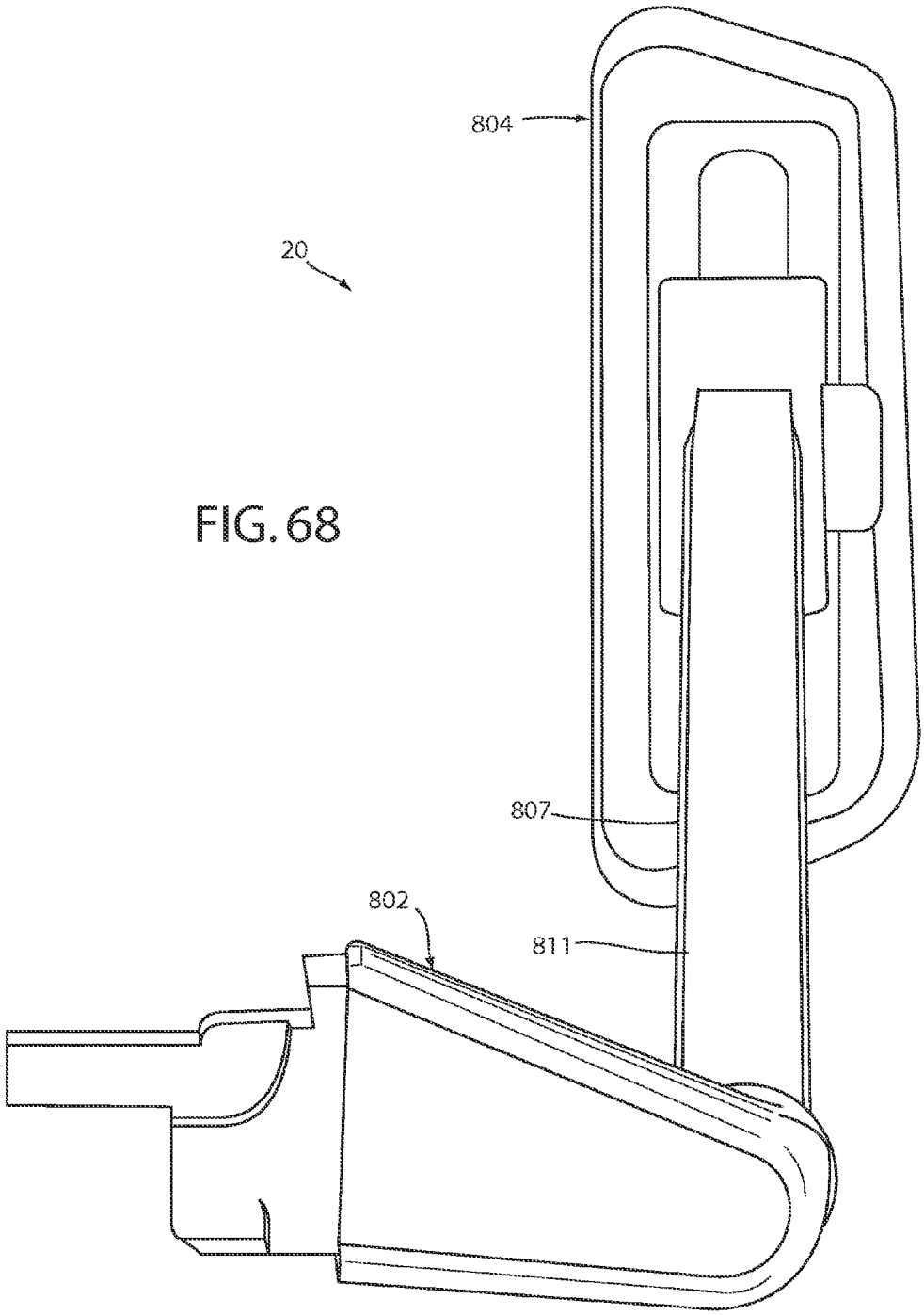
FIG. 68 is a bottom plan view of the arm assembly.

A chair assembly embodiment is illustrated in a variety of views, including a perspective view (FIG. 55), a front elevational view (FIG. 56), a first side elevational view (FIG. 57), a second side elevational view (FIG. 58), a rear elevational view (FIG. 59), a top plan view (FIG. 60), and a bottom plan view (FIG. 61). An arm assembly embodiment is illustrated in a variety of views, including a perspective view (FIG. 62), a front elevational view (FIG. 63), a first side elevational view (FIG. 64), a second side elevational view (FIG. 65), a rear elevational view (FIG. 66), a top plan view (FIG. 67), and a bottom plan view (FIG. 68).

In the foregoing description, it will be readily appreciated by those skilled in the art that alternative embodiments of the various components and elements of the invention and modifications to the invention may be made without departing when the concept is disclosed. Such modifications are to be considered as included in the following claims, unless these claims by their language expressly state otherwise.

The invention claimed is:

1. A chair assembly, comprising:

a four-bar linkage assembly, comprising:

a first linkage member having a first end, a second end, and a U-shaped cross-sectional configuration located along a length thereof;

a second linkage member having a first end, a second end, and a U-shaped cross-sectional configuration located along a length thereof, and wherein the first linkage member and the second linkage member cooperate to form an interior space extending longitudinally along the lengths of the first and second linkage members;

a third linkage member having a first end pivotably coupled to the first end of the first linkage member for rotation about a first pivot point, and a second end pivotably coupled to the first end of the second linkage member for rotation about a second pivot point; and a fourth linkage member having a first end pivotably coupled to the second end of the first linkage member for rotation about a third pivot point, and a second end pivotably coupled to the second end of the second linkage member for rotation about a fourth pivot point;

wherein the four-bar linkage assembly includes a lower end and an upper end that is vertically adjustable between a raised position and a lowered position;

an arm rest assembly adapted to support the arm of a seated user thereon and supported on the upper end of the four-bar linkage assembly; and a locking assembly including a first locking link having a first surface and a second locking link having plurality of teeth corresponding to a plurality of vertical positions of the four-bar linkage located between the raised position and the lowered position, wherein the first and second locking links are movable with respect to one another between a locked position, wherein the first surface engages at least one of the plurality of teeth to prevent adjustment of the four-bar linkage between the raised and lowered positions, and an unlocked position, wherein the first surface is spaced from the plurality of teeth, thereby allowing the four-bar linkage to be adjusted between the raised and lowered positions; and wherein at least a substantial portion of both the first and second locking links are located within the interior space.

2. The chair assembly of claim 1, further including:

a first cover member at least partially housing the first linkage member, and having at least one elongated first edge portion;

a second cover member at least partially housing the second linkage member, and having at least one elongated second edge portion at least partially overlapping the first edge portion, wherein the first edge portion and second edge portion move relative to one another as the four-bar linkage assembly is adjusted between the raised and lowered positions.

3. The chair assembly of claim 2, wherein the first edge portion and the second edge portion overlap with one another in both the raised and lowered positions.

4. The chair assembly of claim 1, wherein the third linkage member includes the plurality of teeth.

5. The chair assembly of claim 1, wherein the first locking link is pivotably coupled to the first linkage member.

6. The chair assembly of claim 1, wherein the locking assembly is biased towards the locked position.

7. The chair assembly of claim 6, wherein the locking assembly is biased towards the locked position by a leaf spring.

8. A chair assembly, comprising:

an arm support structure;

an arm rest assembly adapted to support the arm of a seated user thereon;

an arm support assembly having a lower end supported by the arm support structure, and an upper end supporting the arm rest assembly thereon, wherein the arm support assembly is adjustable between a vertically raised position and a vertically lowered position; and a locking assembly, comprising:

a first locking link having at least one of a first surface and a plurality of teeth;

a second locking link having the other of the first surface and the plurality of the teeth, and movable between a locked position, wherein the first surface engages at least one of the plurality of teeth to prevent adjustment of the arm support assembly between the raised and lowered positions, and an unlocked position, wherein the first surface is spaced from the plurality of teeth, thereby allowing the arm support assembly to be adjusted between the raised and lowered positions;

an actuator link operably coupled with the first locking link and adapted to move between a first position, wherein the first locking link is moved by the actuator link to the locked position, and a second position, wherein the first locking link is moved by the actuator link to the unlocked position; and an actuator member operably coupled with the actuator link, wherein at least a portion of the actuator member may be actuated by a seated user, thereby allowing the user to move the actuator link between the first and second positions; and wherein the second locking link is biased towards the locked position by a leaf spring.

9. The chair assembly of claim 8, wherein the second locking link is biased towards the locked position.

10. The chair assembly of claim 8, wherein the actuator link is pivotably coupled to the arm support assembly.

11. The chair assembly of claim 10, wherein the first locking link is pivotably coupled to the arm support assembly.

12. A chair assembly, comprising:

an arm support structure;

an arm rest assembly adapted to support the arm of a seated user thereon;

an arm support assembly having a lower end supported by the arm support structure, and an upper end supporting the arm rest assembly thereon, wherein the arm support assembly is adjustable between a vertically raised position and a vertically lowered position; and a locking assembly, comprising:

a first locking link having at least one of a first surface and a plurality of teeth;

a second locking link having the other of the first surface and the plurality of the teeth, and movable between a locked position, wherein the first surface engages at least one of the plurality of teeth to prevent adjustment of the arm support assembly between the raised and lowered positions, and an unlocked position, wherein the first surface is spaced from the plurality of teeth, thereby allowing the arm support assembly to be adjusted between the raised and lowered positions;

an actuator link operably coupled with the first locking link and adapted to move between a first position, wherein the first locking link is moved by the actuator link to the locked position, and a second position, wherein the first locking link is moved by thee actuator link to the unlocked position; and an actuator member operably coupled with the actuator link, wherein at least a portion of the actuator member may be actuated by a seated user, thereby allowing the user to move the actuator link between the first and second positions; and wherein the actuator link includes a leaf spring.

13. A chair assembly, comprising:

an arm support structure;

an arm rest assembly adapted to support the arm of a seated user thereon;

an arm support assembly having a lower end supported by the arm support structure, and an upper end supporting the arm rest assembly thereon, wherein the arm support assembly is adjustable between a vertically raised position and a vertically lowered position; and a locking assembly, comprising:

a first locking link having at least one of a first surface and a plurality of teeth;

a second locking link having the other of the first surface and the plurality of the teeth, and movable between a locked position, wherein the first surface engages at least one of the purality of teeth to prevent adjustment of the arm support assembly between the raised and lowered positions, and an unlocked position, wherein the first surface is spaced from the plurality of teeth, thereby allowing the arm support assembly to be adjusted between the raised and lowered positions;

an actuator link operably coupled with the first locking link and adapted to move between a first position, wherein the first locking link is moved by the actuator link to the locked position, and a second position, wherein the first locking link is moved by the actuator link to the unlocked position; and an actuator member operably coupled with the actuator link, wherein at least a portion of the actuator member may be actuated by a seated user, thereby allowing the user to move the actuator link between the first and second positions; and wherein the actuator link includes an arcuately-shaped abutment surface, and wherein the actuator member abuts the abutment surface of the actuator link.

14. An arm rest assembly for an office chair, the armrest assembly comprising:

an outer member having a cushion mounted thereto;

an inner member configured to be secured to an office chair structure, the inner member having teeth disposed thereon;

upper and lower members extending between and pivotably coupling the inner and outer members to form a four-bar linkage;

a vertical adjustment lock assembly to lock the height of the cushion relative to the inner member;

the vertical adjustment lock assembly comprising:

a movable release member;

an actuator member that shifts between a locked position and an unlocked position upon movement of the release member, the actuator member defining a base end;

a pivotable locking member with teeth that selectively engage the teeth on the inner member of the four-bar linkage; and a spring biasing the actuator member towards the locked position and also biasing the teeth of the pivotable locking member out of engagement with the teeth on the inner member of the four-bar linkage;

wherein the base end of the actuator member moves into a first recess of the locking member to permit movement of the locking member teeth out of engagement with the teeth of the inner member of the four-bar linkage; and a second lock including a locking second recess in the locking member that receives the end of the actuator member and prevents movement of the locking member when a downward force is applied to the cushion.

15. The arm rest assembly of claim 14, wherein the first recess comprises a shallow V-shaped surface.

16. The arm rest assembly of claim 15, wherein the first recess comprises first and second substantially flat surfaces that intersect one another to define a vertex of the shallow V-shaped surface, and wherein the locking second recess is formed in the first generally flat surface at a location that is spaced apart from the vertex.

17. The arm rest assembly of claim 16, wherein the spring comprises a leaf spring.

18. The arm rest assembly of claim 17, wherein the leaf spring generates a moment acting on the pivotable lock.

19. The arm rest assembly of claim 18, wherein the leaf spring generates a moment acting on the actuator member.

20. The arm rest assembly of claim 14, wherein the actuator member is pivotably coupled to the upper member, and forms a rigid triangular linkage with the upper member and the inner member when the base end of the actuator member engages the locking second recess.

21. A chair assembly, comprising:

a base structure defining an upper portion and a lower portion located below the upper portion;

a seat support structure including an upwardly-facing seat support surface configured to support a seated user thereon;

an upwardly-extending back structure having a forwardly-facing back support surface configured to support a user's back in a generally upright position;

a control link having a first end pivotably coupled to the rearward portion of the seat support structure, and a second end pivotably coupled to the rearward portion of the back support structure;

an arm rest assembly including an arm support structure coupled to the seat support structure, the arm rest assembly having an upwardly-facing arm support surface that is movable upwardly and downwardly, and a four-bar linkage assembly movably coupled to the arm support structure and the arm rest assembly, wherein the four-bar linkage assembly comprises:

a first linkage member having a first end and a second end;

a second linkage member having a first end and a second end;

a third linkage member having a first end pivotably coupled to the first end of the first linkage member for rotation about a first pivot point, and a second end pivotably coupled to the first end of the second linkage member for rotation about a second pivot point; and a fourth linkage member having a first end pivotably coupled to the second end of the first linkage member for rotation about a third pivot point, and a second end pivotably coupled to the second end of the second linkage member for rotation about a fourth pivot point;

wherein the first, second, third, and fourth pivot points define first, second, third, and fourth corners of the four-bar linkage, respectively, and wherein the first and fourth corners define a diagonal distance therebetween that becomes smaller as the arm support surface moves downwardly; and a rigid link operably coupling the first and fourth corners to thereby place the rigid link in compression to prevent the diagonal distance from becoming smaller to thereby lock the arm support surface at a user-selected height.

22. The arm rest assembly of claim 21, wherein the arm support surface is disposed on the third linkage member.

23. The arm rest assembly of claim 22, wherein the fourth linkage member comprises an inner member having teeth disposed thereon and being fixed to the arm support structure, and including:

a pivotable locking member with teeth that selectively engage the teeth on the inner member of the four-bar linkage.

24. The arm rest assembly of claim 23, wherein the rigid link comprises an actuator member that shifts between locked and unlocked positions, the actuator member defining a base end; and including:

a spring biasing the actuator member towards the locked position and also biasing the teeth of the pivotable locking member out of engagement with the teeth on the inner member of the four-bar linkage;

wherein the base end of the actuator member is movable into a first recess of the locking member to permit movement of the locking member teeth out of engagement with the teeth of the inner member of the four-bar linkage.

25. The arm rest assembly of claim 24, including:

a second lock including a locking second recess in the locking member that receives the base end of the actuator member and prevents movement of the locking member when a downward force is applied to the cushion.

26. The arm rest assembly of claim 25, wherein the base end of the actuator member is pointed.

* * * * *

UNITED STATES PATENT AND TRADEMARK OFFICE

CERTIFICATE OF CORRECTION

PATENT NO. : 8,967,724 B2
APPLICATION NO. : 14/029194
DATED : March 3, 2015
INVENTOR(S) : Battey et al.

It is certified that error appears in the above-identified patent and that said Letters Patent is hereby corrected as shown below:

On the Title page

*Abstract, line 6, replace “on” with --one--;

*Abstract, line 7, delete “a”;

*Abstract, line 11, after “having” insert --a--;

*Related U.S. Application Data, page 2, item (60), line 1, replace “60/703,677” with --61/703,677--;

In the Specification

*Col. 1, line 53, delete “of”;

*Col. 2, line 53, replace “actuate” with --actuated--;

*Col. 3, line 2, replace “moveable” with --movable--;

*Col. 5, line 35, replace “a” with --an--;

*Col. 6, line 67, replace “maybe” with --may be--;

*Col. 8, line 5, replace “portion” (1st occurrence) with --portions--;

*Col. 8, line 48, after “134” insert --is--;

*Col. 8, line 53, after “part” insert --of--;

Signed and Sealed this
Twenty-fifth Day of August, 2015

Michelle K. Lee

Michelle K. Lee
*Director of the United States Patent and Trademark Office*

*Col. 10, line 6, replace “16a and 16b” with --16A and 16B--;

*Col. 13, line 22, delete “back”;

*Col. 16, line 35, after “and” insert --in--;

*Col. 16, line 36, replace “is” with --are--;

*Col. 19, line 11, delete “that”;

*Col. 20, line 32, replace “fore-and-aft” with --fore-to-aft--;

*Col. 20, line 44, after “arm” (1st occurrence) insert --member--;

*Col. 21, line 17, replace “arm-base” with --arm base--;

*Col. 24, line 25, replace “protracted” with --retracted--;

*Col. 24, line 66, after “without departing” insert --from the concepts disclosed herein,--;

In the Claims

*Col. 25, claim 1, line 35, after “having” insert --a--;

*Col. 26, claim 8, line 33, delete “and”;

*Col. 27, claim 12, line 6, delete “and”;

*Col. 27, claim 13, line 41, delete “and”;

*Col. 27, claim 13, line 46, delete “and”;

*Col. 27, claim 13, line 48, replace “,” with --;--;

*Col. 29, claim 23, line 18, replace “,” with --;--.